US007053888B2

(12) United States Patent
Ando

(10) Patent No.: US 7,053,888 B2
(45) Date of Patent: May 30, 2006

(54) IMAGE DISPLAY APPARATUS

(75) Inventor: Muneki Ando, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 594 days.

(21) Appl. No.: 10/054,895

(22) Filed: Jan. 25, 2002

(65) Prior Publication Data

US 2003/0020698 A1 Jan. 30, 2003

(30) Foreign Application Priority Data

Jan. 26, 2001 (JP) ..... 2001-018081
Jan. 25, 2002 (JP) ..... 2002-016776

(51) Int. Cl.
*G09G 3/28* (2006.01)
*G09G 5/00* (2006.01)

(52) U.S. Cl. ..... 345/204; 345/60; 345/213

(58) Field of Classification Search ..... 345/204, 345/75.2, 76, 77, 78, 98, 100, 211, 212, 213, 345/214, 80–89, 90, 92, 94, 99; 315/169.2–169.3; 313/495–497
See application file for complete search history.

(56) References Cited

U.S. PATENT DOCUMENTS

| | | | | |
|---|---|---|---|---|
| 5,307,085 | A | 4/1994 | Nakamura | 345/99 |
| 5,710,604 | A | 1/1998 | Hodson et al. | 348/717 |
| 5,771,031 | A | 6/1998 | Kinoshita et al. | 345/98 |
| 6,552,702 | B1 * | 4/2003 | Abe et al. | 345/75.2 |
| 6,653,794 | B1 * | 11/2003 | Sagano et al. | 315/169.2 |
| 2002/0021483 | A1 * | 2/2002 | Katase | 359/267 |
| 2002/0047512 | A1 * | 4/2002 | Shinjo et al. | 313/495 |
| 2003/0095085 | A1 * | 5/2003 | Abe | 345/74.1 |

FOREIGN PATENT DOCUMENTS

| | | |
|---|---|---|
| JP | 3-188492 | 8/1991 |
| JP | 5-100632 | 4/1993 |
| JP | 8-211846 | 8/1996 |
| JP | 11-85119 | 3/1999 |
| JP | 2000-293134 | 10/2000 |

* cited by examiner

*Primary Examiner*—Vijay Shankar
*Assistant Examiner*—Nitin Patel
(74) *Attorney, Agent, or Firm*—Fitzpatrick, Cella, Harper & Scinto

(57) ABSTRACT

An image display apparatus include a plurality of scan wirings and a plurality of modulation wirings forming a matrix, display elements to be driven in matrix according to a scan signal applied by the scan wirings and a modulation signal applied by the modulation wirings, and a scan circuit for scanning the plurality of scan wirings and applying a scan signal to the selected scan wiring. An output circuit stores an input signal to be inputted in time-series, generates a plurality of outputs consisting of a time-series signal for generating a modulation signal based on the stored result and outputs the plurality of outputs to a plurality of output paths as parallel outputs. In addition, a modulation side drive circuit outputs parallel modulation signals based on the time-series signal for generating a modulation signal. The modulation side drive circuit is provided in a plural form corresponding to each of the plurality of output paths and each of the plurality of modulation side drive circuits supplies the modulation signal to a part of and a plurality of modulation wirings among the plurality of modulation wirings, and the output circuit starts to output at least one of the parallel outputs before storing the input signal for constituting the rearmost end among respective rear ends of the parallel outputs.

47 Claims, 29 Drawing Sheets

IMAGE DISPLAY APPARATUS

BACKGROUND OF THE INVENTION

1. Field of the Invention

The present invention relates to an image display apparatus for forming an image using a plurality of display elements, an image display method for the image display apparatus, an image display program for the image display method and a computer readable recording medium having the image display program recorded therein.

2. Related Background Art

Conventionally, various image display apparatuses have been developed as those for forming an image on a plane. For example, an example of such a conventional image display apparatus will be described with reference to FIGS. 22 and 23.

FIG. 22 is a diagram showing a configuration of a conventional image display apparatus disclosed in Japanese Patent Application Laid-Open No. 5-100632 and FIG. 23 is a timing chart of the image display apparatus shown in FIG. 22.

As shown in FIGS. 22 and 23, when the number of pixels of a display panel 2201 increases, a transfer rate of a data signal 2223 rises accordingly.

Thus, in the conventional image display apparatus, a transmission line of the data signal 2223 and a shift register in a data side drive circuit 2224 are required to operate at a high speed.

As a method of solving the above-mentioned requirement for high-speed operation, a configuration shown in FIGS. 24 and 25 is proposed in Japanese Patent Application Laid-Open No. 5-100632. FIG. 24 is a diagram of a conventional image display apparatus and FIG. 25 is a timing chart of the image display apparatus shown in FIG. 24.

As shown in FIGS. 24 and 25, it is an object of this image display apparatus to divide a data signal 2423 to store the divided signals in a recording circuit unit 2404 and forward luminance data 1 to 4 (2416 to 2419) in parallel and simultaneously, thereby reducing operation speeds of a transmission line of the luminance data and a shift register.

In addition, as shown in the timing chart of FIG. 25, the image display apparatus is configured to display data for one scan wiring after completing transfer of the entire data. As a configuration for realizing such an operation, a method called a double buffer is conceivable. The method uses two sets of storage circuits equivalent to a data capacity for one scan wiring as a storing device for one scan wiring, stores data in one set of storage circuits during one scanning period and stores data in the next set of storage circuits while forwarding the data stored in the preceding storage circuits during the next scanning period.

On the other hand, as an example of another conventional image display apparatus, there is an image display apparatus disclosed in U.S. Pat. No. 5,710,604. The image display apparatus disclosed in U.S. Pat. No. 5,710,604 will be described with reference to FIGS. 26 and 27. FIG. 26 is a diagram of the image display apparatus disclosed in U.S. Pat. No. 5,710,604 and FIG. 27 is a timing chart of the image display apparatus shown in FIG. 26.

The image display apparatus disclosed in U.S. Pat. No. 5,710,604 is a display apparatus for displaying colors in a color sequential manner, in which timing is inputted in a control unit 2614 and data is inputted in a memory 2612.

Then, the image display apparatus uses a row driver 2620, a column driver 2618 and an anode power supply 2616 to control a field display 2622 to thereby display an image. A capacity for two sets of storage circuits that are required as a double buffer is cut down in this image display apparatus.

SUMMARY OF THE INVENTION

There is known an image display apparatus using a method of selectively arranging image data of each of R, G and B. This image display apparatus for selectively arranging image data of each of R, G and B will be described with reference to FIGS. 28 and 29.

FIG. 28 is a diagram of an image display apparatus using a matrix display panel and FIG. 29 is a timing chart of signals of the image display apparatus shown in FIG. 28.

In FIG. 28, reference numeral 2801 denotes a display panel in which scan wirings and modulation wirings are arranged in a matrix shape. Reference numeral 2803 denotes a drive unit for driving modulation wirings.

Reference numeral 2803-1 denotes a modulation drive circuit for carrying out modulation drive and 2803-2 denotes a latch circuit for holding modulation data.

Reference numeral 2803-3 denotes a shift register and 2802 denotes a scan side drive unit of scan wirings. Reference numeral 2833 denotes a display timing generator for generating timing for driving a panel.

Reference numeral 2830 denotes an A/D unit for digitizing an inputted image signal. Reference numeral 2831 denotes an RGB selective arrangement unit for selectively arranging an image signal of each of R, G and B in accordance with a pixel arrangement of a display panel.

The A/D unit 2830 digitizes an image signal S1 of each of R, G and B inputted in a display device to generate digital image signals S2-1 to S2-3.

The RGB selective arrangement unit 2831 selectively arranges data such that the digital image signals S2 correspond to a pixel arrangement of the display panel 2801 to generate a luminance signal S3.

The shift register 2803-3 inputs luminance data in the drive unit. The latch circuit 2803-2 stores data of the shift register.

The modulation drive circuit 2803-1 drives the display panel 2801 based on latched data in accordance with display drive timing S5.

In addition, a transfer timing generator 2832 and the display timing generator 2833 generates timing signals S6 and S7 and display drive timing S4 and S5, respectively, based on the inputted image signal S1.

The scan side drive unit 2802 scans scan electrodes of the display panel 2801 in order in accordance with the display drive timing S4.

Since image data of each of R, G and B is selectively arranged in this image display apparatus, the luminance signal S3 has a data amount three times as large as that before the image data is selectively arranged and requires a transfer speed three times as high as that of the image signal S. In addition, the shift register 2803-3 is also required to operate at an equivalent speed.

As a measure for coping with these requirements, we considered lowering an operation speed of the shift register 2803-3 by employing the configuration disclosed in Japanese Patent Application Laid-Open No. 5-100632 to divide the luminance signal S3 and transfer the divided signal in parallel.

However, when the recording circuit unit 2404 is configured considering the description of Japanese Patent Application Laid-Open No. 5-100632, a storage capacity twice as large as a data capacity of a shift register is required. A high-speed memory usable in this recording circuit is expensive, which results in a costly apparatus.

It is an object of the present invention to realize a configuration capable of preferably carrying out image display using a modulation side drive circuit including a conversion circuit (shift register and the like) for converting a time-series signal to a parallel signal. More specifically, it is one of the objects of the present invention to provide an image display apparatus that can manage with a low operating speed of a conversion circuit and/or a small memory usage, an image display method for the image display apparatus, an image display program for the image display method and a computer readable recording medium having the image display program recorded therein.

One aspect of the present invention of the present invention is configured as described below.

The present invention relates to an image display apparatus comprising:

a plurality of scan wirings;

a plurality of modulation wirings for constituting a matrix wiring together with the scan wirings;

display elements to be driven in matrix according to a scan signal to be applied by the scan wirings and a modulation signal applied by the modulation wirings;

a scan circuit for selecting the plurality of scan wirings one after another and applying a scan signal to the selected scan wiring;

an output circuit for storing an input signal to be inputted in time-series, generating a plurality of outputs consisting of a time-series signal for generating a modulation signal based on the stored result and outputting the plurality of outputs to a plurality of output paths as parallel outputs; and a modulation side drive circuit for outputting parallel modulation signals based on the time-series signal for generating a modulation signal, wherein the modulation side drive circuit is provided in a plural form corresponding to each of the plurality of output paths and supplies the modulation signal to a part of and a plurality of modulation wirings among the plurality of modulation wirings, and wherein the output circuit starts to output at least one of the parallel outputs before storing the input signal for constituting the rearmost end among respective rear ends of the parallel outputs.

Here, as the modulation side drive circuit, for example, a modulation side drive circuit of a configuration for converting time-series signals to parallel signals by using a shift register can be employed. Further, the modulation side drive circuit may be combined with a latch circuit if output timing of parallel signals cannot be controlled to a desired state by the shift register only. In addition, a configuration can be preferably employed, in which a modulation side drive circuit for generating a modulation signal based on a signal to be outputted from a shift register or a latch circuit is arranged between the shift register (or the latch circuit if it is used) without turning an output of the shift register or the latch circuit directly into a signal that should be applied to modulation wirings. As this drive circuit, a drive circuit for modulating an output level (peak value) of a signal based on an inputted signal to output the signal, a drive circuit for modulating a pulse width of a signal to output the signal, or a drive circuit for modulating a signal by a combination of peak value modulation and pulse width modulation to output the signal can be preferably employed.

Further, for example, each pixel of a liquid crystal panel or a plasma display panel, an electron-emitting element, an electroluminescence element and each mirror of a micro-mirror integrated device for integrating micro-mirrors to control reflection of light are equivalent to the display elements. If a liquid crystal or a micro-mirror integrated device is used, it is sufficient to use them with a light source. If an electron-emitting element is used, it is sufficient to use it with a fluorescent substance that emits light by an emitted electron. Note that, to the display elements are applied a scan signal and a modulation signal to be driven and, more specifically, is applied a potential difference between a potential given as a scan signal and a potential given as a modulation signal to be driven. In case of the peak value modulation, a peak value of a modulation signal in an ON state is specifically modulated. In case of the pulse width modulation, a pulse width of a modulation signal in an ON state is specifically modulated.

Further, it is not necessary to store all input signals in the output circuit and, for example, an input signal that is simultaneously inputted in the output circuit and outputted from the output circuit may be outputted without being stored.

According to another aspect of the present invention, it is preferable if a plurality of (preferably all) outputs among the above-mentioned parallel outputs are started to be outputted substantially simultaneously. Note that, when the term substantially simultaneously is used in this description and the following descriptions, a tolerance of the term means a range in which a deviation of outputs can be neglected and the outputs can be treated as simultaneous in the subsequent circuit or the deviation can be eliminated using a simple timing adjustment circuit (buffer of a small capacity or the like).

In addition, in each of the above-mentioned aspects of the present invention, a configuration can be preferably employed in which the above-mentioned signal to be inputted in time-series has first to Dth parts (D is an integer equal to or larger than 2) in the order of input in the above-mentioned output circuit, and the above-mentioned output circuit is for outputting The above-mentioned D parallel outputs based on each of the D parts and starts to output a first output corresponding to the first part when a Dth output corresponding to the Dth part is ready to be outputted or later. Note that "when the Dth output is ready to be outputted" means, for example, a point of time when it is inputted in the output circuit and, in particular, a point of time when input in a memory for storing the signal is started in the output circuit.

In addition, according to still another aspect of the present invention, it is preferable if the above-mentioned signal to be inputted in time-series has first to Dth parts (D is an integer equal to or larger than 2) in the order of input in the above-mentioned output circuit, and the above-mentioned output circuit is for outputting the above-mentioned D parallel outputs based on each of the D parts, and starts to output a first output corresponding to the first part substantially simultaneously with the start of output of a Dth output corresponding to the Dth part.

In addition, according to yet another aspect of the present invention, a configuration can be preferably employed in which the above-mentioned signal to be inputted in time-series has first to Dth parts (D is an integer equal to or larger than 2) in the order of input in the above-mentioned output circuit, and the above-mentioned output circuit is for outputting the above-mentioned D parallel outputs based on each of the D parts and starts to output the D outputs substantially simultaneously.

In addition, in each of the above-mentioned aspects of the present invention, a configuration can be preferably employed in which the above-mentioned signal to be inputted in time-series has first to Dth parts (D is an integer equal to or larger than 2) in the order of input in the above-mentioned output circuit, and the above-mentioned output circuit is for outputting the above-mentioned D parallel outputs based on each of the D parts and finishes outputting the D outputs substantially simultaneously.

Further, in each of the above-mentioned aspects of the present invention, a configuration can be preferably employed in which an input signal to be inputted in the above-mentioned output circuit in time-series in order to output the above-mentioned plurality of parallel outputs is n time-series input signals for generating n modulation signals to be supplied in parallel with each other to the above-mentioned modulation wirings, the above-mentioned output circuit is for storing the n time-series input signals in first to Dth memories (D is an integer equal to or larger than 2) one after another in the order of input, the above-mentioned each memory is for writing the above-mentioned input signal in an address designated by a write address to be given and reading a signal written in an address designated by a read address to be given, a write address to be given to an Xth memory ($1 \leqq X \leqq D$) changes during a period from the time when an $n(X-1)/D+1$th input signal among the above-mentioned n input signals is inputted until the time when nX/Dth input signal is inputted in the order of 1 to n/D in synchronism with the input signals, and the signal stored in the above-mentioned each memory is read out by giving the above-mentioned read address to each memory and an output from each memory is outputted as the above-mentioned D parallel outputs.

Further, here, a configuration can be preferably employed in which the above-mentioned read address to be given to the Xth memory ($1 \leqq X \leqq D$) changes during a period from the time when $n(D-1)/D+1$th input signal among the above-mentioned n input signals is inputted until the time when n/Dth input signal among the next n input signals is inputted (particularly preferably, using the entire period) in the order of 1 to n/D.

In this configuration, it is also preferable if a starting point in time and an ending point in time of each parallel output are arranged in order. In particular, according to this configuration, a starting point in time and an ending point in time of each parallel output can be easily arranged in order. Note that, in this configuration, an output path can be used most effectively when D=2.

In addition, a configuration can also be preferably employed in which a delay circuit is further provided, the above-mentioned signal to be inputted in time-series has first to Dth parts (D is an integer equal to or larger than 2) in the order of input in the above-mentioned output circuit, the above-mentioned output circuit is for outputting the above-mentioned D parallel outputs based on each of the D parts and starting to output at least one output among the D outputs earlier than starting to output other outputs, and the above-mentioned delay circuit is for delaying inputting the output, which is started to be outputted earlier, in the above-mentioned modulation side drive circuit.

Here, a delay amount by the delay circuit is favorably set such that a time difference between the start of input of an output, which is started to be outputted earlier, in the modulation side drive circuit and the start of input of other outputs in the modulation side drive circuit is smaller than a time difference between the start of output of an output which is started to be outputted earlier and the start of output of other outputs. In particular, it is favorable to set a delay amount such that the start of input of each output in the modulation side drive circuit is substantially simultaneous.

In addition, a configuration can be preferably employed in which a delay circuit is further provided, the above-mentioned signal to be inputted in time-series has first to Dth parts (D is an integer equal to or larger than 3) in the order of input in the above-mentioned output circuit, the output circuit is for outputting the above-mentioned D parallel outputs based on each of the D parts and starts to output each of first to D−2th outputs corresponding to the above-mentioned first to D−2th parts, respectively, earlier than output of D−1th part and Dth part, and the above-mentioned delay circuit is for delaying inputting each of the above-mentioned first to D−2th outputs in each of the above-mentioned modulation side drive circuits.

Further, a configuration can be preferably employed in which the above-mentioned signal to be inputted in time-series has first to Dth parts (D is an integer equal to or larger than 3) in the order of input in the above-mentioned output circuit, the above-mentioned output circuit is for outputting the above-mentioned D parallel outputs based on each of the D parts, starting an Xth output ($1 \leqq X \leqq D-1$) at a delay of a first predetermined period from the start of input of the above-mentioned first part and starting a Dth output at a delay of a second predetermined period from the start of input of the above-mentioned first part, where the above-mentioned first predetermined period is X/D of a reference period that is a period required for inputting the above-mentioned first to Dth parts (more specifically, one scanning period) and the above-mentioned second predetermined period is (D−1)/D of the above-mentioned reference period, and moreover, a delay circuit for giving a delay to an Xth output ($1 \leqq X \leqq D-2$) is provided and a delay amount by the delay circuit is (D−X−1)/D of the above-mentioned reference period.

In addition, in the configuration of the present invention described first and the configuration of the present invention using the above-mentioned delay circuit, a configuration can be preferably employed in which the input signal to be inputted in the above-mentioned output circuit in time-series in order to output the above-mentioned plurality of parallel outputs is n time-series input signals for generating n modulation signals to be supplied in parallel with each other to the above-mentioned modulation wirings, the above-mentioned output circuit is for storing the n time-series input signals in first to Dth memories (D is an integer equal to or larger than 3) one after another in the order of input, and the above-mentioned each memory is for writing the above-mentioned input signals in an address designated by a write address to be given and reading an signal written in an address designated by a read address to be given, a write address to be given to an Xth memory ($1 \leqq X \leqq D$) changes during a period from the time when an $n(X-1)/D+1$th input signal among the above-mentioned n input signals is inputted until the time when nX/Dth input signal is inputted in the order of 1 to n/D in synchronism with the input signals, the above-mentioned read address to be given to the Xth memory ($1 \leqq X \leqq D-1$) changes during a period from the time when nX/D+1th input signal among the above-mentioned n input signals is inputted until the time when nX/Dth input signal among the next n input signals is inputted in the order of 1 to n/D, a read address to be given to the Dth memory changes in the same manner as a read address to be given to a D−1th memory, and an output from each memory is outputted as the above-mentioned D parallel outputs.

In addition, according to a further aspect of the present invention, a configuration can be preferably employed in which the input signal to be inputted in the above-mentioned output circuit in time-series in order to output the above-mentioned plurality of parallel outputs is n time-senes input signals for generating n modulation signals to be supplied to the above-mentioned modulation wirings in parallel, the above-mentioned output circuit is for storing the n time-senes input signals in first to Dth memories (D is an integer equal to or larger than 3) one after another in the order of input, and the above-mentioned each memory is for writing the input signals in an address to be designated by a write address to be given and reading a signal written in an address designated by a read address to be given, a write address to be given to an Xth memory ($1 \leqq X \leqq D$) changes during a period from the time when an $n(X-1)/D+1$th input signal among the above-mentioned n input signals is inputted until the time when nX/Dth input signal is inputted in the order of 1 to n/D in synchronism with the input signals, the above-mentioned read address to be given to the Xth memory ($1 \leqq X \leqq D-1$) changes using an entire period from the time when nX/D+1th input signal among the above-mentioned n input signals is inputted until the time when nX/Dth input signal among the next n input signals is inputted in the order of 1 to n/D, a read address to be given to the Dth memory changes in the same manner as a read address to be given to a D−1th memory, and an output from each memory is outputted as the above-mentioned D parallel outputs.

Further, in each of the above-mentioned aspects of the present invention, a configuration can be preferably employed in which the above-mentioned plurality of modulation side drive circuits are for supplying modulation signals to the same number of the above-mentioned modulation wirings, respectively.

In addition, a configuration can also be employed in which the number of modulation wirings to which each of the above-mentioned plurality of modulation side drive circuits supplies a modulation signal is not the same number.

In this case, a configuration can be preferably employed in which the above-mentioned signal to be inputted in time-series has first to Dth parts (D is an integer equal to or larger than 2) in the order of input in the above-mentioned output circuit, the above-mentioned output circuit is for outputting the above-mentioned D parallel outputs based on each of the D parts, and the number of modulation wirings to which the above-mentioned modulation side drive circuit, in which a first output corresponding to the above-mentioned first part is inputted, supplies a modulation signal is fewer than the number of modulation wirings to which the above-mentioned modulation side drive circuit, in which a Dth output corresponding to the above-mentioned Dth part is inputted, supplies a modulation signal.

Particularly preferably, a configuration can be employed in which the number of modulation wirings to which the modulation side drive circuit, in which a first output corresponding to the first part is inputted, supplies a modulation signal (hereinafter also referred to as the number of modulation wirings corresponding to the first part, the same for other parts) is fewer than any of the numbers of modulation wirings corresponding to each of second to Dth parts.

Here, the input signal to be inputted in time-series in the above-mentioned output circuit in order to output the above-mentioned plurality of parallel outputs is n time-series input signals for generating n modulation signals to be supplied in parallel with each other to the above-mentioned modulation wirings and preferably satisfies a condition:

$$d[X] \leqq M\left(d[D] + \sum_{x=1}^{X} d[x]\right) \quad [X = 1 \sim D-1] \qquad (1)$$

$$d[D] \leqq M\left(\sum_{x=1}^{D} d[x]\right)$$

when the above-mentioned output circuit turns the n time-series input signals into first to Dth parts (D is an integer equal to or larger than 2) in the order of input and outputs an output corresponding to each part as the above-mentioned plurality of parallel outputs, a ratio of the number of modulation wirings to which the above-mentioned modulation side drive circuit, in which an output corresponding to each part is inputted, supplies the above-mentioned modulation signal is d[1]:d[2]: . . . :d[D−1]:d[D], and a transfer speed of a signal in each of the above-mentioned output paths is a speed M times as large as the input speed of the above-mentioned input signal.

In addition, the input signal to be inputted in time-series in the above-mentioned output circuit in order to output the above-mentioned plurality of parallel outputs is n time-series input signals for generating n modulation signals to be supplied in parallel with each other to the above-mentioned modulation wirings and preferably satisfies a condition:

$$d[X] = M\left(d[D] + \sum_{x=1}^{X} d[x]\right) \quad [X = 1 \sim D-1] \qquad (2)$$

$$d[D] = M\left(\sum_{x=1}^{D} d[x]\right)$$

when the above-mentioned output circuit turns the n time-series input signals into first to Dth parts (D is an integer equal to or larger than 2) in the order of input and outputs an output corresponding to each part as the above-mentioned plurality of parallel outputs, a ratio of the number of modulation wirings to which the above-mentioned modulation side drive circuit, in which an output corresponding to each part is inputted, supplies the above-mentioned modulation signal is d[1]:d[2]: . . . :d[D−1]:d[D], and a transfer speed of a signal in each of the above-mentioned output paths is a speed M times as large as the input speed of the above-mentioned input signal.

Further, in each of the above-mentioned aspects of the present invention, preferably, the above-mentioned output circuit has a memory for carrying out the above-mentioned storage and a memory for storing at least the above-mentioned Dth part is a memory capable of nonexclusively carrying out writing and reading. Consequently, since it becomes possible to simultaneously carry out writing and reading of the Dth part, the above-mentioned output circuit can start the output without waiting for the entire Dth part to be stored.

Moreover, preferably, the memory for storing the above-mentioned first part is a memory capable of nonexclusively carrying out writing and reading. Consequently, at least a part of a writing period of the first part can be used as a reading period for the preceding output.

In addition, a configuration can be preferably employed in which the above-mentioned signal to be inputted in time-series has first to Dth parts (D is an integer equal to or larger than 2) in the order of input in the above-mentioned output circuit, the above-mentioned output circuit is for outputting the above-mentioned D parallel outputs based on each of the D parts, memories are provided corresponding to each of the above-mentioned D output paths for outputting the above-mentioned D outputs, at least one of the D memories has two memory blocks for nonexclusively carrying out writing and reading and, after a part of corresponding parts among the above-mentioned D parts is written in one memory block, the two memory blocks carry out writing of the subsequent part in the other memory block and reading of a signal from the above-mentioned memory block in which a part of the above-mentioned input signal is written previously while causing at least a part of the writing and reading to overlap each other.

In particular, each of the above-mentioned D memories preferably has the above-mentioned two memory blocks. Since a memory corresponding to one output path has two or more memory blocks, even if the memory is configured to exclusively carry out writing and reading operations of each memory block, after writing of a signal in a memory block is complete, the memory can read out a signal from the memory block using a period until the time when writing of the next signal in the memory block is started (preferably, the entire period). Therefore, an effect of lowering a transfer speed is remarkably realized. In addition, since it is preferable to lower a transfer speed in each output path and it becomes possible to make a transfer speed in each output path uniform, each memory corresponding to each output path desirably has two or more above-mentioned memory blocks.

Further, here, the above-mentioned output corresponding to the output path is constituted by signals read out from each of two memory blocks corresponding to one output path without overlapping each other.

Moreover, a configuration can be preferably employed in which one of the above-mentioned parallel outputs is constituted by signals read out from each of the above-mentioned two memory blocks one after another and a delay circuit for alleviating deviation in starting of input of each of the parallel outputs in each of the above-mentioned modulation side drive circuits is further provided.

In addition, a configuration can be preferably employed in which, when numbers are allocated to memory blocks, which are provided two for each of the above-mentioned first to Dth outputs, in the order of inputting the above-mentioned input signals, the number of input signals to be written in a memory block of an odd number and the number of input signals to be written in a memory block of an even number satisfy the expression: $1/D \leqq$ the number of input signals to be written in a memory block of an odd number/the number of input signals to be written in a memory block of an even number $\leqq D$, and the number of input signals to be written in each memory block is equal to or more than $1/D(D+1)$ times and equal to or less than $D/D(D+1)$ times the total number of modulation wirings through which each modulation side drive circuit supplies a modulation signal.

Assuming that one modulation signal to be supplied to one modulation wiring is generated in response to one input signal, the number of input signals to be written in a memory block indicates the number of the input signals.

In addition, a configuration can be preferably employed in which, when numbers are allocated to memory blocks, which are provided two for each of the above-mentioned first to Dth outputs, in the order of inputting the above-mentioned input signals, if X is an odd number from 1 to $2D-3$ and $2D$, the number of input signals to be written in an Xth memory block is $D/D(D+1)$ times the total number of modulation wirings to which each modulation side drive circuit supplies a modulation signal, and if X is an even number from 2 to $2D-2$ and $2D-1$, the number of input signals to be written in an Xth memory block is $1/D(D+1)$ times the total number of modulation wirings to which each modulation side drive circuit supplies a modulation signal.

Further, in each of the above-mentioned aspects of the present invention, a configuration is preferable in which transfer speeds of the above-mentioned plurality of parallel outputs are equal.

In addition, in each of the above-mentioned aspects of the present invention, a configuration is particularly preferable in which the above-mentioned signal to be inputted in time-series has first to Dth parts (D is an integer equal to or larger than 2) in the order of input in the above-mentioned output circuit, the above-mentioned output circuit is for outputting the above-mentioned D parallel outputs based on each of the D parts, and the D parallel outputs are started to be inputted in the above-mentioned each modulation side drive circuit substantially simultaneously.

In addition, in each of the above-mentioned aspects of the present invention, a configuration can be preferably employed in which an R input signal, a G input signal and a B input signal are inputted, respectively, the above-mentioned output circuits are provided for the input signals of each color, and a composition circuit for composing outputs to be outputted to the same modulation side drive circuit among the plurality of parallel outputs of each output circuit is further provided. As the composition circuit, it is sufficient to use a color selection circuit that selects an output to a predetermined modulation side drive circuit from an output circuit corresponding to R and an output to the predetermined modulation side drive circuit from an output circuit corresponding to another color according to a color to which display elements to be connected to a modulation wiring to which the predetermined modulation side drive circuit supplies a modulation signal correspond and arranges the selected outputs in time-series. Thus, the composition circuit is favorably provided in association with each of the D modulation side drive circuit.

Further, the present invention includes the following aspect of the present invention.

An image display apparatus comprising:

a plurality of scan wirings;

a plurality of modulation wirings constituting a matrix wiring together with the scan wirings;

display elements to be driven in matrix according to a scan signal applied by the scan wirings and a modulation signal applied by the modulation wirings;

a scan circuit for selecting the plurality of scan wirings one after another and applying a scan signal to the selected scan wiring;

an output circuit including a first output circuit for storing an input signal for displaying a first color to be inputted in time-series and generating D outputs (D is an integer equal to or larger than 2) consisting of time-series signals for generating modulation signals based on the stored result to output the D outputs to D output paths as parallel outputs, a second output circuit for storing an input signal for displaying a second color to be inputted in time-series and generating D outputs consisting of time-series signals for generating modulation signals based on the stored result to output the D outputs to D output paths as parallel outputs, and D composition circuits for composing outputs that are outputted to an Xth output path ($1 \leqq X \leqq D$) among the above-mentioned D output paths to which the above-mentioned outputs from the above-mentioned first output circuit are outputted and an Xth output path ($1 \leqq X \leqq D$) among the above-mentioned D output paths to which the above-mentioned outputs from the above-mentioned second output circuit are outputted, respectively; and a modulation side drive circuit for outputting parallel modulation signals based on time-series signals for generating modulation signals to be outputted from the above-mentioned composition circuit, wherein the above-mentioned modulation side drive circuit is provided in plural forms associated with each of the above-mentioned D composition circuits and each of the plurality of modulation side drive circuits supplies the above-mentioned modulation signal to a part of and a plurality of modulation wirings among the above-mentioned plurality of modulation wirings, wherein the above-mentioned display elements are arranged such that a plurality of display elements to which the above-mentioned scan signals are given simultaneously by one scan wiring include a display element for displaying the above-mentioned first color and a display element for displaying the above-mentioned second color, and wherein the above-mentioned composition circuit is for composing outputs from the above-mentioned first output circuit and the above-mentioned second output circuit according to the arrangement of the display element for displaying the first color and the display element for displaying the second color.

Moreover, the output circuit may be an output circuit that copes with a third color or other colors. For example, the image display apparatus can employ a configuration for inputting an R input signal, a G input signal and a B input signal separately. The image display apparatus is configured as described below.

An image display apparatus comprising:

a plurality of scan wirings;

a plurality of modulation wirings constituting a matrix wiring together with the scan wirings;

display elements to be driven in matrix according to a scan signal applied by the scan wirings and a modulation signal applied by the modulation wirings;

a scan circuit for selecting the plurality of scan wirings one after another and applying a scan signal to the selected scan wiring;

an output circuit including a first output circuit for storing an input signal for displaying red to be inputted in time-series and generating D outputs (D is an integer equal to or larger than 2) consisting of time-series signals for generating modulation signals based on the stored result to output the D outputs to D output paths as parallel outputs, a second output circuit for storing an input signal for displaying green to be inputted in time-series and generating D outputs consisting of time-series signals for generating modulation signals based on the stored result to output the D outputs to D output paths as parallel outputs, a third output circuit for storing an input signal for displaying blue to be inputted in time-series and generating D outputs consisting of time-series signals for generating modulation signals based on the stored result to output the D outputs to D output paths as parallel outputs, and D composition circuits for composing outputs that are outputted to an Xth output path ($1 \leqq X \leqq D$) among the above-mentioned D output paths to which the above-mentioned outputs from the above-mentioned first output circuit are outputted, an Xth output path ($1 \leqq X \leqq D$) among the above-mentioned D output paths to which the above-mentioned outputs from the above-mentioned second output circuit are outputted, and an Xth output path ($1 \leqq X \leqq D$) among the above-mentioned D output paths to which the above-mentioned outputs from the above-mentioned third output circuit are outputted, respectively; and a modulation side drive circuit for outputting parallel modulation signals based on time-series signals for generating modulation signals to be outputted from the above-mentioned composition circuit, wherein the above-mentioned modulation side drive circuit is provided in plural forms associated with each of the above-mentioned D composition circuits and each of the plurality of modulation side drive circuits supplies the above-mentioned modulation signal to a part of and a plurality of modulation wirings among the above-mentioned plurality of modulation wirings, wherein the above-mentioned display elements are arranged such that a plurality of display elements to which the above-mentioned scan signals are given simultaneously by one scan wiring include a display element for displaying red, a display element for displaying green and a display element for displaying blue, and wherein the above-mentioned composition circuit is for composing outputs from the above-mentioned first output circuit, the above-mentioned second output circuit and the above-mentioned third output circuit according to the arrangement of the display element for displaying red, the display element for displaying green and the display element for displaying blue.

Other objects and features of the present invention will be apparent from the following descriptions taken in conjunction with the accompanying drawings, in which like reference characters designate the same or similar parts throughout the figures thereof.

DESCRIPTION OF THE PREFERRED EMBODIMENTS

Figure 1:
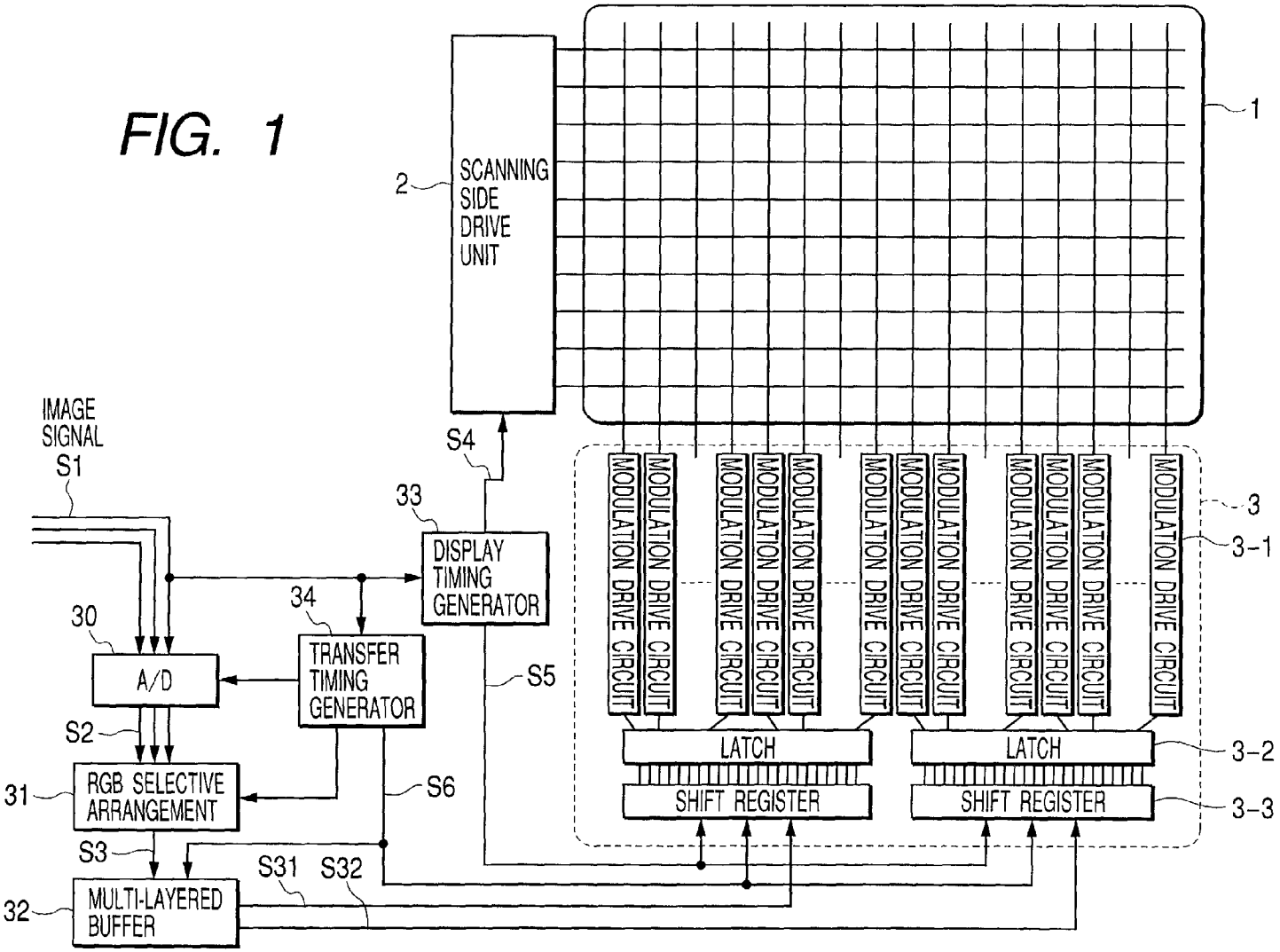
FIG. 1 is a diagram of an image display apparatus in accordance with a first embodiment of the present invention.

Preferred embodiments of the present invention will be hereinafter described illustratively with reference to the drawings. Further, dimensions, materials and shapes of components and their relative arrangements described in the embodiments are not intended to limit the scope of the present invention to them only unless specifically described otherwise.

In addition, in the drawings, the same members as those shown in the drawings used in describing the above-mentioned conventional art and those shown in the drawings already described are denoted by the same reference numerals. Further, a description of each embodiment of an image display apparatus in accordance with the present invention to be described below also serves as a description of each embodiment of an image display method and an image display program in accordance with the present invention.

(First Embodiment)

First, a first embodiment of the image display apparatus in accordance with the present invention will be described with reference to FIGS. 1 to 3.

FIG. 1 is a diagram of the first embodiment of the image display apparatus in accordance with the present invention. In the first embodiment, an example in which the number of divisions of a transfer signal is two (D=2) will be described.

In FIG. 1, reference numeral 1 denotes a display panel on which scan wirings and n modulation wirings are arranged in a matrix shape. Reference numeral 2 denotes a scan side drive unit that is a scan circuit for driving the scan wirings. Reference numeral 3 denotes a drive unit for driving the modulation wirings. The drive unit 3 includes two modulation side drive circuits corresponding to the number of divisions of a transfer signal which is two. One modulation side drive circuit includes a shift register 3-3 functioning as a circuit for outputting transfer signals, which is sent from in time-series (modulated data as signals for generating modulation signals), in parallel, a latch circuit 3-2 for receiving and holding a signal inputted from the shift register and a modulation drive circuit 3-1 for receiving input of modulated data and outputting a modulation signal according to the modulated data.

Electron emitting elements as display elements, which are components of the present invention, are provided in association with points of intersection of the above-mentioned scan wirings and modulation wirings. As such an electron emitting element, there are, for example, an surface conduction electron emitting element, an electron emitting element of the field emission type (FE type) and an electron emitting element of the metal/insulator/metal type (MIM type). In this embodiment, surface conductive electron emitting elements provided in the vicinity of the points of intersection of the scan wirings and the modulation wirings are used as the display elements. As a configuration in which other display elements are used, a configuration for carrying out light modulation using liquid crystals as elements, a configuration using electroluminescence elements, a configuration for carrying out light modulation by micro-mirrors using the micro-mirrors as the display elements, and the like, can be employed.

Reference numeral 33 denotes a display timing generator for generating timing for driving the display panel.

Reference numeral 30 denotes an A/D unit for digitizing an inputted image signal. Reference numeral 31 denotes an RGB selective arrangement unit for selectively arranging image signals of each of R, G and B in accordance with a pixel arrangement of the display panel.

Reference numeral 32 denotes an output circuit for dividing an input signal (luminance signal) to be inputted into the number of the modulation side drive circuit and outputting the divided luminance signals in parallel with each other to a plurality of (two in this context) output paths, each connected to the modulation side drive circuits, as modulated data (signals for generating modulation signals) to be transferred to each of the modulation side drive circuits. The output circuit 32 is also referred to herein as a multi-layered buffer.

The A/D unit 30 digitizes image signals S1 of each of RGB inputted in a display device to generate digital image signals S2.

The RGB selective arrangement unit 31 selectively arranges data such that the digital image signals S2 corresponds to a pixel arrangement of the display panel 1 to generate a luminance signal S3.

The multi-layered buffer 32 divides the luminance signal S3 in one scanning period into a plurality of blocks to generate transfer data S31 to S32 (modulated data) as signals for generating modulation signals (transfer signals), that are components of the present invention, to be transferred to the plurality of shift registers 3-3 in parallel with each other. The division of the luminance signal S3 into a plurality of blocks by the multi-layered buffer 32 is carried out according to a ratio of the numbers of modulation wirings to be connected to each of the modulation side drive circuits, that is, a ratio of division of blocks of the modulation wirings. For example, if a ratio of division of the modulation wirings is a:b:c, a ratio of division of a luminance signal (e.g., a ratio of amounts of information corresponding to the modulation wirings included in a luminance signal) is also a:b:c.

The shift register 3-3 is an input unit for inputting the transfer data S31 to S32 in the drive unit 3.

The latch circuit 3-2 latches data for one scanning period stored in the shift register 3-3 according to a display drive timing S5.

The modulation drive circuit 3-1 drives the display panel 1 for each scanning period based on the latched data.

In addition, the display timing generator 33 functioning as timing generating means, which is a component of the present invention, generates display drive timing S4 and S5 based on the inputted image signals S1.

The scan side drive unit 2 scans the scan wiring of the display panel 1 in order according to the display drive timing S4 and applies a scan signal to the selected scan wiring.

The above procedures are repeated one after another, whereby an image is displayed on the display panel 1.

Figure 2:
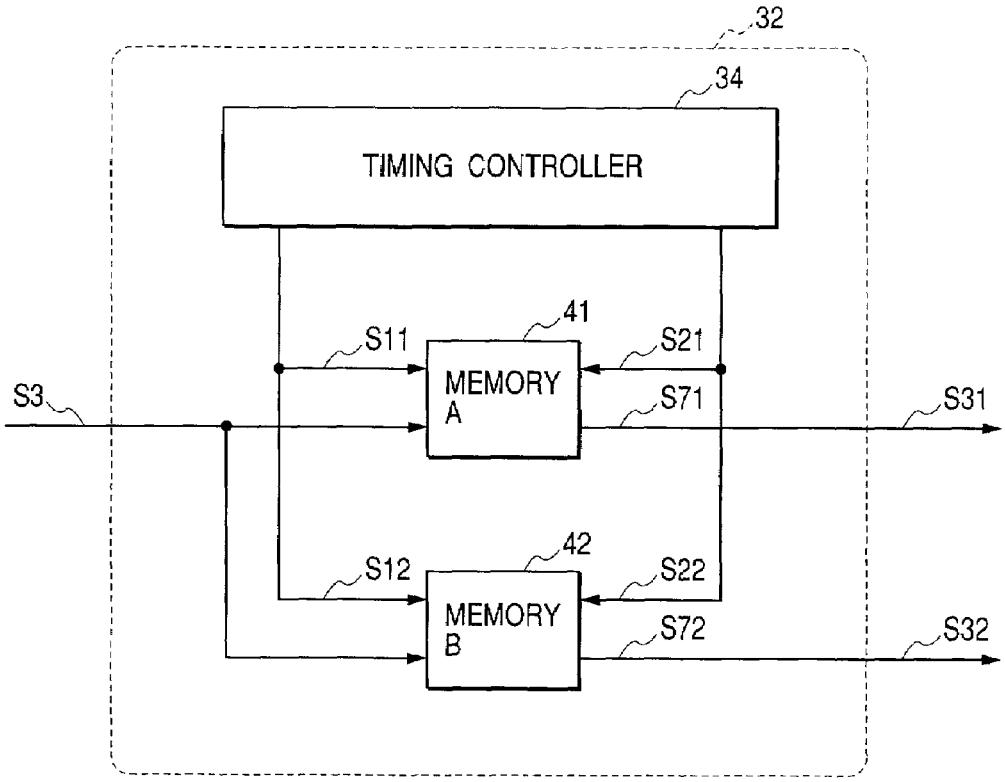
FIG. 2 is a diagram showing an internal configuration of a multi-layered buffer 32 shown in FIG. 1.
Figure 3:
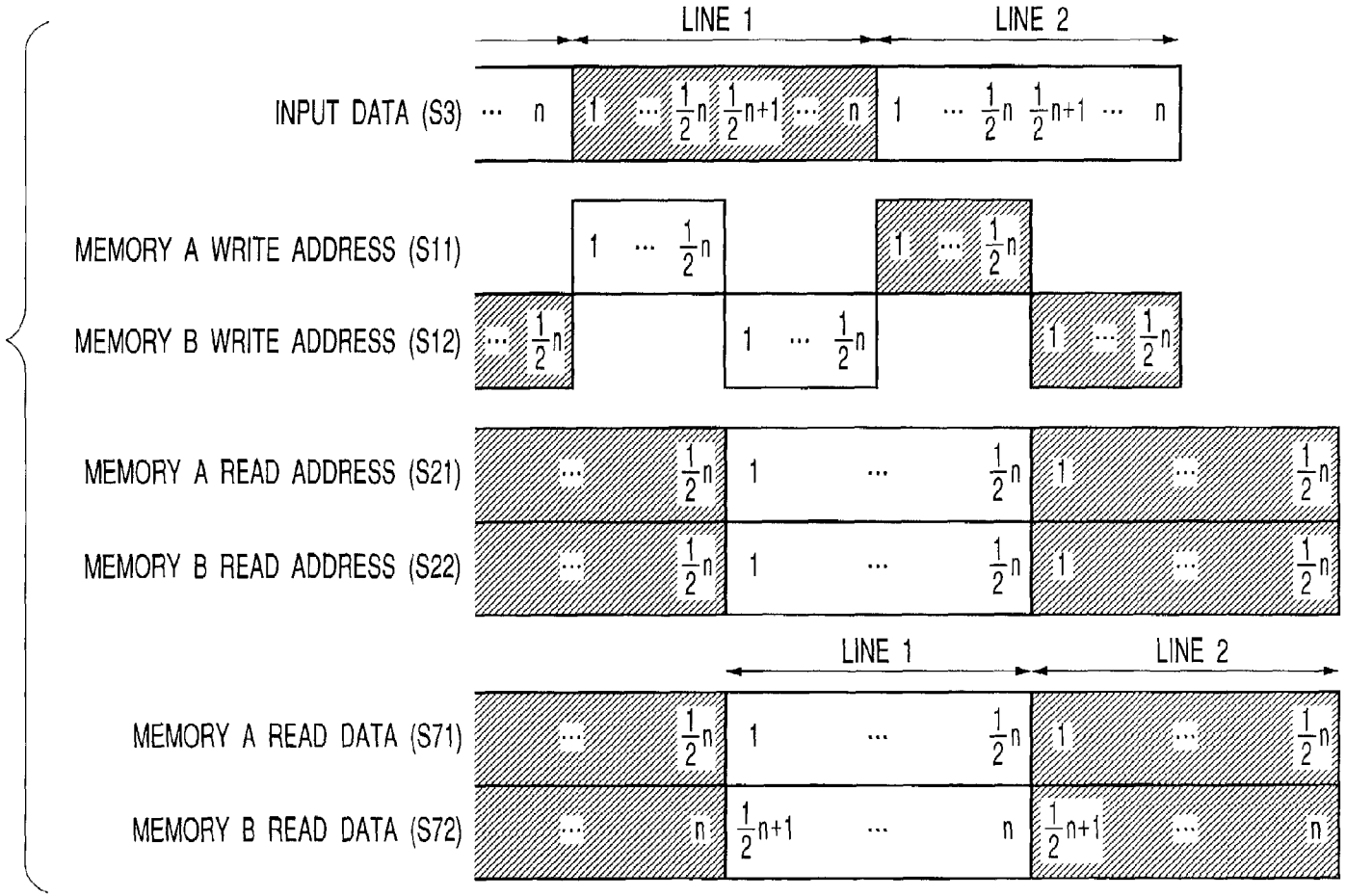
FIG. 3 is a timing chart of an operation of the image display apparatus in accordance with the first embodiment of the present invention shown in FIG. 1.

FIG. 2 is a diagram showing an internal configuration of the multi-layered buffer 32 shown in FIG. 1. In addition, FIG. 3 is a timing chart of an operation of the first embodiment of the image display apparatus in accordance with the present invention shown in FIG. 1.

In FIG. 2, reference numeral 34 denotes a timing controller for generating a timing signal in the multi-layered buffer, functioning as address generating means, which is a component of the present invention.

A main storage such as an RAM (Random Access Memory) and an ROM (Read Only Memory) is provided in the timing controller 34 as a recording medium for recording the image display program in accordance with the present invention (not shown).

In addition, the timing controller 34 can also be implemented in a logic circuit (ASIC and the like) by hardware.

In addition, the first embodiment of the image display apparatus in accordance with the present invention may use an auxiliary storage such as a floppy disk, a hard disk, a CD-ROM, a CD-R, a CD-RW or an MO by a magnetic disk device, an optical disk device, a semiconductor disk device or the like in order to supplement a storage capacity of the above-mentioned recording medium. This is true for other embodiments to be described below.

Therefore, at least one of the above-mentioned main storage and auxiliary storage corresponds to a computer readable recording medium having recorded therein the image display program in accordance with the present invention. However, a CD-ROM, an FD, a CD-R, a CD-RW or the like can also be used as the computer readable recording medium having recorded therein the image display program in accordance with the present invention.

Further, the computer readable recording medium in the descriptions of the present invention and this embodiment includes a recording medium readable by a server and a recording medium readable by a client in addition to a recording medium readable by an image display apparatus.

Reference numerals 41 and 42 denote a memory A as a first memory and a memory B as a second memory, respectively, that temporarily store an image signal.

A storage element to be used in these memories is a memory having an input port and an output port separately, which is an asynchronous dual port type memory capable of carrying out input and output asynchronously and simultaneously.

Reference numeral S3 denotes an image signal in which signals of R, G and B are selectively arranged based on an element arrangement of the display panel 1.

Reference numerals S11 and S12 denote write address signals to be applied to the memory A 41 and the memory B 42. Reference numerals S21 and S22 denote read address signals to be applied to the memory A 41 and the memory B 42.

Reference numerals S71 and S72 denote read data of each memory, which is turned into transfer signals (modulated data) S31 and S32 without change.

In addition, a write enable signal (not shown) is connected to each memory. During the period when effective write addresses S11 and S12 are not given, the memories are made write disable.

A capacity of each of the memory A 41 and the memory B 42 is a capacity capable of storing luminance signals for the number of modulation wirings handled by the modulation side drive circuit associated with each memory among luminance signals for one scan wiring. Here, since the modulation wiring is halved and each of the halved modulation wirings is handled by each modulation side drive circuit, a capacity of each memory is half of a data amount for one scan wiring. Each memory is composed of a storage element having a width equal to the image signal S3 and a depth of n/2.

The timing controller 34 generates address control signals of S11 and S12 as well as S21 and S22. Details of timing of each signal will be described below.

The memory A write address signal S11 changes, in synchronism with the luminance signal S3, in the order of 1 to n/2 during the period from the time when first data in one scanning period of a luminance signal to be inputted in the multi-layered buffer is inputted until the time when n/2th data is inputted (hereinafter referred to as "period of 1 to n/2 in one scanning period", and other periods are represented in the same manner).

The memory B write address signal S12 changes in the order of 1 to n/2 during a period of n/2+1 to n in one scanning period in synchronism with the luminance signal S3.

The memory A and B read address signals S21 and S22 change in the order of 1 to n/2 during a period of n/2+1 in one scanning period to n/2 of the next scanning period.

Modulated data is read out and outputted in accordance with these read address signals. These read address signals are not always required to be synchronous with the luminance signal S3. In addition, the read address signals may change in the order of 1 to n/2 during a shorter period as long as it changes in the above-mentioned period. However, since a data speed to be described below does not drop to one half following the change, it is preferable to use the above-mentioned period (one scanning period) as much as possible (use the entire period).

By giving the above-mentioned control signals, data of 1 to n/2 of the luminance signal S3 is outputted to the memory A read data S71 at a speed that is half of the data speed of the luminance signal S3 with a delay of ½ scanning period.

Similarly, data of n/2+1 to n of the luminance signal S3 is outputted to the memory B read data S72 at a speed that is half of the data speed of the luminance signal S3 with a delay of ½ scanning period.

In this way, the write address signals S11 and S12 as well as the read address signals S21 and S22 are inputted in the memory A 41 and the memory B 42, respectively, from the timing controller 34, whereby transfer signals S31 and S32 are outputted.

Therefore, a control program of the memory block A 41 and the memory block B 42 of the timing controller 34 can be regarded as the image display program in accordance with the present invention. This is true for each embodiment to be described below.

As described above, according to this embodiment, it can be realized with a capacity of a storage equivalent to a capacity for one scan wiring of a shift register to transfer data in parallel with the shift register divided into two blocks and reduce the transfer speed of the transfer data S31 and S32 and the operation speed of the shift register 3-3 to half.

Here, an output circuit having a plurality of output paths (each of which is connected to each modulation side drive circuit, in particular, to a shift register) as the output circuit (multi-layered buffer 32) (more specifically, a configuration having a plurality of memories including output ports connected to the above-mentioned output paths) is employed, whereby modulated data can be outputted to a plurality of modulation side drive circuits in parallel with each other. In particular, the circuit is structured such that modulated data for one scan wiring to be inputted in the output circuit (multi-layered buffer 32) in time-series is divided into each part corresponding to each modulation side drive circuit and each part is outputted to each output path. That is, modulated data (n input signals) for one scan wiring is divided into D pieces and outputted as D outputs. Here, an Xth ($1 \leqq X \leqq D$) output is constituted by signals for generating a modulation signal to be supplied to a plurality of modulation wirings to be connected to a modulation side drive circuit corresponding to the Xth output. in addition, the following conditions are employed in outputting modulated data for one scan wiring.

Condition 1: After temporarily storing a first part of partly modulated data, obtained by dividing modulated data for one scan wiring, in the output circuit, reading of the first part (output of the first part to a first output path that is a path for transferring the first part to the modulation side drive circuit) is started before input of the entire modulated data for the one scan wiring in the output circuit (multi-layered buffer 32) (storage in the output circuit) is completed.

Condition 2: Output of the modulated data stored in a predetermined address in a memory of the output circuit is carried out during the period until the predetermined address is overwritten by modulated data to be inputted next.

Condition 3: When the above-mentioned conditions 1 and 2 are satisfied, reading of the above-mentioned first part (output of the above-mentioned first part to the above-mentioned first output path) is carried out over a time that is longer than a time required for inputting the first part in the output circuit.

By satisfying these conditions, a configuration can be realized which is capable of lowering a communication rate (transfer rate) of modulated data from the output circuit to the modulation side drive circuit with less storage capacity.

Further, in this embodiment, start of output of modulated data to each output path synchronizes with a point of time when input of the last part among a plurality of parts obtained by dividing time-series modulated data for one scan wiring divided into D pieces (D=2 in this embodiment) in the output path is started. (Note that, it is assumed that when timing for outputting modulated data to each output path is referred to, it indicates timing for outputting each part into which modulated data for one scan wiring is divided to each output path, as long as there is not particularly annotated.)

Although it is not necessary to completely match start of output of modulated data to each output path with the start time of input of the above-mentioned last part in the output circuit, it is preferable to match the start of output to the start point in time or set it in the vicinity of the start point in time (it is favorable to set it from the start point in time of input of the above-mentioned last part in the output circuit until the point in time when a clock of the above-mentioned transfer rate is counted ten) in order to control the transfer rate as low as possible.

Further, in this embodiment, in particular, start of output of modulated data to each output path is set at the same time as a configuration for outputting each part of modulated data for one scan wiring in parallel to the modulation side drive circuit. However, outputting each part in parallel is not limited to matching the start of output of each part. The output of modulated data corresponding to a modulation signal to be applied to a predetermined modulation wiring stored in the output circuit can be appropriately set as long as it can be performed before the modulated data is overwritten by the next modulation data to be applied to the predetermined modulation wiring. However, overlap of a period during which each output (each partly modulated data) is outputted to each output path is an important requirement from the point of view of setting a transfer rate low. Further, in the case in which start of output of modulation data from each output port (start of each output to each output path) is not simultaneous, if it is inconvenient to input the modulated data in the modulation side drive circuit without adjustment, it is also possible to adjust timing for inputting in the modulation side drive circuit by giving a predetermined delay at any point in time before inputting the modulated data in the modulation side drive circuit as described in a second embodiment to be described below.

Note that, in this embodiment, as a configuration of an output circuit that can preferably realize the above-mentioned conditions 1, 2 and 3, the output circuit has a plurality of memories that can be independently controlled, respectively, and moreover, each memory is a dual port memory having an output port and an input port separately. Since data can be nonexclusively inputted in and outputted from a memory by employing the dual port memory, it is unnecessary to complete reading out data from the memory by the time when input of data for the next scan wiring in the memory is started. Thus, on condition that data stored in a predetermined address is read out before the predetermined address is overwritten, since an ending time of reading out modulated data for the previous scan wiring from a memory can be set after input of modulation data for the next scan wiring in the memory is started, a time required for outputting partly modulated data (each part of data for one scan wiring) from the memory can be particularly long and a communication rate to the modulation side drive circuit can be made lower.

In addition, although the case of D=2 is shown as an example in this embodiment, it is assumed here that D is 2 or more. Then, the write address given to the Xth memory ($1 \leqq X \leqq D$) writes a signal in each memory by employing a configuration for causing a write address signal to change in the order of 1 to n/D, during a period from the time when n(X−1)/D+1th input signal among the above-mentioned n input signals for one scan wiring is inputted until the time when the nX/Dth input signal is inputted, in synchronism with the input signals. The read address given to the Xth memory ($1 \leqq X \leqq D$) causes a read address signal to change in the order of 1 to n/D during a period from the time when the n(D−1)/D+1th input signal among the above-mentioned n input signals is inputted until the time when the n/Dth input signal among the next n input signals is inputted (preferably using the entire period) Consequently, the above-mentioned conditions can be satisfied with a simple configuration. However, it is preferable to make D=2 in this configuration because a period in which each output path is not used can be reduced.

(Second Embodiment)

Figure 5:
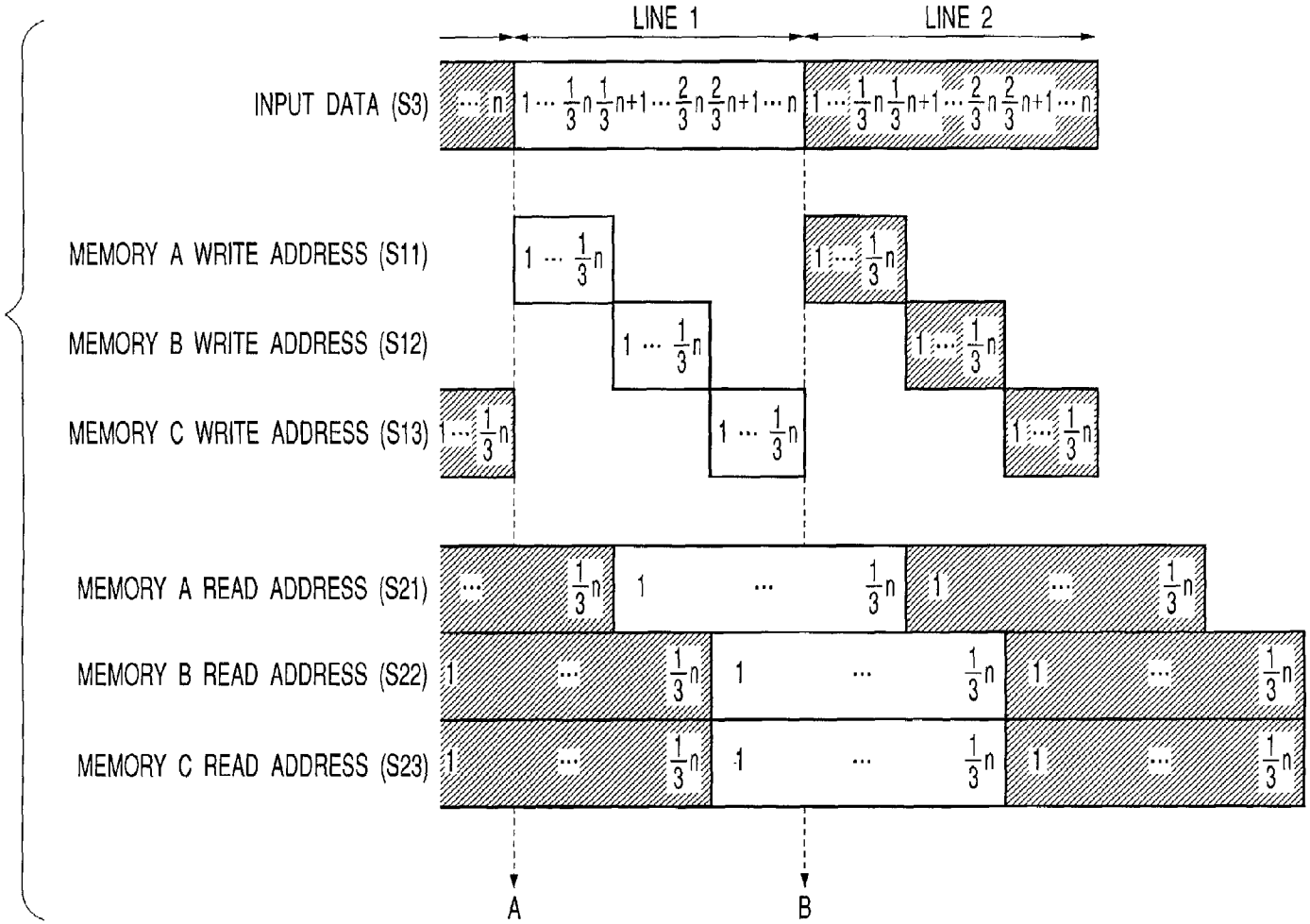
FIG. 5 is a timing chart of an operation of the image display apparatus shown in FIG. 4.
Figure 6:
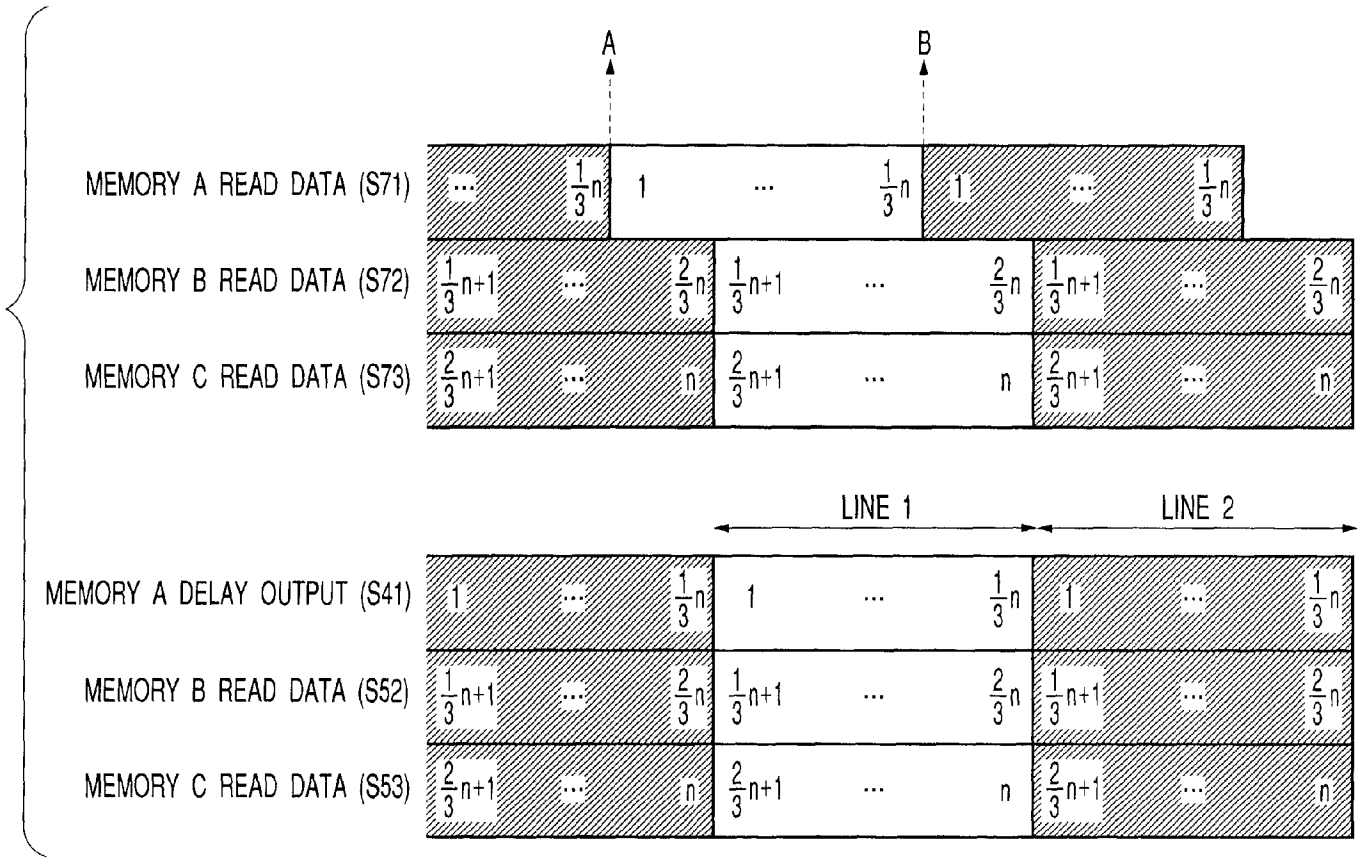
FIG. 6 is a timing chart of an operation of the image display apparatus shown in FIG. 4.

Next, a second embodiment of the image display apparatus in accordance with the present invention will be described with reference to FIGS. 4, 5 and 6. Although FIGS. 5 and 6 are divided for ease of reference, timing in these timing charts match on broken lines A and B shown in these figures.

The second embodiment will be described assuming that the number of division of a transfer signal (the number of modulation side drive circuits) and the number of memories constituting a multi-layered buffer 432 functioning as an output circuit are three, respectively. A dual port memory is also employed as a memory in this embodiment.

Figure 4:
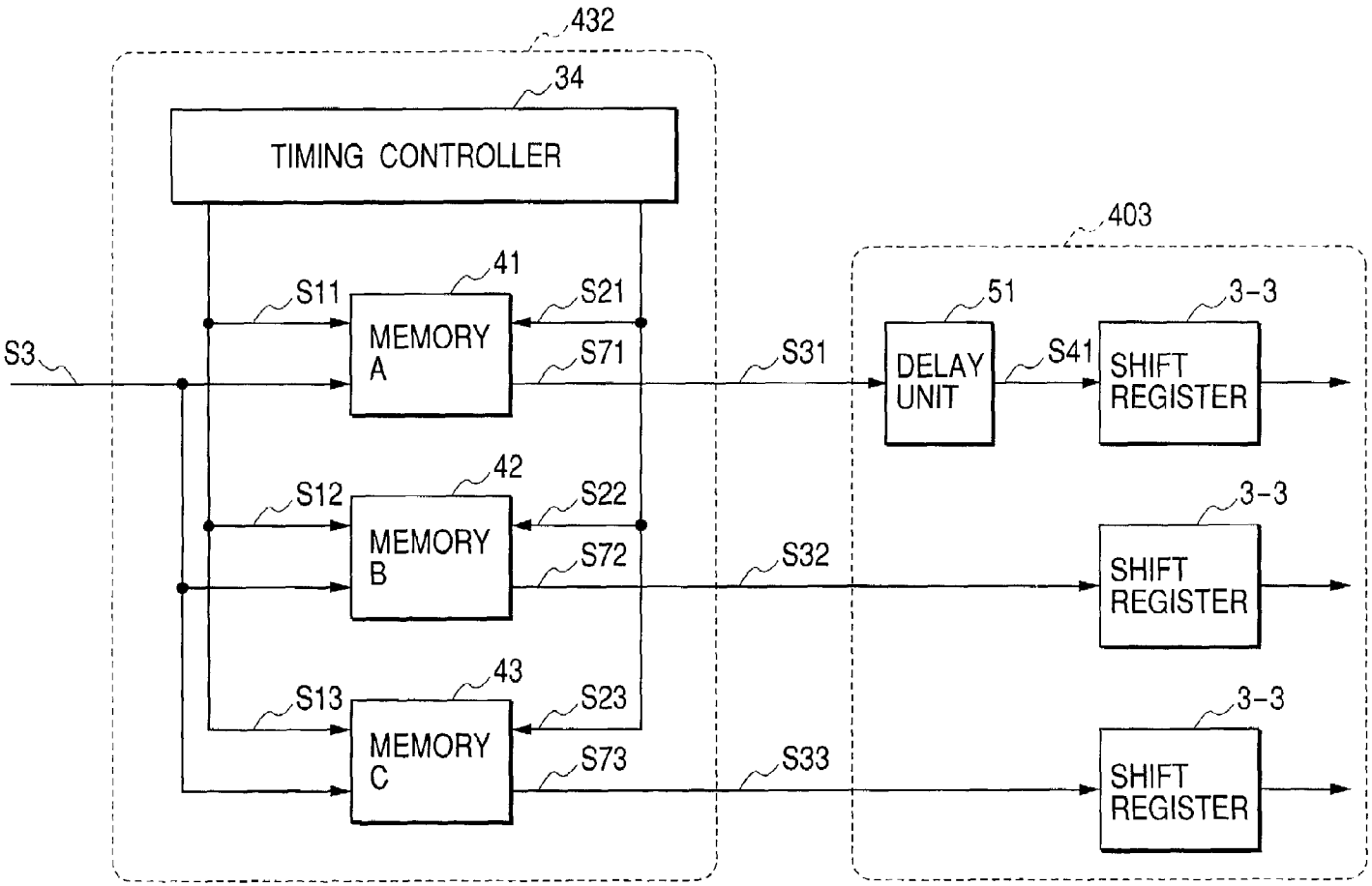
FIG. 4 is a diagram of a part of a multi-layered buffer 432 and a drive unit 403 to be used in the image display apparatus in accordance with a second embodiment of the present invention.

FIG. 4 is a diagram of a part of the multi-layered buffer 432 and a drive unit 403 used in the second embodiment of the image display apparatus in accordance with the present invention.

Here, the second embodiment of the image display apparatus in accordance with the present invention has an entire configuration and a configuration and operation of each member that are the same as those shown in FIG. 1 of the above-mentioned first embodiment except the multi-layered buffer 432 and the drive unit 403.

In addition, FIGS. 5 and 6 are timing charts of an operation of the image display apparatus shown in FIG. 4.

In FIG. 4, reference numeral 51 denotes a delay unit functioning as a delay circuit, which is a component of the present invention, for causing a divided image signal S31 to be delayed by a fixed period of time (same in the following descriptions). Reference symbol S41 denotes a signal that is delayed by the delay unit 51.

Reference numerals 41, 42 and 43 denote a memory A, a memory B and a memory C that are first, second and third memories, respectively. A capacity of each memory is one third of a capacity for one scan wiring.

Reference symbols S11 to S13 denote write address signals, S21 to S23 denote read address signals and S71 to S73 denote read data of each memory, which becomes transfer signals S71 to S73 as they are.

The memory A write address signal S11 changes in the order of 1 to n/3 in synchronism with the luminance signal S3 during the period of 1 to n/3 in one scanning period.

The memory B write address signal S12 changes in the order of 1 to n/3 in synchronism with the luminance signal S3 during the period of n/3+1 to 2n/3 in one scanning period.

The memory C write address signal S13 changes in the order of 1 to n/3 in synchronism with the luminance signal S3 during the period of 2n/3+1 to n in one scanning period.

The memory A read address signal S21 changes in the order of 1 to n/3 during the period of n/3+1 in one scanning period to n/3 in the next scanning period. This is not always required to be synchronous with the luminance signal S3.

The memory B and C read address signals S22 and S23 changes in the order of 1 to n/3 during the period of 2n/3+1 in one scanning period to 2n/3 in the next scanning period. This is not always required to be synchronous with the luminance signal S3.

By giving the above-mentioned control signals, data of 1 to n/3 of the luminance signal S3 is outputted to the memory A read data S71 at a speed that is one third of the data speed of the luminance signal S3, with the delay of ⅓ scanning period.

Similarly, data of n/3+1 to 2n/3 of the luminance signal S3 is outputted to the memory B read data S72 at a speed that is one third of the data speed of the luminance signal S3, with the delay of ⅔ scanning period.

Similarly, data of 2n/3+1 to n of the luminance signal S3 is outputted to the memory C read data S73 at a speed that is one third of the data speed of the luminance signal S3, with the delay of ⅔ scanning period.

The delay unit 51 inputs the transfer signal S31 from the memory A and outputs the signal S41 with delay of ⅓ scanning period. A storage capacity required for this unit is one ninth of the capacity for one scan wiring.

Consequently, it can be realized to input data for one scan wiring in parallel with each other to the shift register divided into three blocks in the state in which a top of divided each partially modulated data is matched and to reduce the transfer speed of the transfer data S31 to S33 and the operation speed of the shift register 3-3 to one third, using three dual port memories having a combined memory capacity equal to the capacity for one scan wiring and a delay unit having a memory capacity equal to one ninth of the capacity for one scan wiring.

In particular, in this embodiment, the delay unit 51 functioning as the delay circuit is used, whereby starting points of input of modulated data in (the shift registers of) each of the modulation side drive circuits can be closer (or matched) to each other. Thus, it becomes possible to preferably reduce a transfer speed.

That is, in this embodiment, a configuration is employed, in which output of modulated data from the first output port (to the first output path) is started before output of modulated data to the last (Dth) output path becomes possible (i.e., before modulated data that should be outputted to the Dth output path among the modulated data for one scan wiring is inputted in the output circuit). Timing for a top of each partially modulated data to be inputted in each modulation side drive circuit deviates if this configuration is left as it is. However, the deviation of timing can be alleviated using a delay unit that is a memory for delay. Further, the delay unit functioning as the delay circuit is shown as being disposed in the vicinity of the shift register of the modulation side drive circuit in the configuration of FIG. 4. However, the position of the delay circuit is not limited to this position, and the delay circuit may be provided in a desired position on condition that deviation of timing for starting input of each output in the modulation side drive circuit can be alleviated.

In addition, the application of the configuration for alleviating deviation of starting input in each modulation side drive circuit by the delay circuit is not limited to the configuration shown in this embodiment. A configuration in which starting of parallel outputs from an output circuit is deviated is applicable.

Here, although the storage capacity of the output circuit is realizable by using a capacity equal to the capacity for one scan wiring of the shift register in the above-mentioned second embodiment, an output circuit having a storage capacity larger than the capacity of the shift register may be used. According to the present invention, the storage capacity can be controlled to less than twice the capacity of the shift register even if the storage capacity required for the delay circuit is included.

(Third Embodiment)

The number of division of a transfer signal is three (the number of modulation side drive circuit is three, that is, D=3) in the above-mentioned second embodiment. However, the image display apparatus can be realized with substantially the same configuration even if the number of divisions is four or more. In this third embodiment, in particular, an example in which the number of divisions D is generalized and optimized will be described.

Here, the third embodiment of the image display apparatus in accordance with the present invention has an entire configuration and a configuration and operation of each member that are the same as those shown in FIG. 1 of the above-mentioned first embodiment except a multi-layered buffer and a drive unit.

For example, with reference to FIG. 4, assuming that the number of divisions is D (D≧4), an Xth (X=1 to D) write address signal changes in the order of 1 to n/D in synchronism with the luminance signal S3 during the period of n(X−1)/D+1 to nX/D in one scanning period.

An Xth (X=1 to D−1) read address signal changes in the order of 1 to n/D during the period of nX/D+1 in one scanning period to nX/D in the next scanning period.

A Dth read address signal is the same as a D−1th read address signal.

By giving the above-mentioned control signals, data of n(X−1)/D+1 to nX/D of the luminance signal S3 is outputted to the Xth (X=1 to D−1) read data at a speed that is 1/D of the data speed of the luminance signal S3, with the delay of X/D scanning period.

Data of n(D−1)/D+1 to n is outputted to the Dth read data at a speed that is 1/D of the data speed of the luminance signal S3, with the delay of (D−1)/D scanning period.

An Xth (X=1 to D−2) delay unit inputs each transfer data and outputs a signal delayed by (D−X−1)/D scanning period.

A storage capacity required for this delay unit

Consequently, it can be realized to transfer data in parallel with each other to the shift register divided into D blocks and to reduce the transfer speed of the transfer data and the operation speed of the shift register to 1/D, using a plurality of dual port memories having a combined memory capacity equal to the capacity for one scan wiring and a delay unit having a capacity equal to the following expression (9) times the capacity for one scan wiring.

$$\sum_{X=1}^{D-2}\left(\frac{D-X-1}{D^2}\right) \tag{9}$$

(Fourth Embodiment)

In the image display apparatuses of the above-mentioned first to third embodiments, an example in which the number of modulation wirings connected to each modulation side drive circuit of the drive unit (e.g., the drive unit 3 shown in FIG. 1) is the same (the modulation wirings are equally divided). However, the present invention is not limited to this, and the modulation wirings may be unequally divided to make the number of modulation wirings connected to each modulation side drive circuit different from each other. This configuration can be coped with by providing time in which a part of output paths is not used, which is an effective configuration as long as it satisfies conditions for allowing an output speed of a signal after divided by an output circuit to be lower than a communication rate of a signal before divided by the output circuit.

On the other hand, in this embodiment, a configuration is shown which realizes a preferable transfer rate by positively varying the number of modulation wirings connected to each modulation side drive circuit.

In this embodiment, a point of time when output of modulation data to a Dth output path (here, in particular, including output paths other than a first output path) ends is set after input of modulated data in an output circuit, which should be outputted to the first output path, among modulated data for the next one scan wiring is completed, whereby a transfer rate from the output circuit to the modulation side drive circuit is preferably reduced. In addition, a transfer rate to the modulation side drive circuit in the first output path is the same as transfer rates in other output paths. Further, the number of modulation wirings connected to the modulation side drive circuit in which modulated data is inputted via the first output path is made fewer than the number of modulation wirings connected to the modulation side drive circuit in which modulated data is inputted via the Dth output path (here, in particular, output paths other than the first output path) such that a situation can be avoided in which a point of time when output of modulation data to the first output path ends is after a point of time when input of modulated data, which should be outputted to the first output path, among modulated data for the next one scan wiring, to the output circuit is completed.

Figure 7:
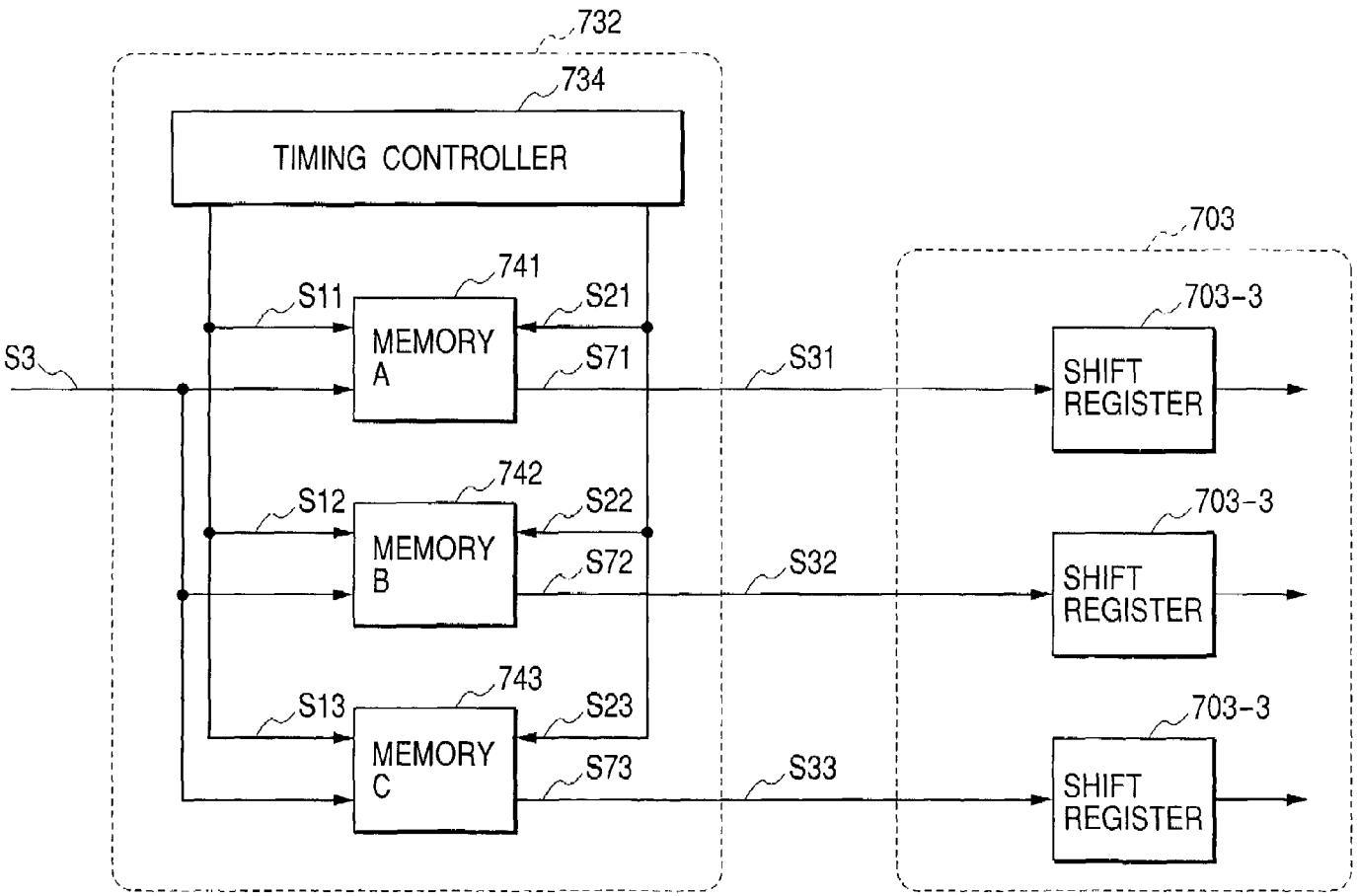
FIG. 7 is a diagram of a multi-layered buffer 732 and a drive unit 703 in the image display apparatus in accordance with a fourth embodiment of the present invention.
Figure 8:
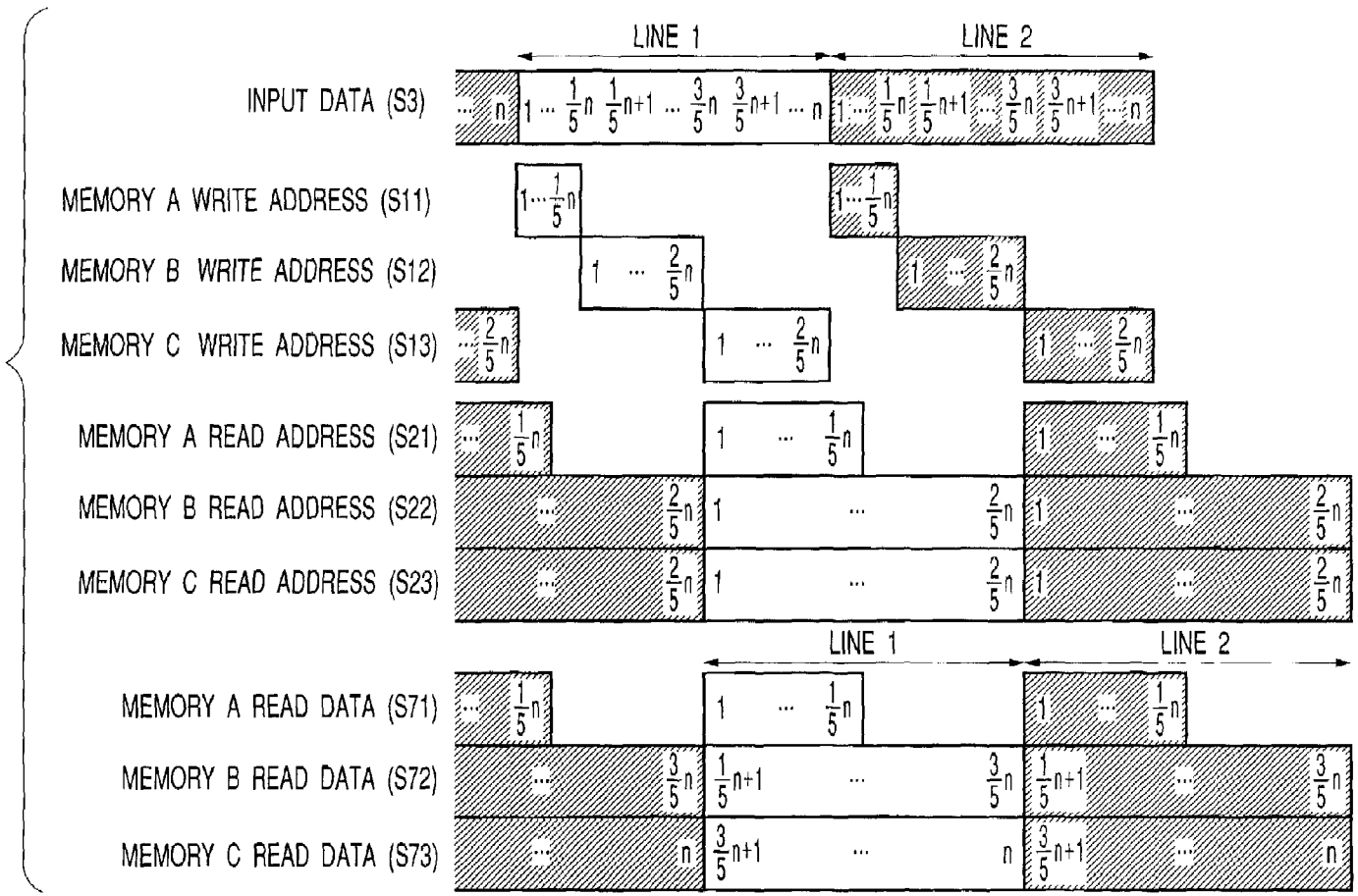
FIG. 8 is a timing chart of the image display apparatus shown in FIG. 7.

FIG. 7 shows a diagram of a multi-layered buffer 732 and a drive unit 703 in the fourth embodiment of the image display apparatus in accordance with the present invention. FIG. 8 shows a timing chart of the image display apparatus shown in FIG. 7.

Further, the fourth embodiment of the image display apparatus in accordance with the present invention has an entire configuration and a configuration and operation of each member that are the same as those shown in FIG. 1 of the above-mentioned first embodiment except the multi-layered buffer 732 and the drive unit 703.

In this embodiment, the drive unit 703 is unequally separated into blocks. That is, the number of modulation wirings connected to each modulation side drive circuit is varied and the ratio of the numbers is 1:2:2.

For example, if the number n of modulation wirings of the display panel 1 is 1000, the modulation wirings are divided into blocks at the ratio of 200:400:400.

Reference numerals 741, 742 and 743 denote a first memory, a second memory and a third memory, respectively. The memory A 741 has a capacity that is one fifth of the capacity for one scan wiring, and the memory B 742 and the memory C 743 have capacities that are two-fifths of the capacity for one scan wiring, respectively.

Reference numerals S11 to S13 denote write address signals and S21 to S23 denote read address signals. Reference numerals S71 to S73 denote read data of each memory, which become transfer signals S31 to S33 as they are.

As shown in FIG. 8, the memory A write address signal S11 changes in the order of 1 to n/5 in synchronism with the luminance signal S3 during the period of 1 to n/5 in one scanning period.

The memory B write address signal S12 changes in the order of 1 to 2n/5 in synchronism with the luminance signal S3 during the period of n/5+1 to 3n/5 in one scanning period.

The memory C write address signal S13 changes in the order of 1 to 2n/5 in synchronism with the luminance signal S3 during the period of 3n/5+1 to n in one scanning period.

The memory A read address signal S21 changes in the order of 1 to n/5 during the period of 3n/5+1 in one scanning period to 0.5n/5 of the next scanning period. This is not always required to be synchronous with the luminance signal S3.

The memory B and C read address signals S22 to S23 change in the order of 1 to 2n/5 during the period of 3n/5+1 in one scanning period to 3n/5 in the next scanning period. This is not always required to be in synchronism with the luminance signal S3.

By giving the above-mentioned control signals, data of 1 to n/5 of the luminance signal S3 is outputted to the memory A read data S71 at a speed that is two-fifths of the data speed of the luminance signal S3, with the delay of 3/5 scanning period.

Similarly, data of n/5+1 to 3n/5 of the luminance signal S3 is outputted to the memory B read data S72 at a speed that is two-fifths of the data speed of the luminance signal S3, with the delay of ⅗ scanning period.

Similarly, data of n/5+1 to n of the luminance signal S3 is outputted to the memory C read data S73 at a speed that is two-fifths of the data speed of the luminance signal S3, with the delay of ⅗ scanning period.

Consequently, it can be realized to transfer data in parallel with each other to the shift register divided into three blocks and to reduce the transfer speed of the transfer data S31 to S33 and the operation speed of the shift register to two-fifths, using a memory capacity equal to the capacity for one scanning wiring.

(Fifth Embodiment)

In addition, other configurations for setting the ratio of division in different values can be realized in the same manner as in the above-mentioned fourth embodiment. An embodiment in the case in which the ratio of division is generalized and optimized will be described as a fifth embodiment of the image display apparatus in accordance with the present invention.

In this fifth embodiment, an entire configuration and a configuration and operation of each member are the same as those shown in FIG. 1 of the above-mentioned first embodiment except the multi-layered buffer and the drive unit.

In this embodiment, it is assumed that the number of division of the shift register of the drive unit is three (D=3) and the ratio of division of each shift register is a:b:c.

Moreover, when it is assumed that a transfer speed of transfer data after division is M times as high as the transfer speed of the luminance signal S3 (M: real number), if the condition of the following expression (10) is satisfied, the present invention can be preferably applied with a storage capacity equal to the capacity for one scan wiring.

$$a \leqq M(a+c)\ b \leqq M(a+b+c)\ c \leqq M(a+b+c) \tag{10}$$

Moreover, the transfer speed becomes the lowest in case of three divisions when the following expression (11) is satisfied, and a best result is obtained.

$$a = M(a+c)\ b = M(a+b+c)\ c = M(a+b+c) \tag{11}$$

In addition, when it is assumed in the same manner that the number of divisions by dividing means is D, even if it is four or more, the ratio of division is d[1]:d[2]: . . . d[D−1]: d[D] and the transfer speed of the transfer signal outputted from the dividing means is M times as high as that of the above-mentioned luminance signal, if the condition (condition 1a) of the following expression (12) is satisfied, the present invention can be preferably applied with a storage capacity equal to the capacity for one scan wiring.

$$d[X] \leqq M\left(d[D] + \sum_{x=1}^{X} d[x]\right) \quad [X = 1 \sim D-1] \tag{12}$$

$$d[D] \leqq M\left(\sum_{x=1}^{D} d[x]\right)$$

Moreover, if the condition of the following expression (13) (condition 1b) is satisfied, the transfer speed of the transfer signal becomes a lowest transfer speed and a best result is obtained. Further, the operation speed of the shift register and the transfer speed after division can be reduced with a storage capacity equal to the capacity for one scan wiring.

$$d[X] = M\left(d[D] + \sum_{x=1}^{X} d[x]\right) \quad [X = 1 \sim D-1] \tag{13}$$

$$d[D] = M\left(\sum_{x=1}^{D} d[x]\right)$$

(1) The reason why the present invention can be implemented with the storage capacity equal to the capacity for one scan wiring if the condition la is satisfied and (2) the reason why if the condition 1b is satisfied, the transfer speed becomes the lowest speed and the best result is obtained and it is possible to preferably reduce the operation speed of the shift register 3-3 and the transfer speed after division with the storage capacity equal to the capacity for one scan wiring, as described above will be hereinafter described.

First, based on the following conditions as preconditions, the reasons will be described with reference to the following expression (14) (a) and (b) as well as FIG. 13.

(Condition 1) Start of a read address cannot be earlier than start of a write address (data cannot be read before it is written).

(Condition 2) End of a read address cannot be behind an end of a write address of the next line (data cannot be overtaken).

(Condition 3) All read data cannot transfer data of a different line simultaneously (a panel is displayed (driven) for the same line simultaneously).

$$d[X] < M\left(d[D] + \sum_{x=1}^{X} d[x]\right) \quad [X = 1 \sim D-1] \qquad (a) \tag{14}$$

↑ (1) ↑ (2)

$$d[D] \leqq M\left(\sum_{x=1}^{D} d[x]\right) \qquad (b)$$

Here, a term (1) of the expression (a) is a ratio of division in case of x=D and a term (2) of the expression (a) is a sum of ratios of division in case of x=1 to X (X=1 to D−1).

A period in which a final memory d[D] can output a signal according to a read address to be inputted is from the time when a write address starts to enter into its own memory until the time when the write address starts to enter into its own memory for writing a signal of the next line. That is, the period is the entire period (one line period) (expression b).

Then, in case of a second memory from the last d[D−1], it starts to read out a signal according to a read address simultaneously with the final memory d[D] (condition 3) and can read out a signal according to a read address until input of a write address into its own memory for writing a signal in the next line ends (condition 2). Eventually, the second block from the last can also use the entire period of one line.

Similarly, a third memory from the last can start to read out a signal according to a read address simultaneously with the last memory d[D] (condition 3) and read out a signal according to a read address until the time when input of a write address in its own memory for writing a signal in the next line ends (condition 2). However, it cannot consume the entire one line period.

When the above descriptions are collectively generalized, a condition as shown in the above expression (12) is obtained.

In addition, if the condition of the above expression (13) is satisfied, M becomes the lowest because no useless time is eliminated. The useless time is, for example, the period of 0.5n/5 to n/5 in S21 of the fourth embodiment.

In addition, the output timing of the last memory can be delayed more. Then, the time efficiency falls because the output period of the second block from the last is reduced due to (condition 1).

(Sixth Embodiment)

In the above-mentioned embodiments, a plurality of memories, each of which has an output port, are used as a configuration for outputting outputs to a plurality of output paths in parallel with each other in an output circuit (multi-layered buffer) and a memory (dual port type memory) capable of writing and reading out data simultaneously is used as each memory. However, the present invention can be applied even in the case in which a single port type memory incapable of writing and reading out data simultaneously (memory for exclusively writing and reading out data) is used.

Thus, a preferred image display apparatus in case of using the single port type memory will be hereinafter described as a sixth embodiment of the image display apparatus in accordance with the present invention.

Further, even if the single port type memory is used, reduction of a memory capacity can be realized by configuring the memory, after writing a signal to be outputted to a first output path in the memory, such that writing of signals to be outputted to the subsequent output paths in other memories and output to the first output path are made to at least partially overlap each other. It is sufficient to adjust timing of an input of an output from each memory in a modulation side drive circuit using a delay circuit. Although the present invention does not exclude this configuration, a reduction effect of a transfer speed cannot be expected in the case in which the number of output paths is two and, if the number of output paths is three or more, a degree of reducing a memory capacity decreases when even a storage capacity required for the delay circuit is included. In this embodiment, each memory corresponding to each output path is constituted by at least two memories (although two memories corresponding to one output path are referred to as a memory block, respectively, in the following description, this is an expression for facilitating understanding of the configuration and a memory of a general configuration can be used as a memory block), whereby reduction of a memory capacity and reduction of a transfer speed to a modulation side drive circuit are realized.

Figure 9:
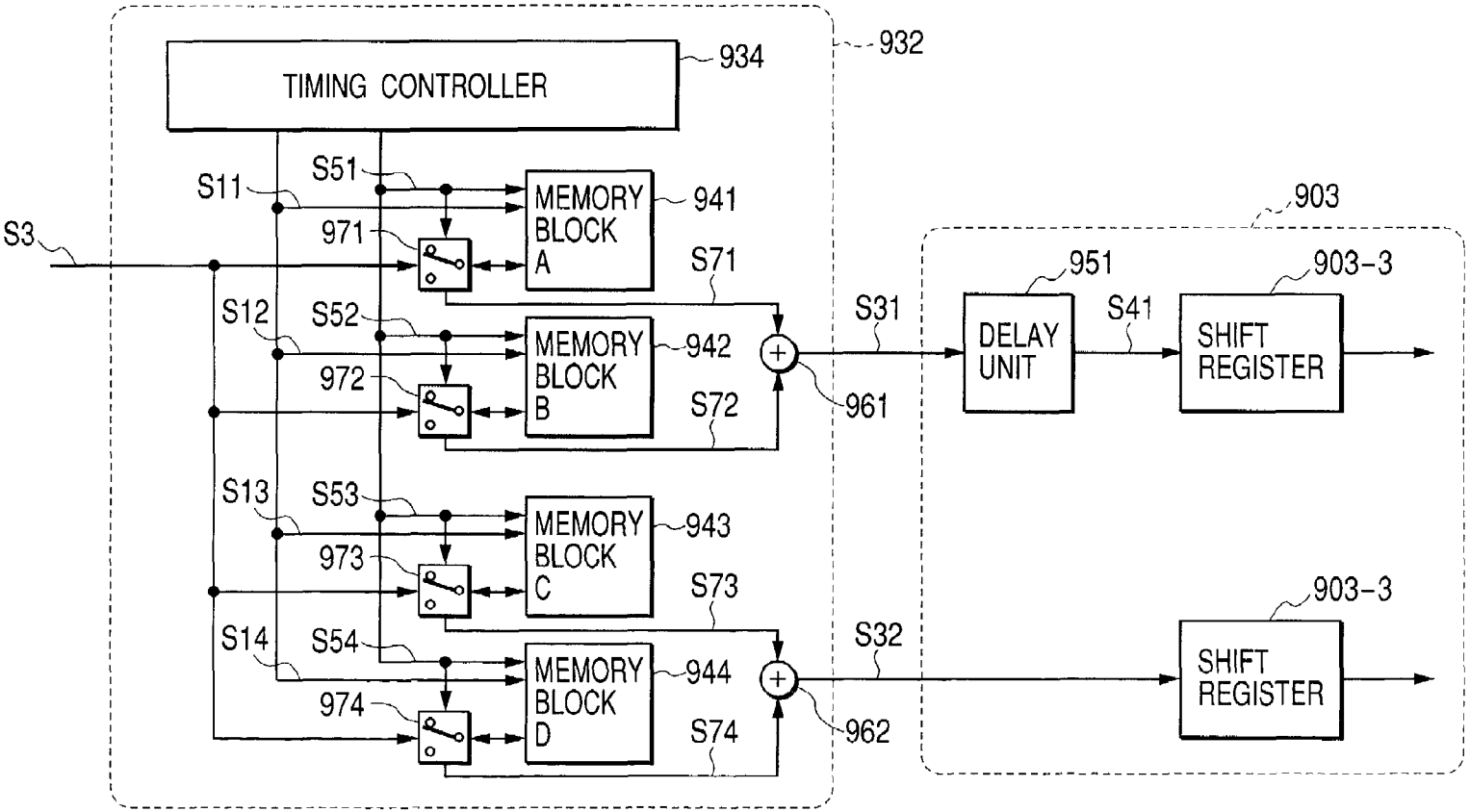
FIG. 9 is a diagram of a multi-layered buffer 932 and a drive unit 903 in the image display apparatus in accordance with a sixth embodiment of the present invention.
Figure 10:
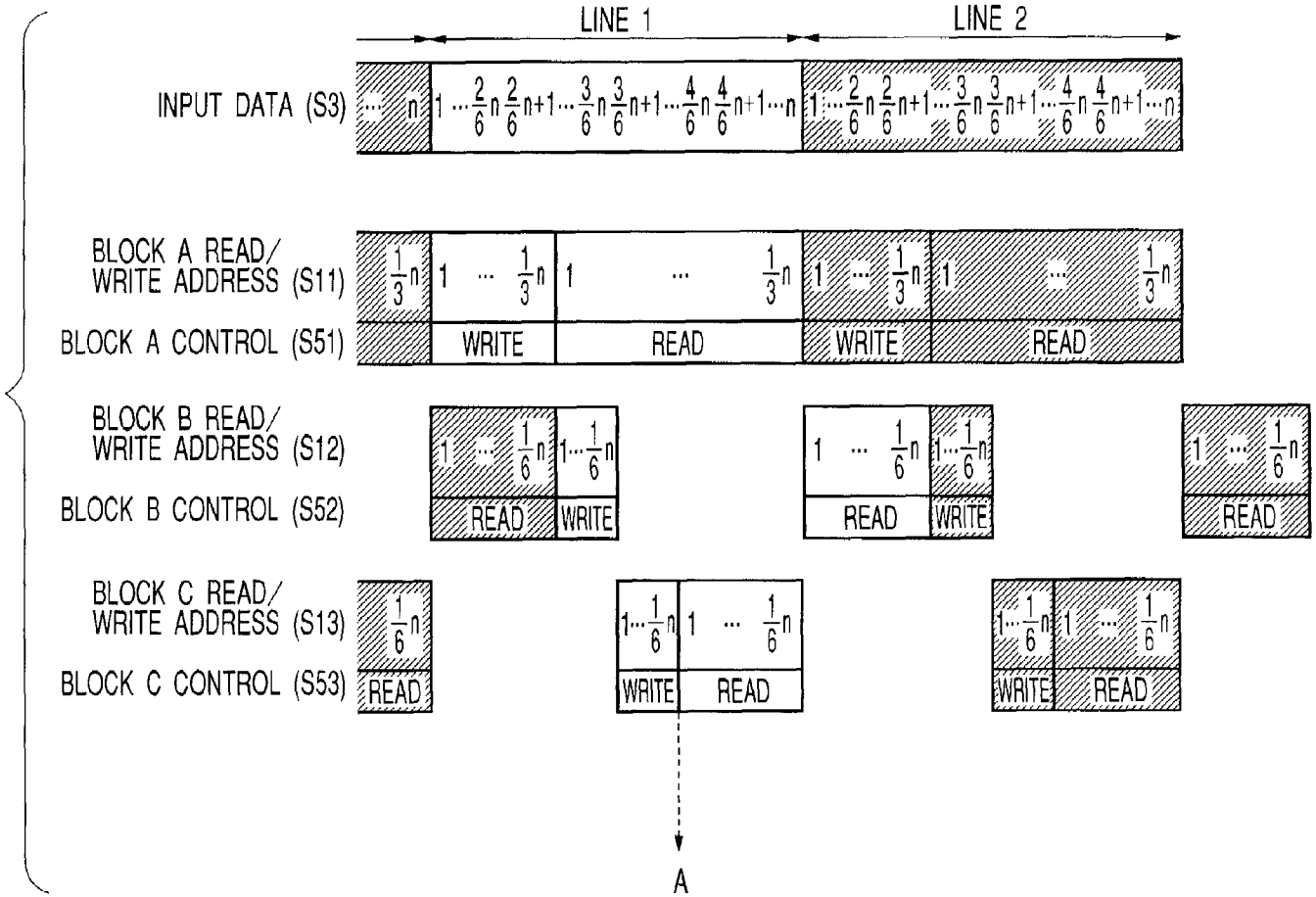
FIG. 10 is a timing chart of an operation of the image display apparatus shown in FIG. 9.
Figure 11:
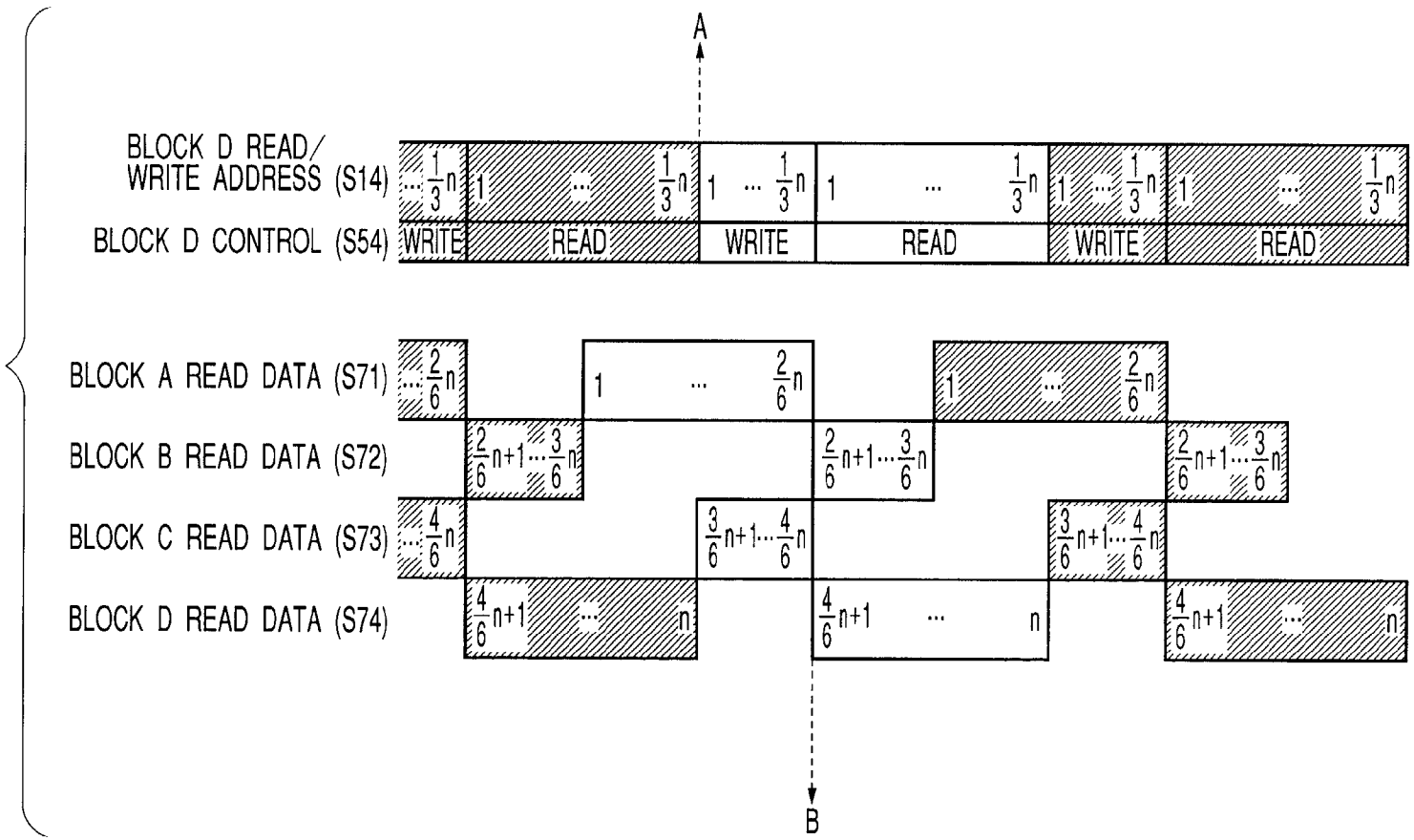
FIG. 11 is a timing chart of an operation of the image display apparatus shown in FIG. 9.
Figure 12:
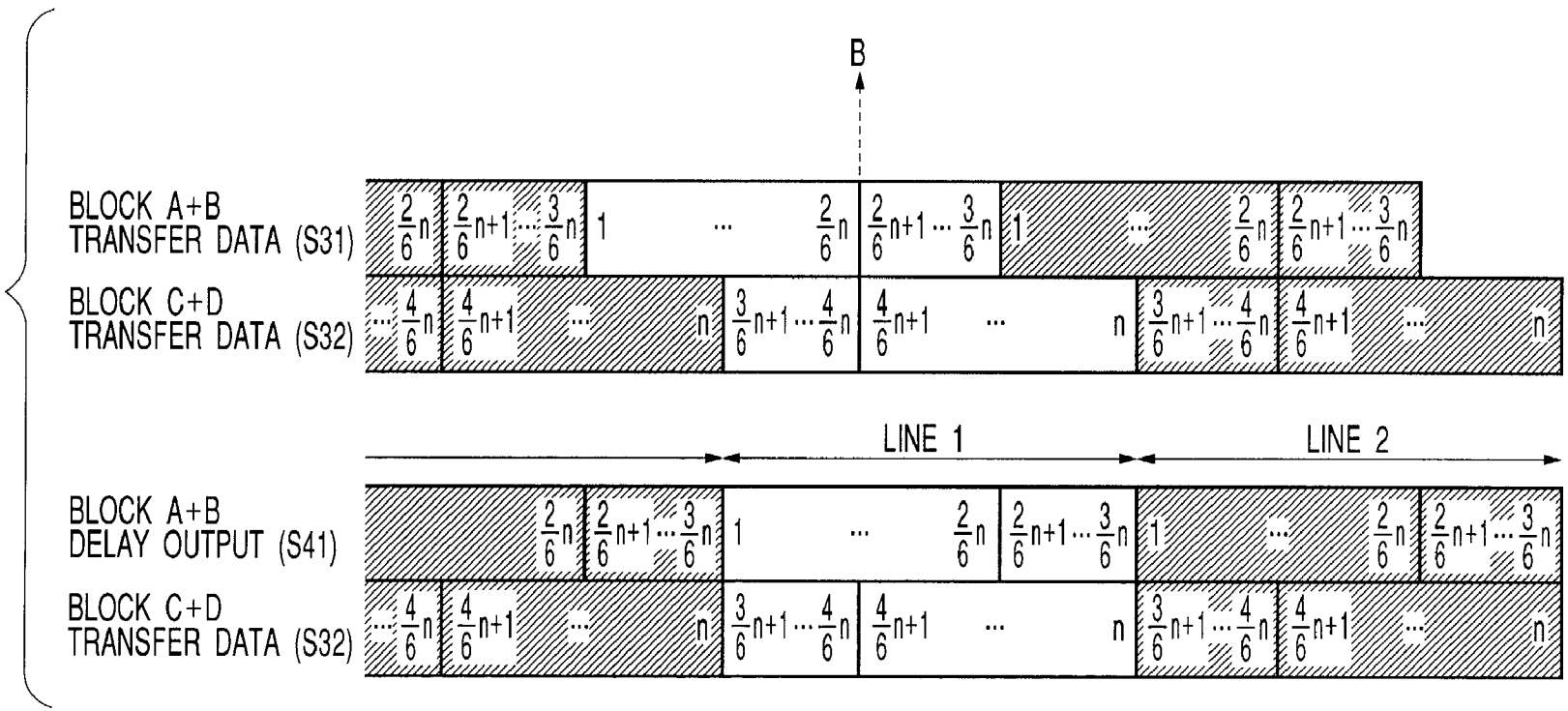
FIG. 12 is a timing chart of an operation of the image display apparatus shown in FIG. 9.

In this sixth embodiment, descriptions are made assuming that the number of division of a transfer signal is two (the number of modulation side drive circuit is two, i.e., D=2). FIG. 9 is a diagram of a multi-layered buffer 932 and a drive unit 903 that form an output circuit in the sixth embodiment of the image display apparatus in accordance with the present invention. FIGS. 10, 11 and 12 are timing charts of operations of the image display apparatus shown in FIG. 9. Although FIGS. 10 to 12 are separated, timing A and timing B shown in these figures are actually common in each figure.

Here, the sixth embodiment of the image display apparatus in accordance with the present invention has an entire configuration and a configuration and operation of each member that are the same as those shown in FIG. 1 of the above-mentioned first embodiment except the multi-layered buffer 932 and the drive unit 903.

In FIG. 9, reference numeral 961 denotes a selector as selecting means that is a component of the present invention. This selector 961 selects effective data in read signals S31 and S32 of a memory block and outputs a signal S312. A selector 962 functions in the same manner.

In this configuration, a first memory is provided in association with a first output path that is an output path for transferring the transfer signal S31. The first memory is constituted by a memory block A 941 and a memory block B 942. It may be said that the first memory is divided into the memory block A 941 and the memory block B 942. In addition, a second memory is provided in association with a second output path that is an output path for transferring the transfer signal S32. The second memory is constituted by a memory block C 943 and a memory block D 944. It may be said that the second memory is divided into the memory block C 943 and the memory block D 944. Memory blocks A, B, C and D are all single port memories and exclusively write and read out data.

Reference symbols S11 to S14 denote address signals, which select read/write addresses of a memory block. Reference symbols S51 to S54 denote memory control signals, which switch read/write operations of a memory block.

Reference numeral 971 denotes an input/output switcher as switching means that is a component of the present invention, which switches a direction of input/output of data in accordance with the memory control signal S51. Reference numerals 972, 973 and 974 also denote input/output switchers.

As shown in FIGS. 10, 11 and 12, an address of the block A address signal S11 changes in the order of 1 to 2n/6 in synchronism with the luminance signal S3 during the period of 1 to 2n/6 in one scanning period. The control signal S51 in this period is "WRITE".

In addition, an address of the block A address signal S11 changes in the order of 1 to 2n/6 during the period of 2n/6+1 to n in one scanning period. This is not always required to be synchronous with the luminance signal S3. The control signal S51 in this period is "READ".

An address of the block B address signal S12 changes in the order of 1 to n/6 in synchronism with the luminance signal S3 during the period of 2n/6+1 to 3n/6 in one scanning period. The control signal S52 in this period is "WRITE".

In addition, an address of the block B address signal S12 changes in the order of 1 to n/6 during the period of 1 to 2n/6 in one scanning period. This is not always required to be synchronous with the luminance signal S3. The control signal S52 in this period is "READ".

The selector 961 selects the block B read data S72 during the period of 1 to 2n/6 and the block A read data S71 during the period of 2n/6+1 to n in one scanning period to output the transfer signal S31.

An address of the block C address signal S13 changes in the order of 1 to n/6 in synchronism with the luminance signal S3 during the period of 3n/6+1 to 4n/6 in one scanning period. The control signal S53 in this period is "WRITE".

In addition, an address of the block C address signal S13 changes in the order of 1 to n/6 during the period of 4n/6+1 to n in one scanning period. This is not always required to be synchronous with the luminance signal S3. The control signal S53 in this period is "READ".

An address of the block D address signal S14 changes in the order of 1 to 2n/6 in synchronism with the luminance signal S3 during the period of 4n/6+1 to n in one scanning period. The control signal S54 in this period is "WRITE".

In addition, an address of the block D address signal S14 changes in the order of 1 to 2n/6 during the period of 1 to 4n/6 in one scanning period. This is not always required to be in synchronism with the luminance signal S3. The control signal S54 in this period is "READ".

The selector 962 selects the block D read data S74 during the period of 1 to 4n/6 and the block C read data S73 during the period of 4n/6+1 to n in one scanning period to output the transfer signal S32.

By giving the above-mentioned control signals, data of 1 to 3n/6 of the luminance signal S3 is outputted to the output S312 of the selector 961 at a speed that is half of the data speed of the luminance signal S3 with the delay of ⅔ scanning period.

Similarly, data of 4n/6+1 to n of the luminance signal S3 is outputted to the output S334 of the selector 962 at a speed that is half of the data speed of the luminance signal S3 with the delay of ⅔ scanning period.

A delay unit 951 as a delay circuit that is a component of the present invention inputs the output S312 of the selector 961 and outputs the signal S41 with the delay of ⅔ scanning period. A storage capacity required for this delay unit 951 is one ninth of the capacity for one scan wiring.

Consequently, it can be realized to transfer data in parallel with each other to the shift register divided into two blocks and to reduce the transfer speed of the transfer data S31 and S32 and the operation speed of the shift register 903-3 to half, using a single port memory having a memory capacity equal to the capacity for one scan wiring and a delay unit having a memory capacity equal to one ninth of the capacity for one scan wiring.

That is, in the configuration of this embodiment, two output paths for sending modulated data to two modulation side drive circuits are provided to carry out parallel transfer. Moreover, a memory corresponding to one output path is constituted by two memories for exclusively writing and reading out data (two memory blocks). In this configuration, start of reading out modulated data from a single port memory, in which modulated data is inputted earlier, among two single port memories corresponding to one output path is set before start of input of modulated data in a memory (which is also constituted by two single port memories) corresponding to the next output path (start of input of modulated data, which should be outputted to the next output path, in an output circuit). With this configuration, although a memory for exclusively writing and reading out data is used, reduction of a storage capacity of a storage and reduction of a transfer rate from an output port to a modulation side drive circuit can be realized. This configuration can be employed even if the number of output ports is three or more.

(Seventh Embodiment)

Next, an optimal embodiment in case of using a single port type memory (memory block) and dividing a transfer signal and a drive unit into three or more will be described as a seventh embodiment of the image display apparatus in accordance with the present invention.

In this embodiment, the techniques described in the above-mentioned first to fifth embodiments are combined, whereby a multi-layered buffer is constituted using a single port memory.

Figure 13:
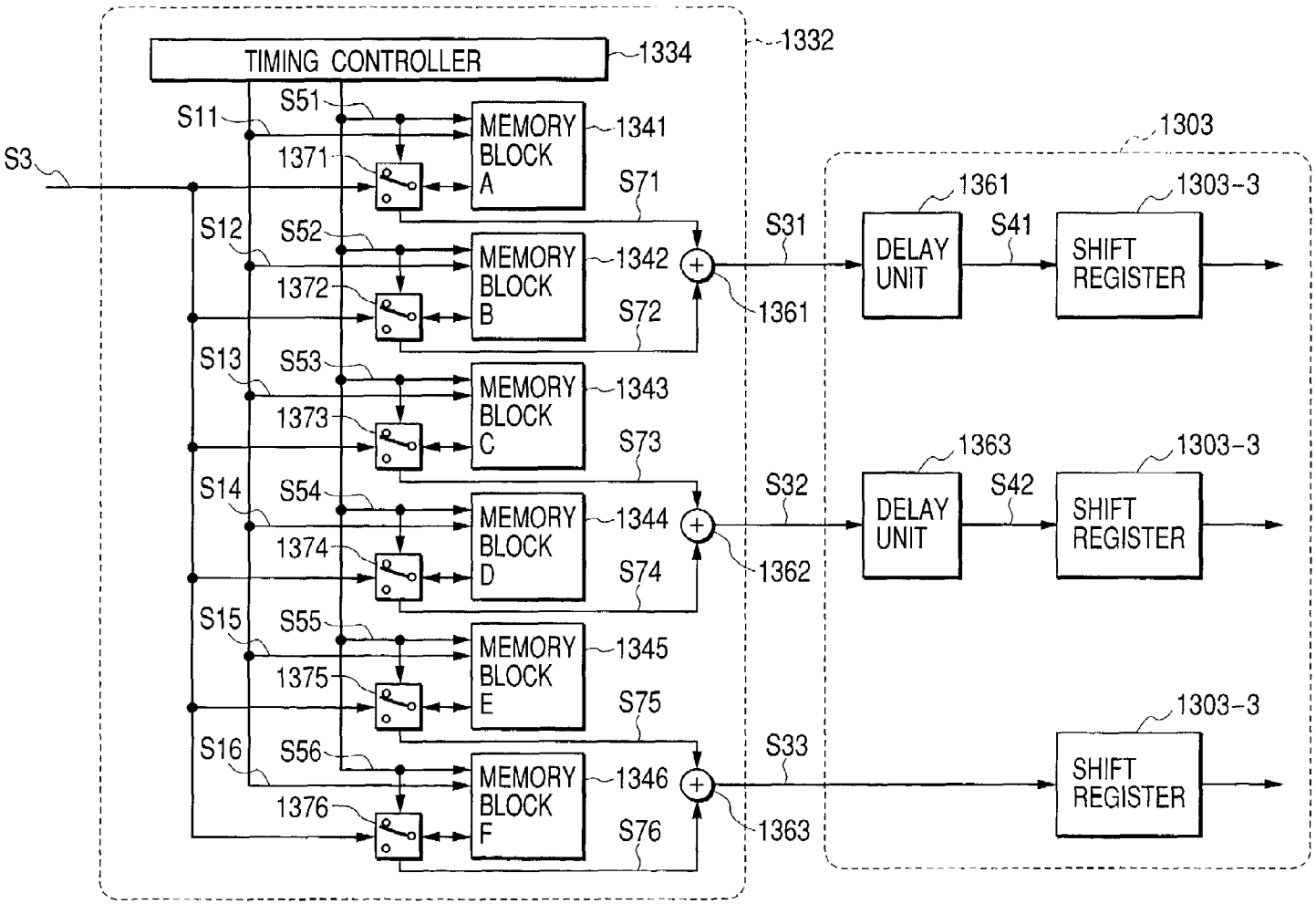
FIG. 13 is a diagram of a part of a multi-layered buffer 1332 and a drive unit 1303 in the image display apparatus in accordance with a seventh embodiment of the present invention.
Figure 14:
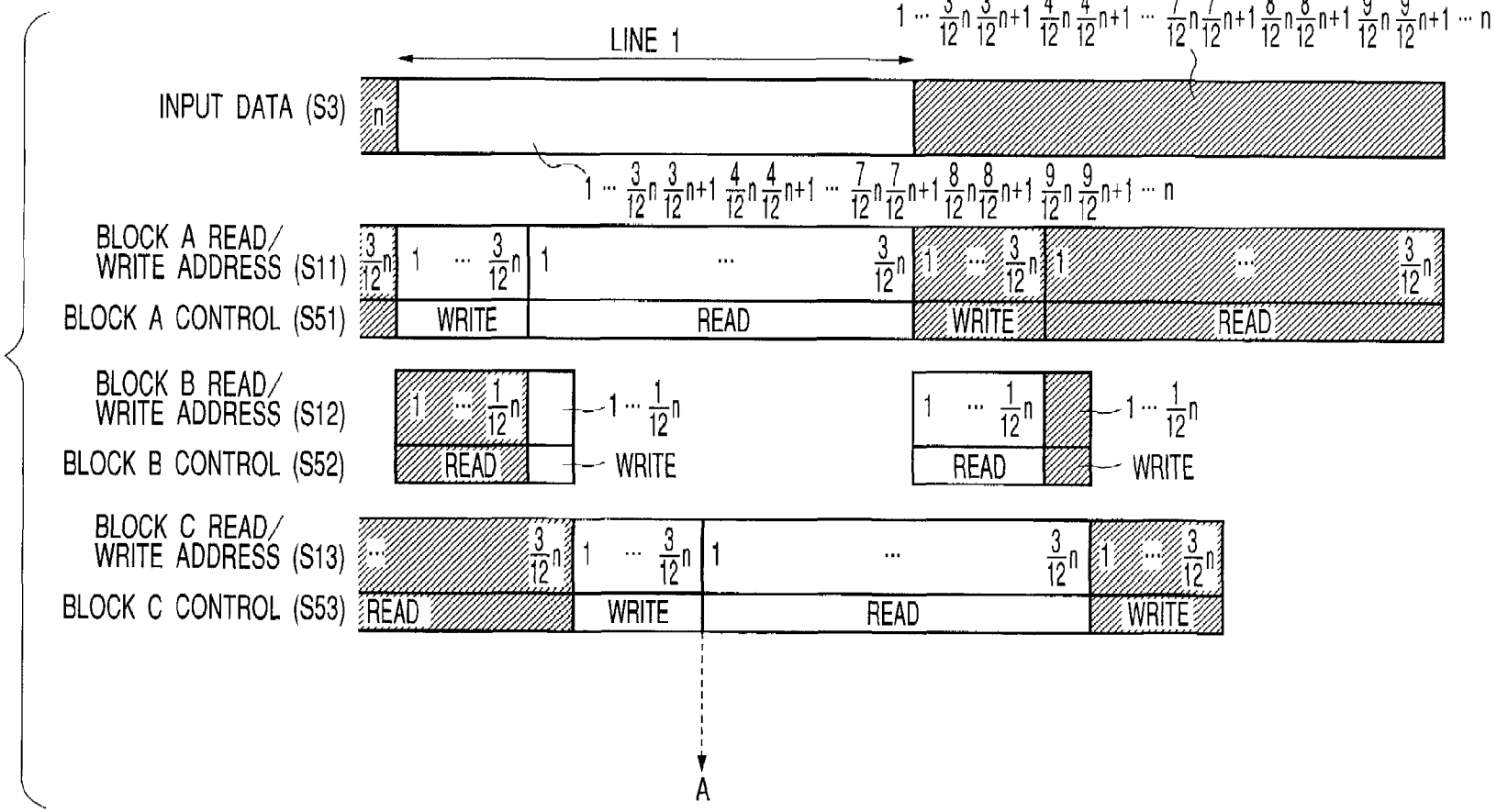
FIG. 14 is a timing chart of an operation of the image display apparatus shown in FIG. 13.
Figure 15:
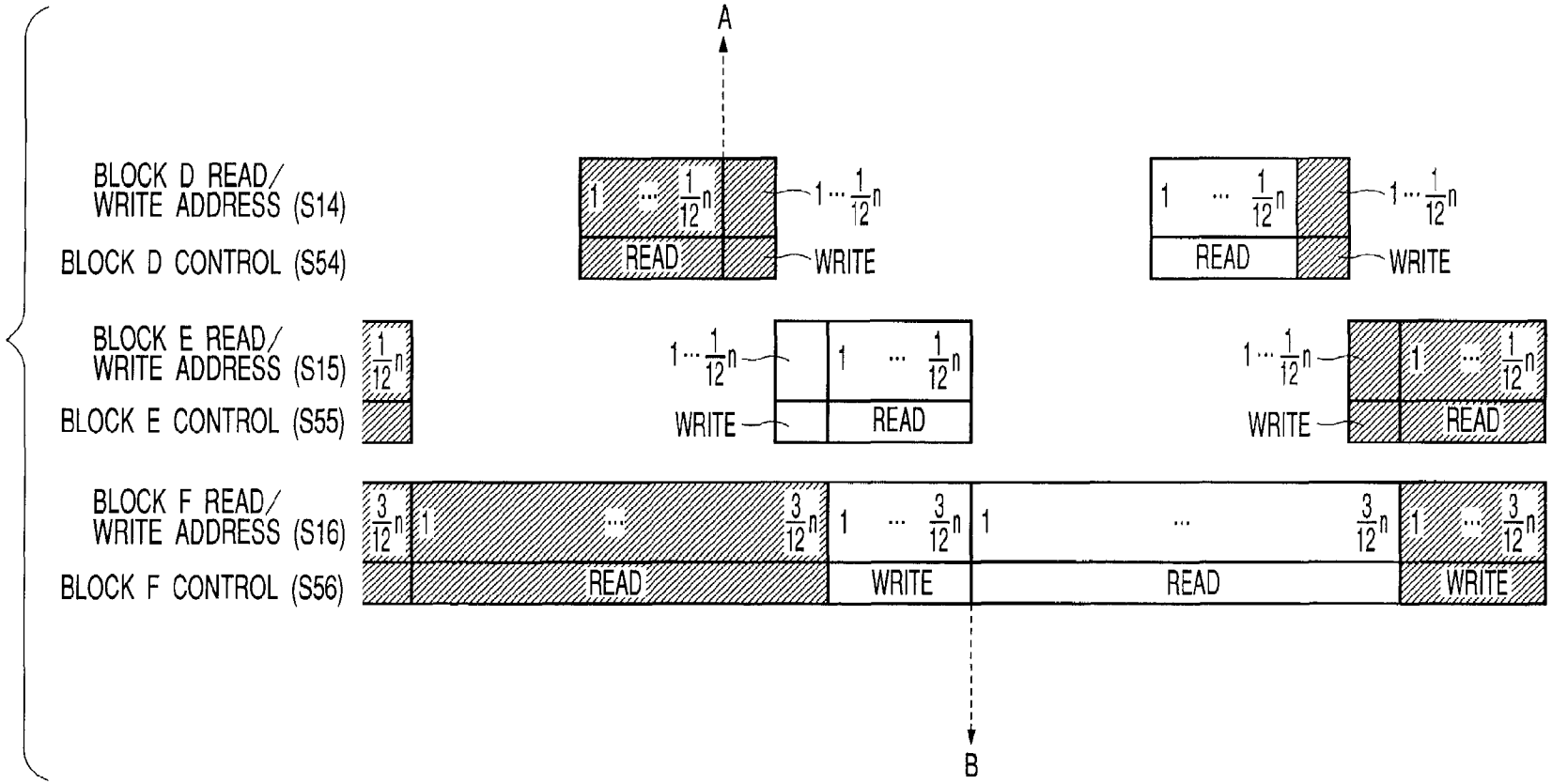
FIG. 15 is a timing chart of an operation of the image display apparatus shown in FIG. 13.
Figure 16:
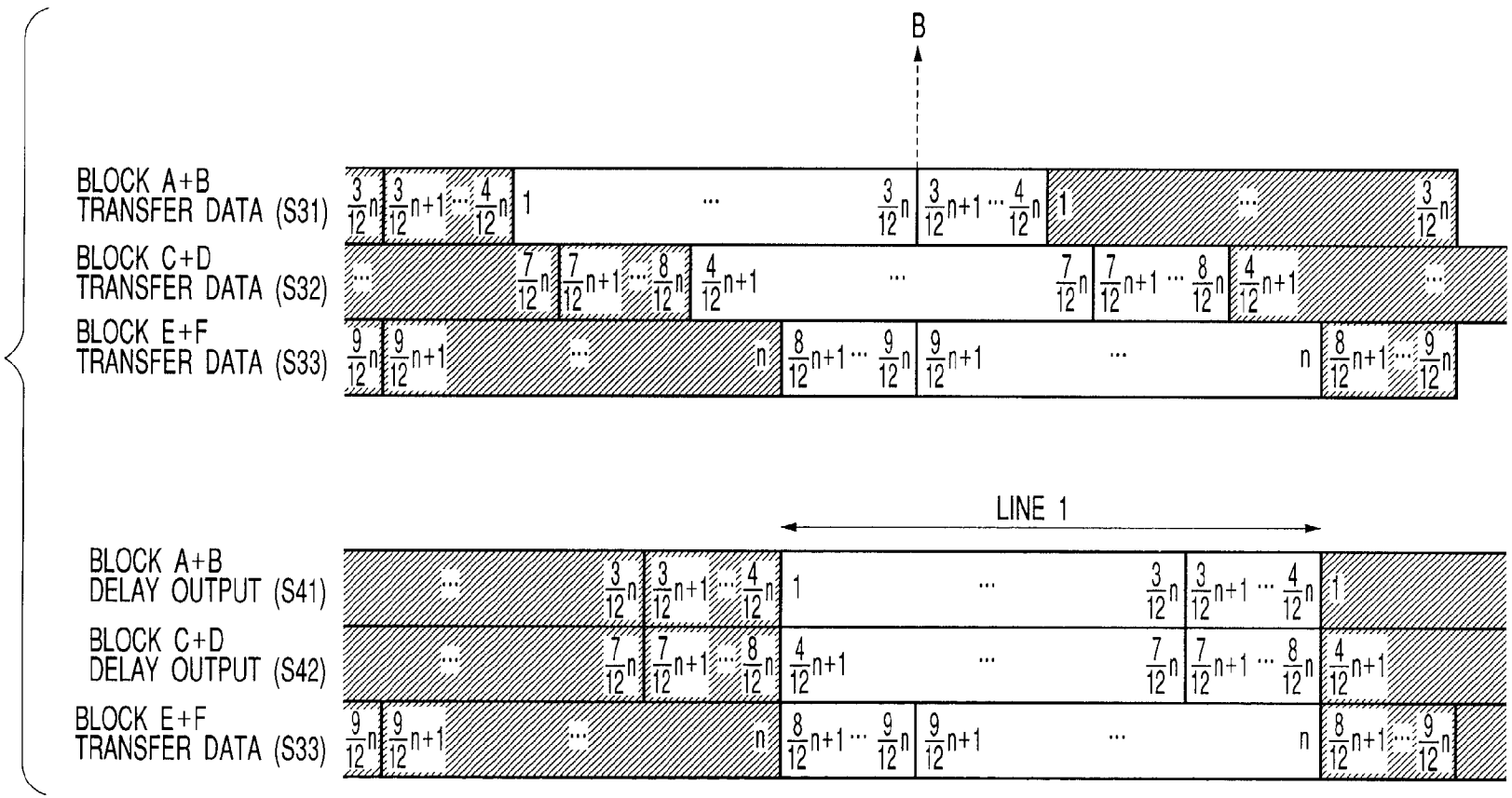
FIG. 16 is a timing chart of an operation of the image display apparatus shown in FIG. 13.

FIG. 13 is a diagram of a part of a multi-layered buffer 1332 and a drive unit 1303 in the seventh embodiment of the image display apparatus in accordance with the present invention. FIGS. 14, 15 and 16 are timing charts of operations of the image display apparatus shown in FIG. 13. Although FIGS. 14 to 16 are separated for ease of reference, timing A and timing B shown in the figures are actually common in each figure.

Further, the seventh embodiment of the image display apparatus in accordance with the present invention has an entire configuration and a configuration and operation of each member that are the same as those shown in FIG. 1 of the above-mentioned first embodiment except the multi-layered buffer 1332 and the drive unit 1303.

In this seventh embodiment, each memory in the above-mentioned second embodiment is further divided into two (using two memory blocks in association with each output path) and data is read and written alternately as described in the sixth embodiment.

Further, a ratio of division of a memory block is described below, which indicates how many input signals among input signals for one scan wiring are stored in each memory block.

If two modulation side drive circuits (D=2) are used as in the sixth embodiment, a ratio of division in dividing a memory corresponding to each output path into two memory blocks can be preferably selected in the range of 1:2 to 2:1. However, a used capacity of a memory can be made minimum when a final block is divided at the ratio of 1:2 and other blocks at the ratio of 2:1 as adopted in the sixth embodiment.

If three or more modulation side drive circuits are used (parallel transfer via three or more output paths is carried out, i.e., $D \geqq 3$), this embodiment is combined with the second and third embodiments. In this case, similarly, each memory is further divided into two and data is read and written alternately as described in the sixth embodiment.

A ratio of division in dividing each memory into two (a ratio of capacity of two memory blocks corresponding to one output path) can be preferably selected in the range of 1:D to D:1. In this case, a capacity of each memory block is $1/D(D+1)$ to $D/D(D+1)$ times as large as a sum of capacities of all shift registers held by a drive unit of the image display apparatus.

That is, as a ratio of storage capacities of two memory blocks (memory block divided into two) corresponding to one output path, assuming the memory blocks are given numbers in the order of input of a luminance signal to be inputted in the memory blocks, a capacity of a memory block of an odd number and a capacity of a memory block of an even number satisfy 1/D≦ (capacity of a memory block of an odd number)/(capacity of a memory block of an even number) ≦D for each memory block divided into two.

Here, the reason why a ratio of division in dividing a memory into two can be selected in the range of 1:D to D:1 and a capacity of each memory block in this case is 1/D(D+1) to D/D(D+1) times as large as a sum of capacities of all shift registers will be described.

It is assumed that the number of the transfer signals S31, etc. (output paths) is D, a WRITE period of S11 is W1, a READ period of S11 is R1, a WRITE period of S12 is W2, a READ period of S12 is R2, a period of one line is T and a ratio of division of memory blocks 41 and 42 is 1:n.

Here, conditions are as follows.

Since a read signal is outputted using the entire one line period, $$R1+R2=T \quad (1)$$

Since the input signal S3 is finally divided into D and outputted as S31, etc., a Transfer speed of S31, etc. is 1/D and, from R1=D·W1, R2=D·W2, $$W1+W2=T/D \quad (2)$$

From (1) and (2),

Since a ratio of division of memory blocks 1341 and 1342 is 1:n, $$R1=R2/n \quad (4)$$

$$W1=W2/n \quad (5)$$

$$R2=nR1 \quad (6)$$

$$W2=nW2 \quad (7)$$

In addition, since a read operation and a write operation cannot be carried out simultaneously in each of the memory blocks 41 and 42 and an operation must be finished within one line period, the following should be a condition.

$$R1+W1\leqq T \quad (8)$$

$$R2+W2\leqq T \quad (9)$$

Here, from (3), (4) and (5), $$(R2+W2)(1+1/n)=T(1+1/D) \quad (10)$$

Moreover, from (9) and (10), $$n\leqq D \quad (11)$$

Similarly, from (3), (6), (7) and (8), $$n>/D \quad (12)$$

Then, from (11) and (12), a ratio of division of the memory blocks 1341 and 1342 is 1:D to D:1.

In addition, when a last memory that is a memory corresponding to the last output path is divided into memory blocks with a ratio of capacity of 1:D and memories corresponding to other output paths are divided into memory blocks with a ratio of capacity of D:1, that is, a capacity of an Xth memory block is D/D (D+1) times (X=1, 3, 5, . . . , 2D−5, 2D−3 and 2D) and 1/D(D+1) times (X=2, 4, 6, . . . , 2D−4, 2D−2 and 2D−1) as large as a capacity of a shift register, a used capacity of a memory can be minimum.

Here, (1) the reason why the last memory is divided into two memory blocks with the ratio of capacity of 1:D and the other memories are divided into two memory blocks with the ratio of capacity of D:1 and (2) the reason why a capacity of the Xth memory block is D/D (D+1) times (X=1, 3, 5, . . . , 2D−5, 2D−3 and 2D) and 1/D (D+1) times (X=2, 4, 6, . . . , 2D−4, 2D−2 and 2D−1) as large as a capacity of a shift register for making a used capacity of a memory minimum will be described.

(1) Reason Why the Last Memory is Divided into Two Memory Blocks with the Ratio of Capacity of 1:D and the Other Memories are Divided into Two Memory Blocks with the Ratio of Capacity of D:1

To add for making it sure, "memory for which a used capacity can be reduced" referred to here is a memory corresponding the delay units 1361 and 1363 and the capacities of the memory blocks A 1341 to F 1346 are unchanged.

In this embodiment, since timing shifts when the transfer signals S31, etc. are outputted from the multi-layered buffer 1332, timing is made the same by delay unit lines 1361 and 1362.

As the timing of the transfer signals S31, etc., output from the first memory (S31) is outputted at the earliest timing and output from the last memory (S33) is outputted at the latest timing.

Thus, timing of all the transfer signals is made the same as that of the output from the last memory with including the delay lines.

On the other hand, in the memory blocks 1341 to 1346, if the ratio of division is changed between 1:D to D:1, timing for outputting the transfer signals also changes.

More specifically, the transfer signals are outputted earliest when the ratio of division is 1:D and are outputted latest when it is D:1.

Since output from the other memories must be delayed until output from the last memory is started, the ratio of division of 1:D with which the transfer signals are outputted earliest is selected for the output from the last memory. In addition, since the capacities of the delay units 1361 and 1362 can be reduced when the transfer signals are outputted from the other memories as late as possible, the ratio of division of D:1 is selected for the output from the other memories.

(2) Concerning the Capacity of the Xth Memory Block

If a ratio of division of Xth memory block 41 or the like is determined, from the ratio of division 1/D by the transfer data S31, etc. and the ratio of division 1:D or D:1 (1/(D+1), D/(D+1)) inside the memory block, the capacity of the memory block is D/D (D+1) times (X=1, 3, 5, . . . , 2D−5, 2D−3 and 2D, that is, if D is 3, X=1, 3, 6) and 1/D (D+1) times (X=2, 4, 6, . . . , 2D−4, 2D−2 and 2D−1, that is, if D is 3, X=2, 4, 5).

Details of the other operations are substantially the same as those of the embodiments already described. An operation speed of a shift register can be reduced with a smaller memory capacity as in the above-mentioned each embodiment.

(Eighth Embodiment)

In the above-mentioned embodiments, data corresponding to a plurality of colors (R, G and B) is divided by driving display elements such that data arranged in time-series in advance is transmitted in parallel with each other to a plurality of modulation side drive circuits. However, an embodiment of the present invention is not limited to this. In an eighth embodiment, a configuration will be described in which modulated data for each color is divided separately, and then data corresponding to a plurality of colors that are composed and arranged in time-series are used in a modulation side drive circuit.

More specifically, an output circuit is used here which is a combination of a division circuit (output circuit for each color), which divides time-series modulated data of each color into a plurality of parallel modulated data each heading toward a plurality of modulation side drive circuits, and an RGB selective arrangement unit, which is a composed circuit provided between the division circuit and the modulation side drive circuits. That is, modulated data is divided for a signal of each color and outputted in parallel, and the output is selected and arranged in time-series such that the output becomes a time-series signal including a signal of each color and inputted in the modulation side drive circuits. Here, a configuration for division is basically the same as the configuration of the output circuit used in the first embodiment.

Figure 17:
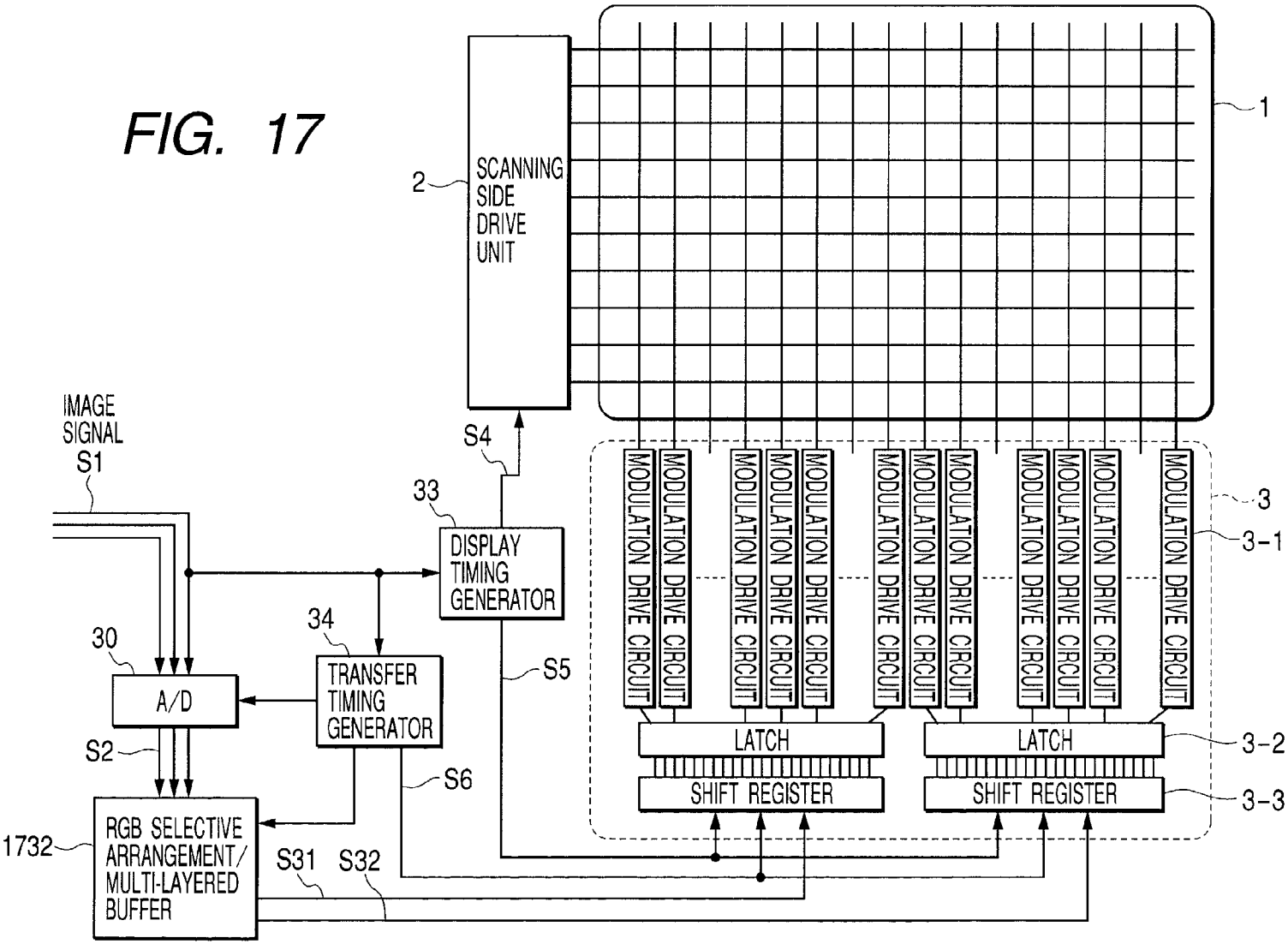
FIG. 17 is a diagram showing the entire image display apparatus in accordance with an eighth embodiment of the present invention.

FIG. 17 is a diagram showing the entire image display apparatus in the eighth embodiment of the image display apparatus in accordance with the present invention. Reference numeral 1732 denotes a multi-layered buffer integrated with an RGB selective arrangement unit, in which an image signal S2 for each of R, G and B is inputted and selectively arranged and multi-layered.

Further, the eighth embodiment of the image display apparatus in accordance with the present invention has a configuration and operation that are the same as those shown in FIG. 1 of the above-mentioned first embodiment except the multi-layered buffer 1732.

Figure 18:
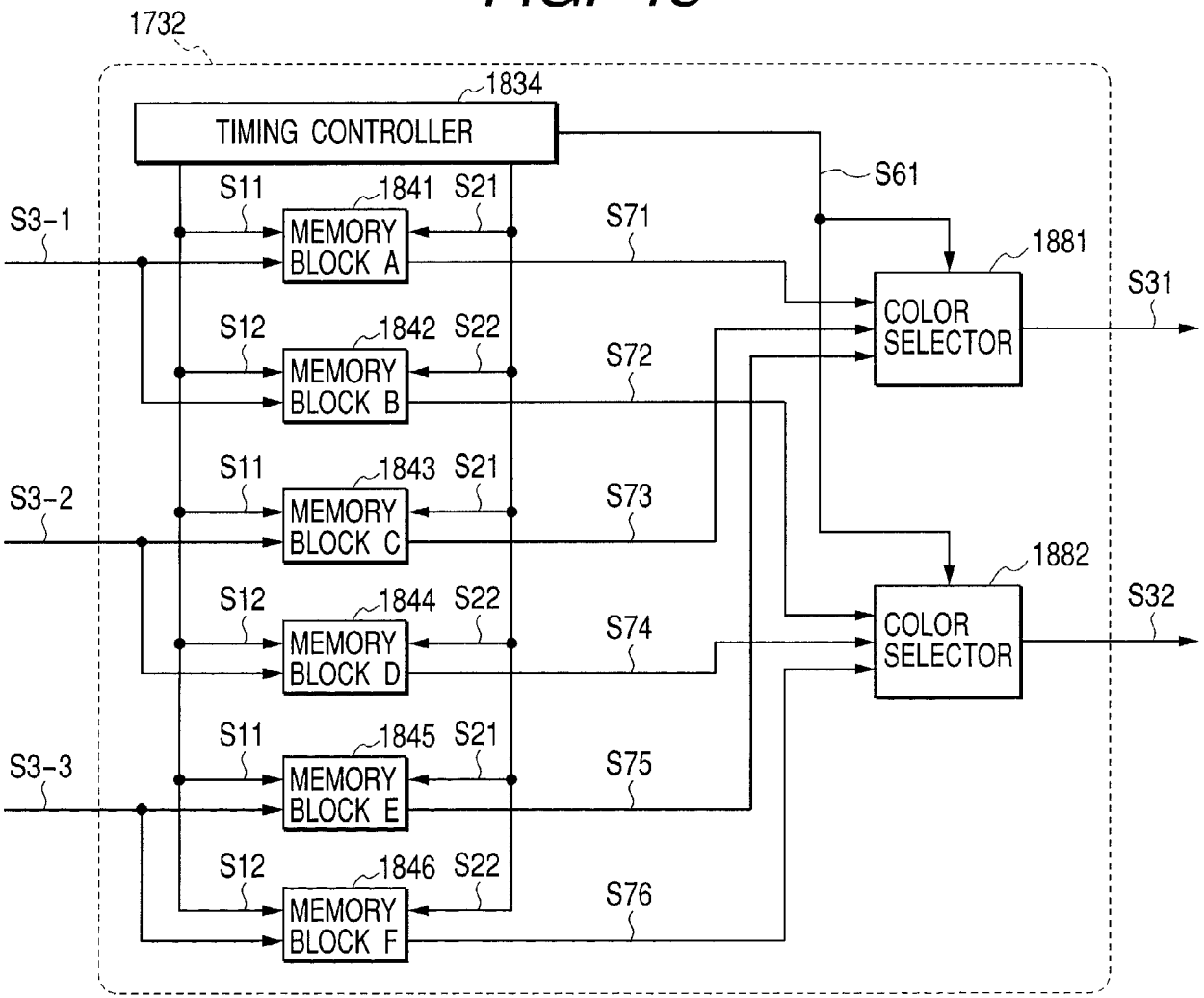
FIG. 18 is a diagram of a multi-layered buffer 1732 integrated with an RGB selective arrangement unit, which is used in the image display apparatus shown in FIG. 17.
Figure 19:
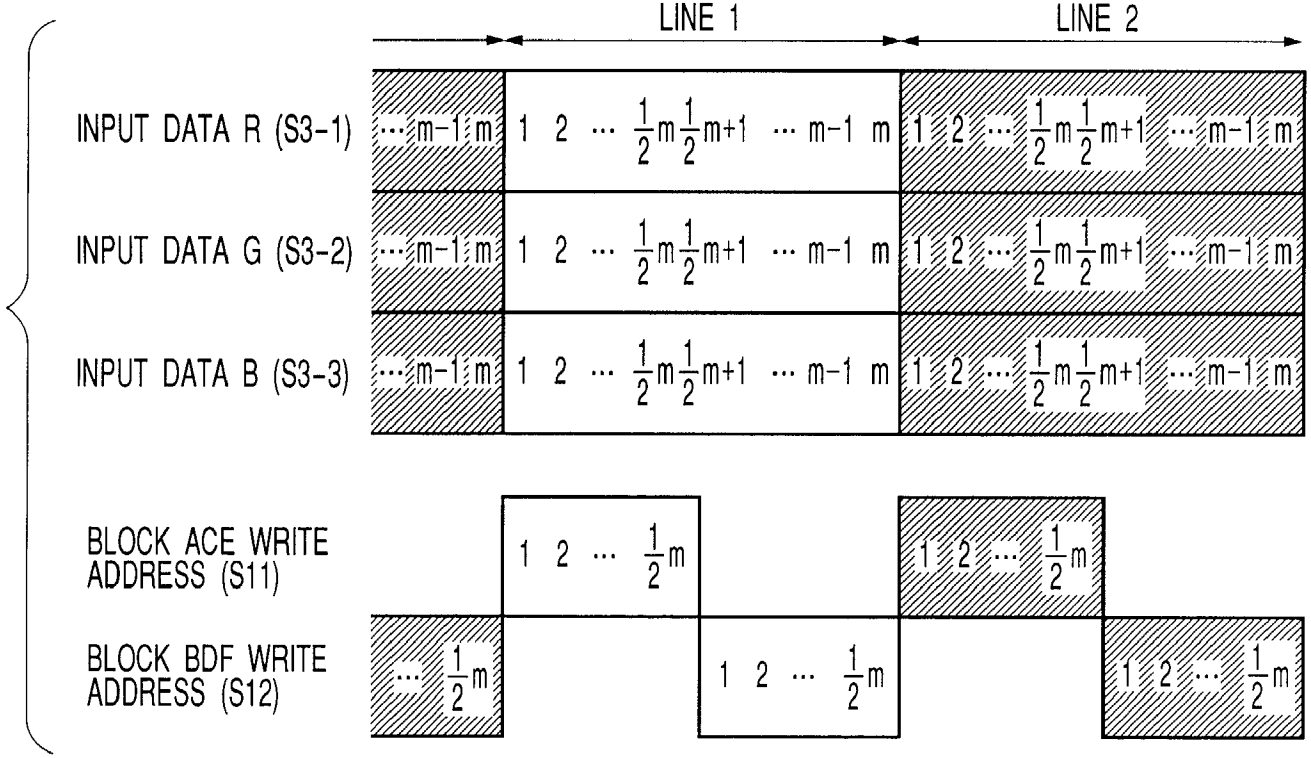
FIG. 19 is a timing chart of an operation of the image display apparatus of the eighth embodiment shown in FIG. 17.
Figure 20:
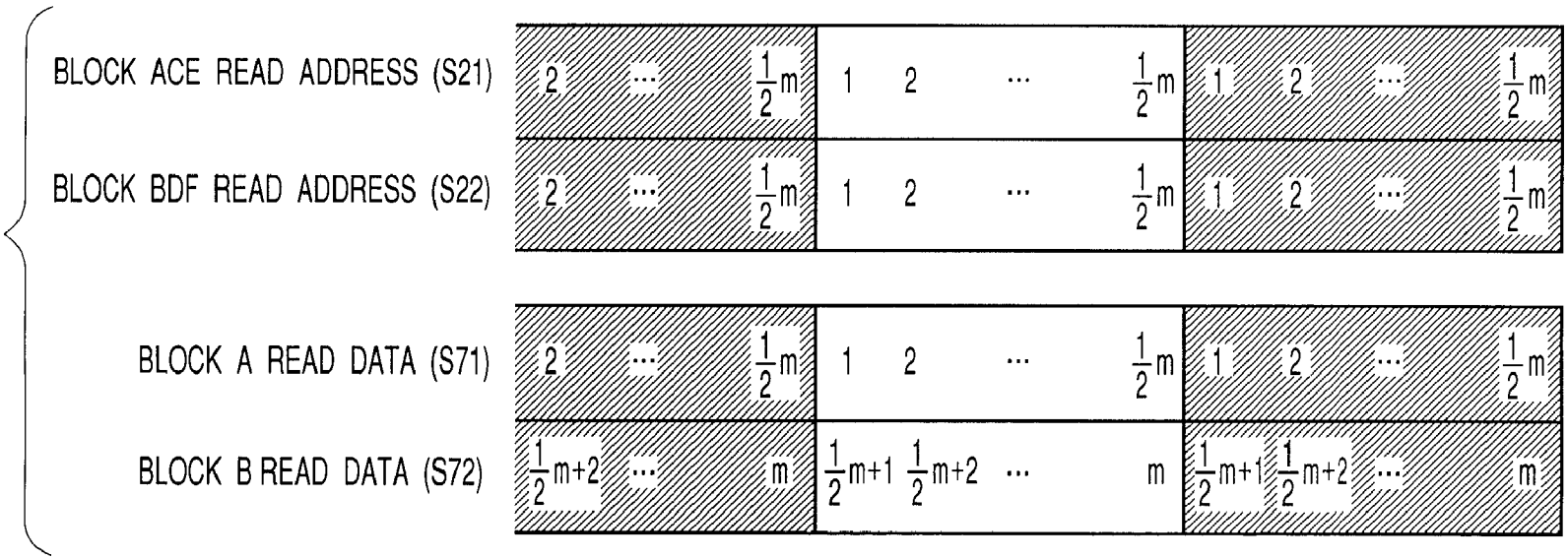
FIG. 20 is a timing chart of an operation of the image display apparatus of the eighth embodiment shown in FIG. 17.
Figure 21:
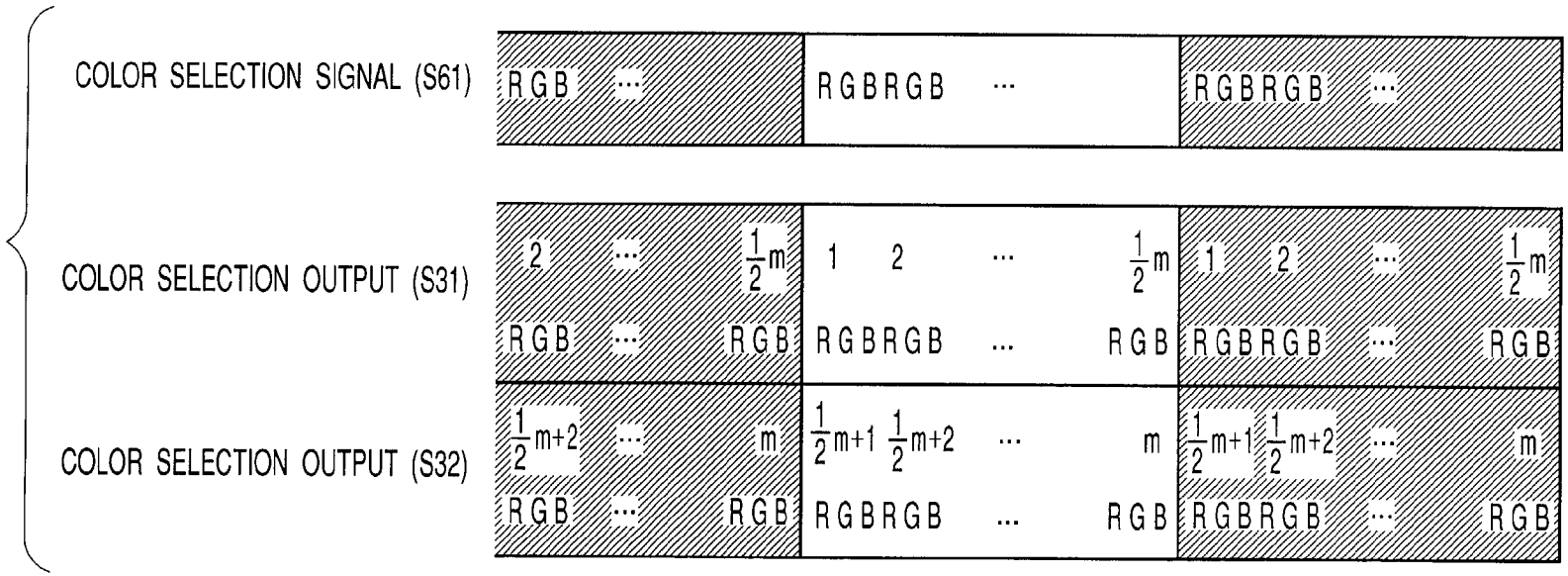
FIG. 21 is a timing chart of an operation of the image display apparatus of the eighth embodiment shown in FIG. 17.
Figure 22:
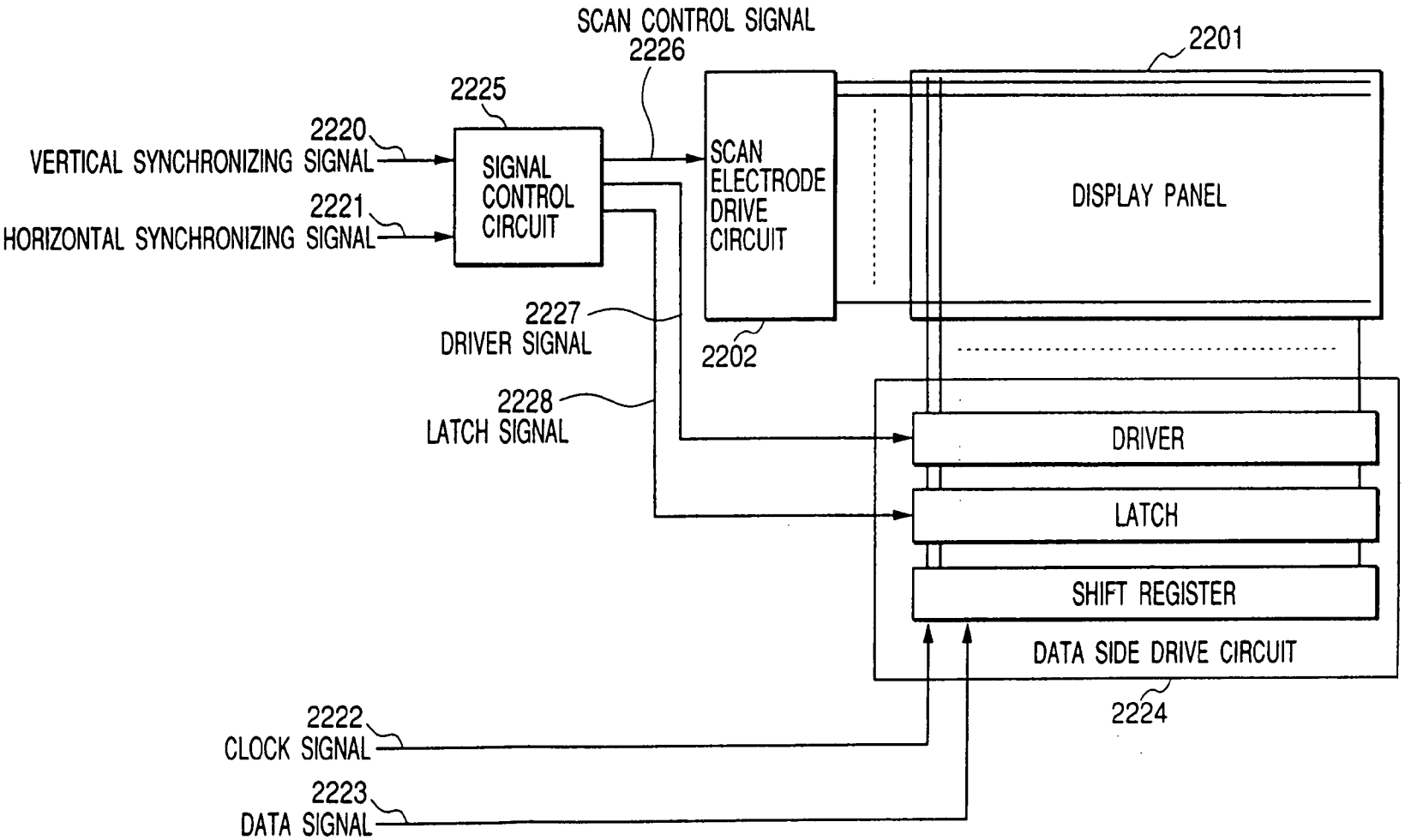
FIG. 22 (PRIOR ART)
FIG. 22 is a diagram showing a configuration of a conventional image display apparatus shown in Japanese Patent Application Laid-Open No. 5-100632.
Figure 23:
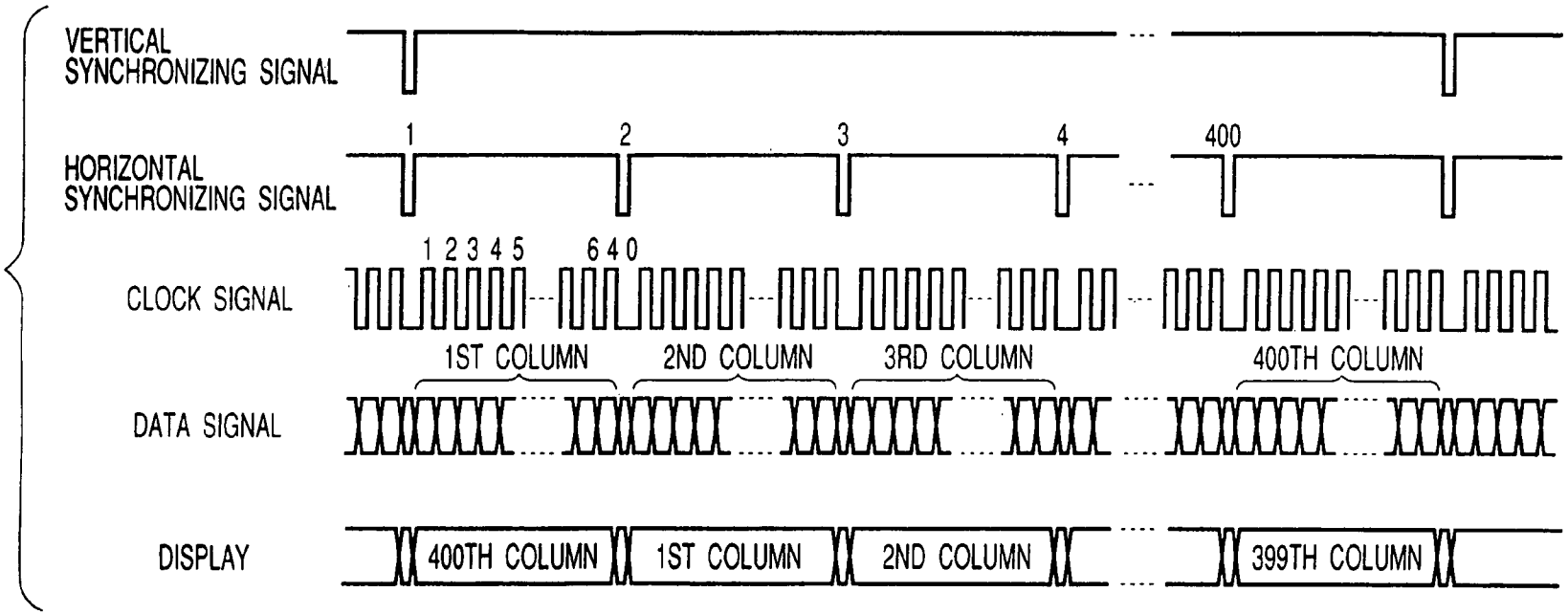
FIG. 23 (PRIOR ART)
FIG. 23 is a timing chart of the image display apparatus shown in FIG. 22.
Figure 24:
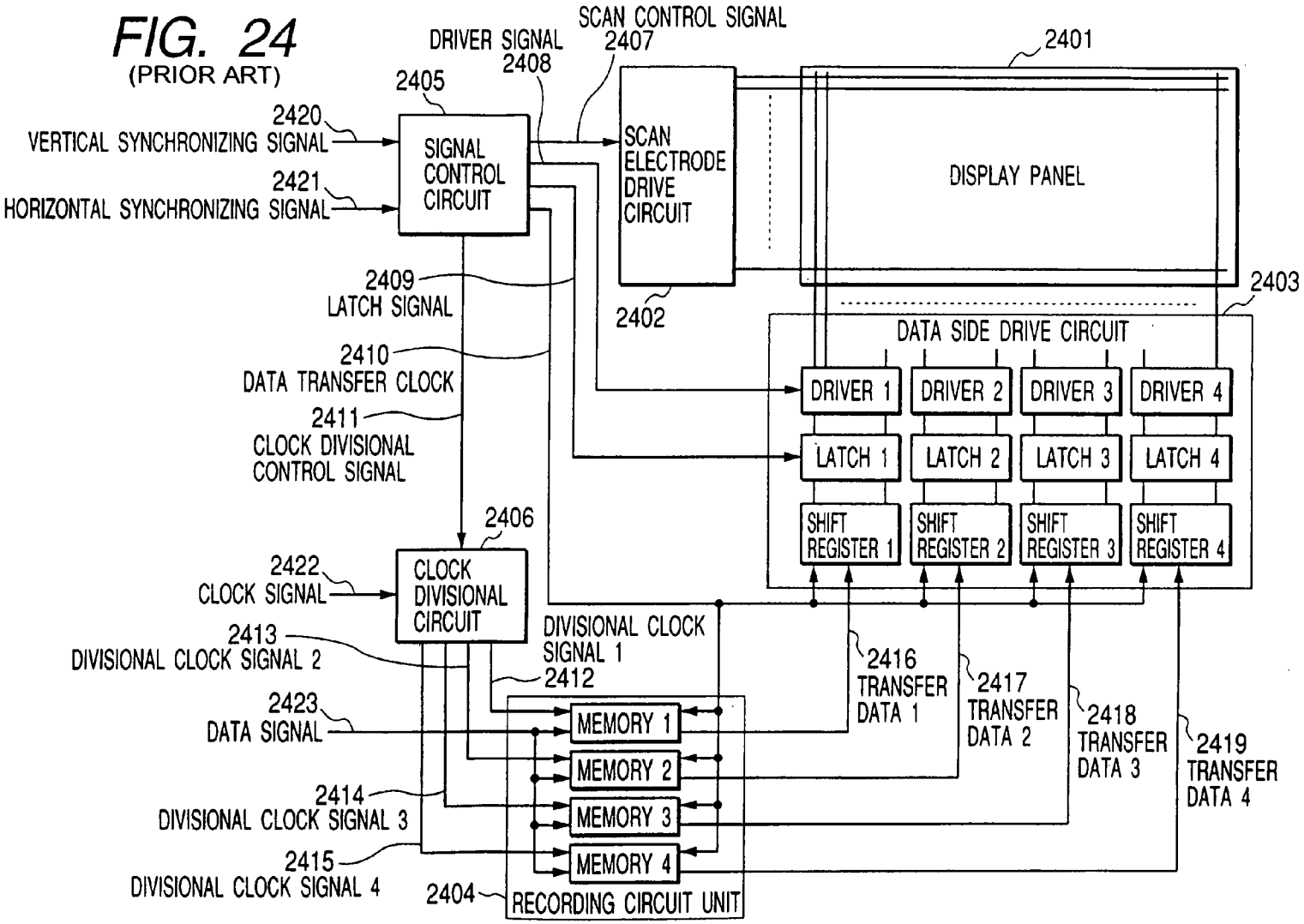
FIG. 24 (PRIOR ART)
FIG. 24 is a diagram of a conventional image display apparatus.
Figure 25:
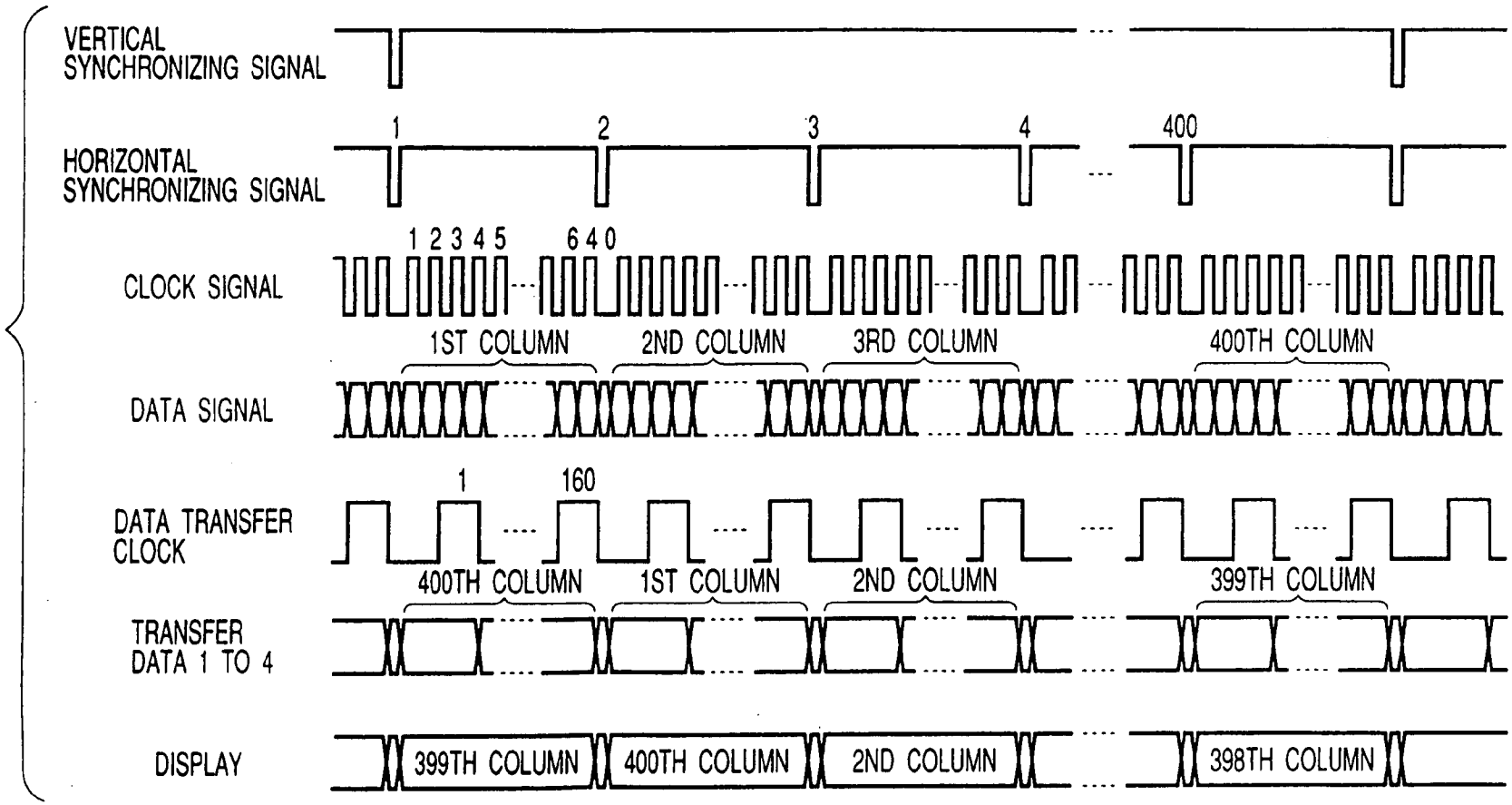
FIG. 25 (PRIOR ART)
FIG. 25 is a timing chart of the image display apparatus shown in FIG. 24.
Figure 26:
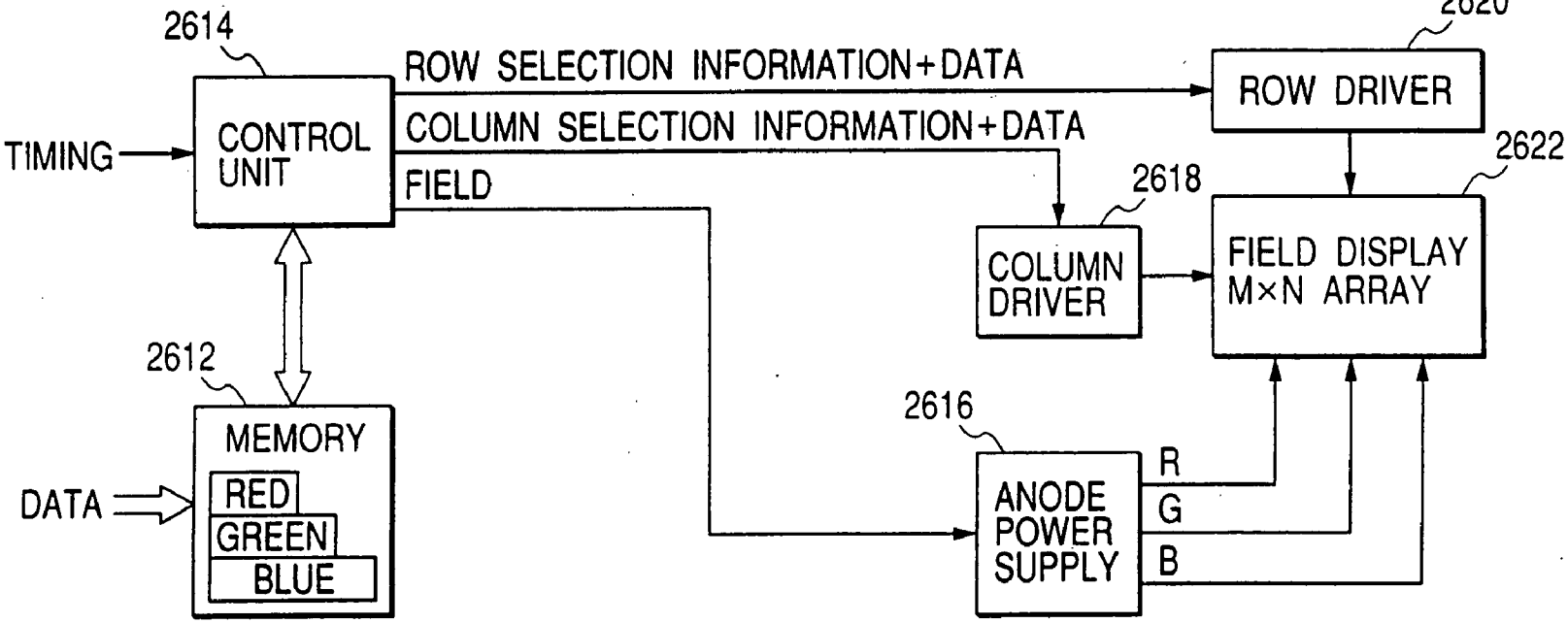
FIG. 26 (PRIOR ART)
FIG. 26 is a diagram of an image display apparatus shown in U.S. Pat. No. 5,710,604.
Figure 27:
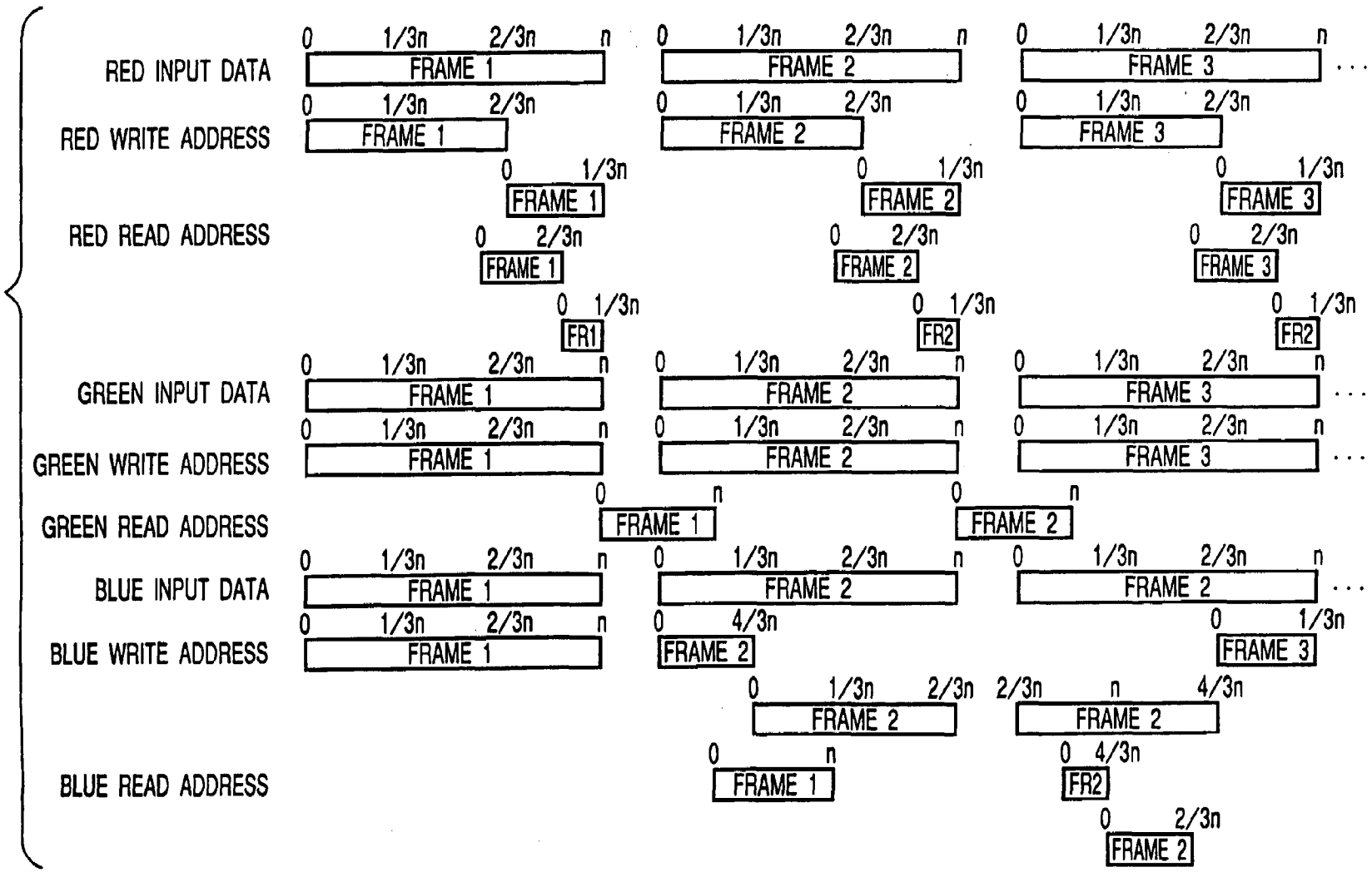
FIG. 27 (PRIOR ART)
FIG. 27 is a timing chart of the image display apparatus shown in FIG. 26.
Figure 28:
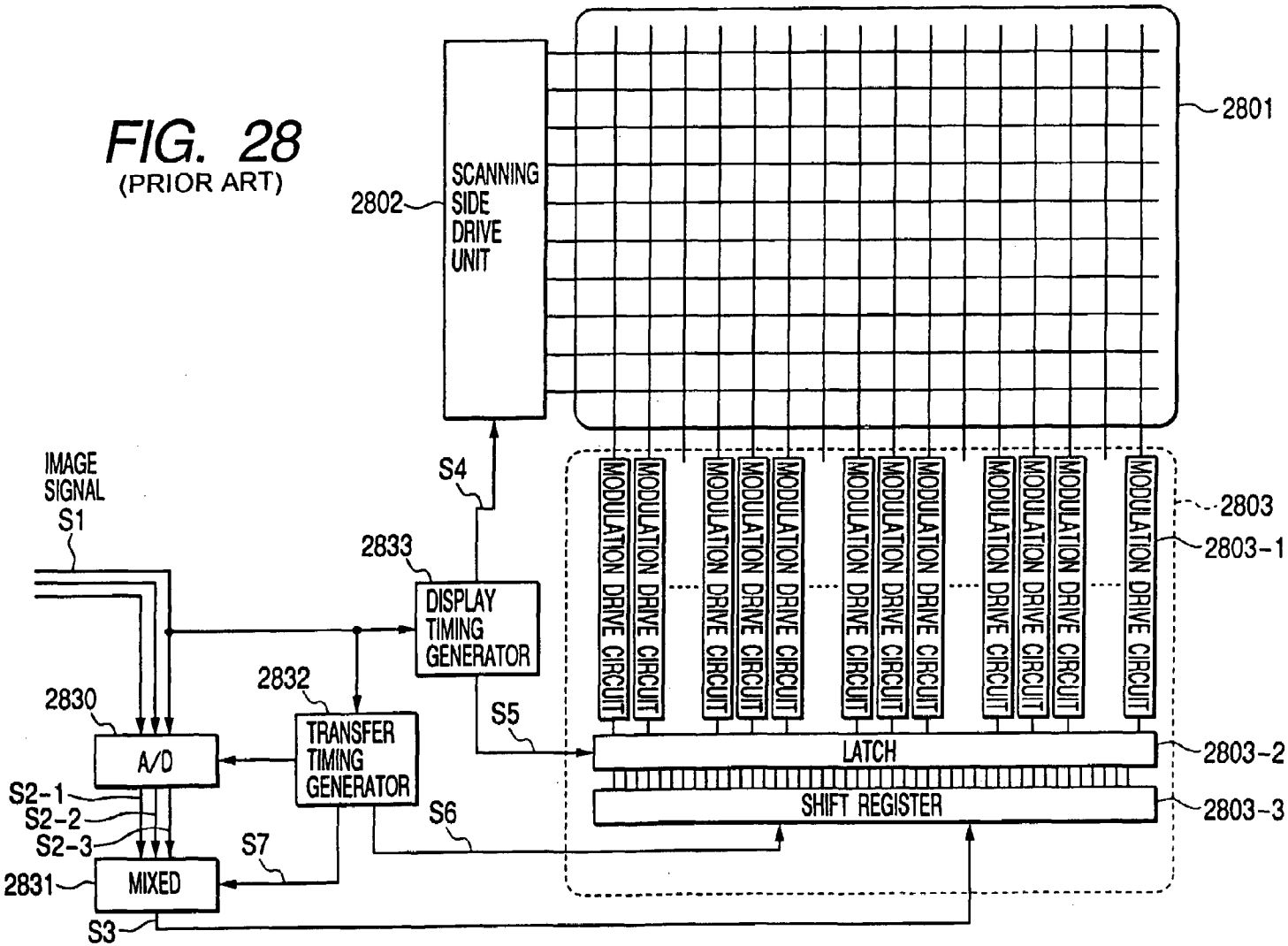
FIG. 28 (PRIOR ART)
FIG. 28 is a diagram of an image display apparatus using a conventional matrix display panel.
Figure 29:
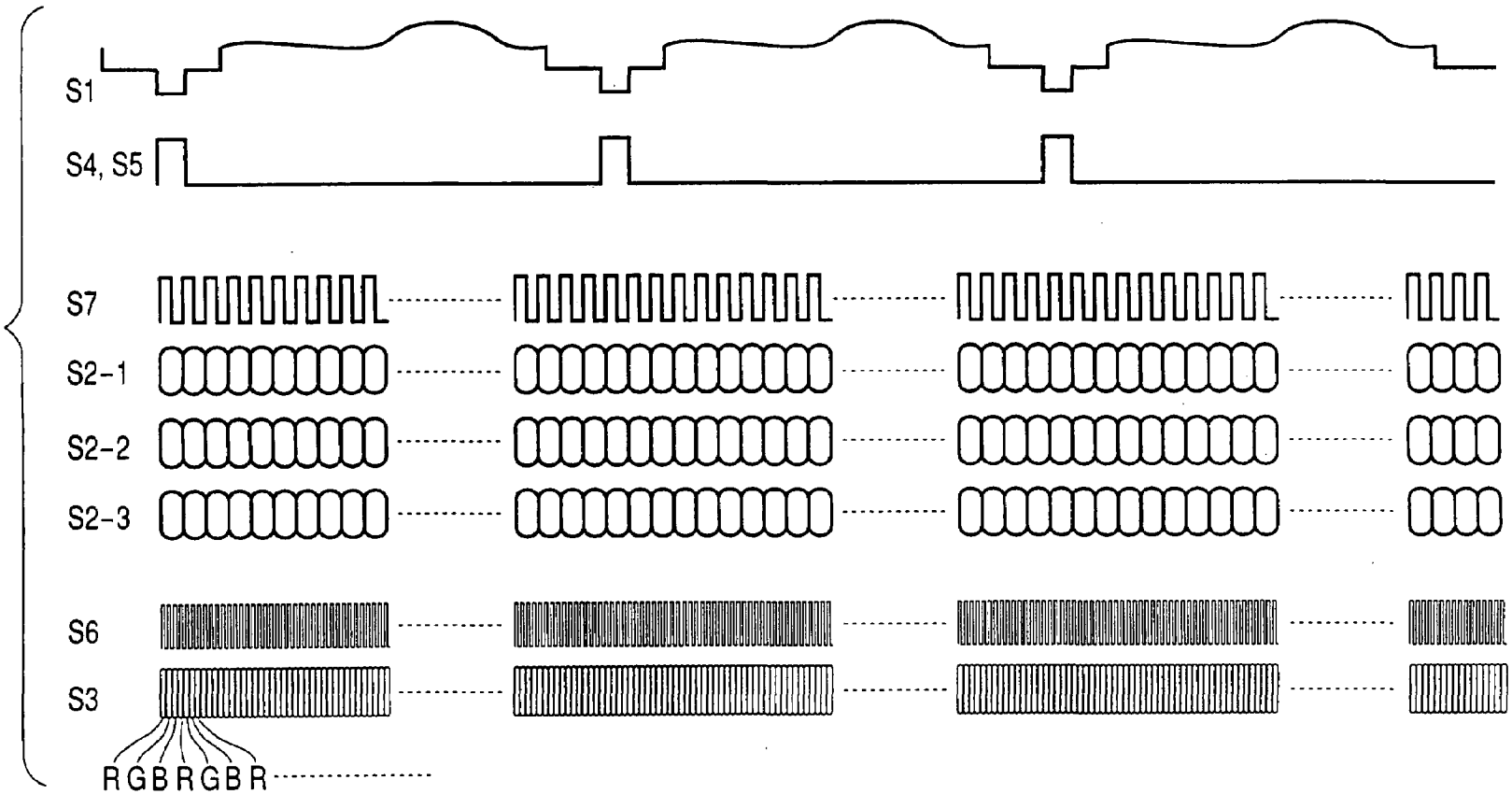
FIG. 29 (PRIOR ART)
FIG. 29 is a timing chart of signals of the image display apparatus shown in FIG. 28.

FIG. 18 is a diagram of the multi-layered buffer 1732 integrated with the RGB selective arrangement unit, which is used for the image display apparatus shown in FIG. 17. FIGS. 19, 20 and 21 are timing charts of operations of the eighth embodiment of the image display apparatus shown in FIG. 17.

Since the number of modulation wirings of the display panel 1 is n, the number of horizontal pixels m for each of R, G and B is m=n/3. In addition, it is assumed that a pixel arrangement of the display panel 1 is in the order of R, G and B along a scan wiring. That is, an input signal for one scan wiring for each color to be inputted in the output circuit (multi-layered buffer) in this context is constituted by a set of signals corresponding to display elements to be connected to the scan wiring at an interval of two display elements corresponding to the other colors.

Reference symbols S3-1 to S3-3 shown in FIG. 18 denote image signals for each of R, G and B. Reference symbol S61 denotes a color selection signal for selectively arranging R, G and B. Reference numerals 1881 and 1882 denote color selectors for selecting a color based on the color selection signal S61. Reference symbols S31 and S32 denote transfer signals that are divided and for which R, G and B are selectively arranged.

The image signal S3-1 is divided into RGB signals S71 and S72 by the same method as in the above-mentioned first embodiment using a memory block A 1841 and a memory block B 1842. That is, the memory block A 1841 and the memory block B 1842 constitute an output circuit corresponding to red. The RGB signals S71 and S72 have a data speed that is half the speed of the image signal S3-1.

The image signals S3-2 and S3-3 are divided into RBG signals S73 to S76 in the same manner.

That is, a memory constituted by the memory blocks A, C and E corresponding to each color is associated with one output path (path through which modified data S31 is transferred). A memory constituted by the memory blocks B, D and F is associated with another output path (path through which modulated data S32 is transferred).

Then, as shown in FIGS. 19, 20 and 21, the color selection signal S61 continues to change in the order of R, G and B in synchronism with a speed three times as high as that of the divided RGB signals S71 to S76.

The color selector 1881 inputs the divided image signals S71, S73 and S75 and selects a signal according to the color selection signal S61 to output the transfer signal S31.

Similarly, the color selector 1882 inputs the divided image signals S32, S34 and S36 to output the transfer signal S32.

Consequently, it can be realized to generate the transfer signals S31 and S32, for which R, G and B are selectively arranged, at a speed 1.5 times as high as that of the image signal S2 with a storage capacity equal to the capacity for one scan wiring.

In addition, similarly, it is also naturally possible to combine the methods described in the above-mentioned second embodiment and seventh embodiment with the RGB selective arrangement.

As described above, according to each embodiment, it becomes possible to provide an image display apparatus in which an operation speed of a shift register is low and a used capacity of a memory is reduced.

Further, it is possible to combine the configuration of each embodiment described above for use.

Thus, it is seen that an image display apparatus is provided. One skilled in the art will appreciate that the present invention can be practiced by other than the preferred embodiments which are presented for the purposes of illustration and not of limitation, and the present invention is limited only by the claims which follow.

What is claimed is:

1. An image display apparatus comprising:

a plurality of scan wirings;

a plurality of modulation wirings forming a matrix wiring together with the scan wirings;

display elements to be driven in matrix according to a scan signal applied by the scan wirings and a modulation signal applied by the modulation wirings;

a scan circuit for scanning the plurality of scan wirings and applying a scan signal to the selected scan wiring;

an output circuit for storing an input signal to be inputted in time-series, generating a plurality of outputs consisting of a time-series signal for generating a modulation signal based on the stored result and outputting the plurality of outputs to a plurality of output paths as parallel outputs; and a modulation side drive circuit for outputting parallel modulation signals based on the time-series signal for generating a modulation signal, wherein the modulation side drive circuit is provided in a plural form corresponding to each of the plurality of output paths and each of the plurality of modulation side drive circuits supplies the modulation signal to a part of and a plurality of modulation wirings among the plurality of modulation wirings, and wherein the output circuit starts to output at least one of the parallel outputs before storing the input signal for constituting the rearmost end among respective rear ends of the parallel outputs.

2. An image display apparatus according to claim 1, wherein a plurality of outputs among the parallel outputs are started to be outputted substantially simultaneously.

3. An image display apparatus according to claim 2, wherein the signal to be inputted in time-series has first to Dth parts, with D being an integer equal to or larger than 2, in the order of input in the output circuit, and the output circuit is for outputting the D parallel outputs based on each of the D parts and finishes outputting the D outputs substantially simultaneously.

4. An image display apparatus according to claim 2, wherein the signal to be inputted in time-series has first to Dth parts, with D being an integer equal to or larger than 2, in the order of input in the output circuit, and the output circuit is for outputting the D parallel outputs based on each of the D parts and starts to output a first output corresponding to the first part when a Dth output corresponding to the Dth part is ready to be outputted or later.

5. An image display apparatus according to claim 4, wherein the signal to be inputted in time-series has first to Dth parts, with D being an integer equal to or larger than 2, in the order of input in the output circuit, and the output circuit is for outputting the D parallel outputs based on each of the D parts and finishes outputting the D outputs substantially simultaneously.

6. An image display apparatus according to claim 4, wherein the signal to be inputted in time-series has first to Dth parts, with D being an integer equal to or larger than 2, in the order of input in the output circuit, the output circuit is for outputting the D parallel outputs based on each of the D parts, and starts to output a first output corresponding to the first part substantially simultaneously with the start of output of a Dth output corresponding to the Dth part.

7. An image display apparatus according to claim 6, wherein the signal to be inputted in time-series has first to Dth parts, with D being an integer equal to or larger than 2, in the order of input in the output circuit, and the output circuit is for outputting the D parallel outputs based on each of the D parts and finishes outputting the D outputs substantially simultaneously.

8. An image display apparatus according to claim 6, wherein the signal to be inputted in time-series has first to Dth parts, with D being an integer equal to or larger than 2, in the order of input in the output circuit, and the output circuit is for outputting the D parallel outputs based on each of the D parts and starts to output the D outputs substantially simultaneously.

9. An image display apparatus according to claim 8, wherein the signal to be inputted in time-series has first to Dth parts, with D being an integer equal to or larger than 2, in the order of input in the output circuit, and the output circuit is for outputting the D parallel outputs based on each of the D parts and finishes outputting the D outputs substantially simultaneously.

10. An image display apparatus according to claim 1, wherein the signal to be inputted in time-series has first to Dth parts, with D being an integer equal to or larger than 2, in the order of input in the output circuit, and the output circuit is for outputting the D parallel outputs based on each of the D parts and starts to output a first output corresponding to the first part when a Dth output corresponding to the Dth part is ready to be outputted or later.

11. An image display apparatus according to claim 10, wherein the signal to be inputted in time-series has first to Dth parts, with D being an integer equal to or larger than 2, in the order of input in the output circuit, and the output circuit is for outputting the D parallel outputs based on each of the D parts and finishes outputting the D outputs substantially simultaneously.

12. An image display apparatus according to claim 10, wherein the signal to be inputted in time-series has first to Dth parts, with D being an integer equal to or larger than 2, in the order of input in the output circuit, the output circuit is for outputting the D parallel outputs based on each of the D parts, and starts to output a first output corresponding to the first part substantially simultaneously with the start of output of a Dth output corresponding to the Dth part.

13. An image display apparatus according to claim 12, wherein the signal to be inputted in time-series has first to Dth parts, with D being an integer equal to or larger than 2, in the order of input in the output circuit, and the output circuit is for outputting the D parallel outputs based on each of the D parts and finishes outputting the D outputs substantially simultaneously.

14. An image display apparatus according to claim 12, wherein the signal to be inputted in time-series has first to Dth parts, with D being an integer equal to or larger than 2, in the order of input in the output circuit, and the output circuit is for outputting the D parallel outputs based on each of the D parts and starts to output the D outputs substantially simultaneously.

15. An image display apparatus according to claim 14, wherein the signal to be inputted in time-series has first to Dth parts, with D being an integer equal to or larger than 2, in the order of input in the output circuit, and the output circuit is for outputting the D parallel outputs based on each of the D parts and finishes outputting the D outputs substantially simultaneously.

16. An image display apparatus according to claim 1, wherein the signal to be inputted in time-series has first to Dth parts, with D being an integer equal to or larger than 2, in the order of input in the output circuit, and the output circuit is for outputting the D parallel outputs based on each of the D parts and finishes outputting the D outputs substantially simultaneously.

17. An image display apparatus according to any one of claims 1 to 9, wherein an input signal to be inputted in the output circuit in time-series in order to output the plurality of parallel outputs is n time-series input signals for generating n modulation signals to be supplied in parallel with each other to the modulation wirings, the output circuit is for storing the n time-series input signals in first to Dth memories, with D being an integer equal to or larger than 2, one after another in the order of input, and each of the memories is for writing the input signal in an address designated by a write address to be given and reading a signal written in an address designated by a read address to be given, wherein a write address to be given to an Xth memory, wherein $1 \leqq X \leqq D$, changes during a period from the time when an $n(X-1)/D+1$th input signal among the n input signals is inputted until the time when $nX/D$th input signal is inputted in the order of 1 to n/D in synchronism with the input signals, and wherein the signal stored in each of the memories is read out by giving the read address to each memory and an output from each memory is outputted as the D parallel outputs.

18. An image display apparatus according to claim 17, wherein the read address to be given to the Xth memory, wherein $1 \leqq X \leqq D$, changes during a period from the time when $n(D-1)/D+1$th input signal among the n input signals is inputted until the time when n/Dth input signal among the next n input signals is inputted in the order of 1 to n/D.

19. An image display apparatus according to claim 18, wherein the read address to be given to the Xth memory, wherein $1 \leqq X \leqq D$, changes using an entire period from the time when $n(D-1)/D+1$th input signal among the n input signals is inputted until the time when n/Dth input signal among the next n input signals is inputted in the order of 1 to n/D.

20. An image display apparatus according to claim 1, further comprising a delay circuit, wherein the signal to be inputted in time-series has first to Dth parts, with D being an integer equal to or larger than 2, in the order of input in the output circuit, the output circuit is for outputting the D parallel outputs based on each of the D parts and starting to output at least one output among the D outputs earlier than starting to output other outputs, and the delay circuit is for delaying inputting the output which is started to be outputted earlier in the modulation side drive circuit.

21. An image display apparatus according to claim 1, further comprising a delay circuit, wherein the signal to be inputted in time-series has first to Dth parts, with D being an integer equal to or larger than 3, in the order of input in the output circuit, the output circuit is for outputting the D parallel outputs based on each of the D parts and starts to output each of first to D−2th outputs corresponding to the first to D−2th parts, respectively, earlier than output of D−1th part and Dth part, and the delay circuit is for delaying inputting each of the first to D−2th outputs in each of the modulation side drive circuits.

22. An image display apparatus according to claim 1, wherein the signal to be inputted in time-series has first to Dth parts, with D being an integer equal to or larger than 3, in the order of input in the output circuit, the output circuit is for outputting the D parallel outputs based on each of the D parts and starting an Xth output, wherein $1 \leqq X \leqq D-1$, at a delay of a first predetermined period from the start of input of the first part and starting a Dth output at a delay of a second predetermined period from the start of input of the first part, where the first predetermined period is X/D of a reference period that is a period required for inputting the first to Dth parts and the second predetermined period is (D−1)/D of the reference period, and wherein a delay circuit for giving a delay to an Xth output, wherein $1 \leqq X \leqq D-2$, is further provided and a delay amount by the delay circuit is (D−X−1)/D of the reference period.

23. An image display apparatus according to any one of claim 1, 20, 21 or 22, wherein the input signal to be inputted in the output circuit in time-series in order to output the plurality of parallel outputs is n time-series input signals for generating n modulation signals to be supplied in parallel with each other to the modulation wirings, the output circuit is for storing the n time-series input signals in first to Dth memories, with D being an integer equal to or larger than 3, one after another in the order of input, and each of the memories is for writing the input signals in an address designated by a write address to be given and reading a signal written in an address designated by a read address to be given, wherein a write address to be given to an Xth memory, wherein $1 \leqq X \leqq D$, changes during a period from the time when an n(X−1)/D+1th input signal among the n input signals is inputted until the time when nX/Dth input signal is inputted in the order of 1 to n/D in synchronism with the input signals, wherein the read address to be given to the Xth memory, wherein $1 \leqq X \leqq D-1$, changes during a period from the time when nX/D+1th input signal among the n input signals is inputted until the time when nX/Dth input signal among the next n input signals is inputted in the order of 1 to n/D, wherein a read address to be given to the Dth memory changes in the same manner as a read address to be given to a D−1th memory, and wherein an output from each memory is outputted as the D parallel outputs.

24. An image display apparatus according to claim 23, wherein the input signal to be inputted in the output circuit in time-series in order to output the plurality of parallel outputs is n time-series input signals for generating n modulation signals to be supplied to the modulation wirings in parallel, the output circuit is for storing the n time-series input signals in first to Dth memories, with D being an integer equal to or larger than 3, one after another in the order of input, and each of the memories is for writing the input signals in an address to be designated by a write address to be given and reading a signal written in an address designated by a read address to be given, wherein a write address to be given to an Xth memory, wherein $1 \leqq X \leqq D$, changes during a period from the time when an n(X−1)/D+1th input signal among the n input signals is inputted until the time when nX/Dth input signal is inputted in the order of 1 to n/D in synchronism with the input signals, wherein the read address to be given to the Xth memory, wherein $1 \leqq X \leqq D-1$, changes using an entire period from the time when nX/Dth input signal among the n input signals is inputted until the time when nX/Dth input signal among the next n input signals is inputted in the order of 1 to n/D, wherein a read address to be given to the Dth memory changes in the same manner as a read address to be given to a D−1th memory, and wherein an output from each memory is outputted as the D parallel outputs.

25. An image display apparatus according to claim 1, wherein the plurality of modulation side drive circuits are for supplying modulation signals to the same number of the modulation wirings, respectively.

26. An image display apparatus according to any one of claims 1 to 8, wherein the number of modulation wirings to which each of the plurality of modulation side drive circuits supplies a modulation signal is not the same number.

27. An image display apparatus according to claim 26, wherein: the signal to be inputted in time-series has first to Dth parts, with D being an integer equal to or larger than 2, in the order of input in the output circuit; the output circuit is for outputting the D parallel outputs based on each of the D parts; and the number of modulation wirings to which the modulation side drive circuit, in which a first output corresponding to the first part is inputted, supplies a modulation signal is fewer than the number of modulation wirings to which the modulation side drive circuit, in which a Dth output corresponding to the Dth part is inputted, supplies a modulation signal.

28. An image display apparatus according to claim 26, wherein the input signal to be inputted in time-series in the output circuit in order to output the plurality of parallel outputs is n time-series input signals for generating n modulation signals to be supplied in parallel with each other to the modulation wirings and satisfies a condition:

$$d[X] \leqq M\left(d[D] + \sum_{x=1}^{X} d[x]\right) \quad [X = 1 \sim D-1] \tag{1}$$

$$d[D] \leqq M\left(\sum_{x=1}^{D} d[x]\right)$$

when the output circuit turns the n time-series input signals into first to Dth parts, with D being an integer equal to or larger than 2, in the order of input and outputs an output corresponding to each part as the plurality of parallel outputs, a ratio of the number of modulation wirings to which the modulation side drive circuit, in which an output corresponding to each part is inputted, supplies the modulation signal is d[1]:d[2]: . . . :d[D−1]:d[D], and a transfer speed of a signal in each of the output paths is a speed M times as large as the input speed of the input signal.

29. An image display apparatus according to claim 26, wherein the input signal to be inputted in time-series in the output circuit in order to output the plurality of parallel outputs is n time-series input signals for generating n modulation signals to be supplied in parallel with each other to the modulation wirings and satisfies a condition:

$$d[X] = M\left(d[D] + \sum_{x=1}^{X} d[x]\right) \quad [X = 1 \sim D - 1] \tag{2}$$

$$d[D] = M\left(\sum_{x=1}^{D} d[x]\right)$$

when the output circuit turns the n time-series input signals into first to Dth parts, with D being an integer equal to or larger than 2, in the order of input and outputs an output corresponding to each part as the plurality of parallel outputs, a ratio of the number of modulation wirings to which the modulation side drive circuit, in which an output corresponding to each part is inputted, supplies the modulation signal is d[1]:d[2]: . . . :d[D−1]:d[D], and a transfer speed of a signal in each of the output paths is a speed M times as large as the input speed of the input signal.

30. An image display apparatus according to claim 1, wherein the output circuit has a memory for carrying out the storage and a memory for storing at least the Dth part is a memory capable of nonexclusively carrying out writing and reading.

31. An image display apparatus according to claim 30, wherein the memory for storing the first part is a memory capable of nonexclusively carrying out writing and reading.

32. An image display apparatus according to claim 1, wherein: the signal to be inputted in time-series has first to Dth parts, with D being an integer equal to or larger than 2, in the order of input in the output circuit; the output circuit is for outputting the D parallel outputs based on each of the D parts; memories are provided corresponding to each of the D output paths for outputting the D outputs; at least one of the D memories has two memory blocks for nonexclusively carrying out writing and reading; and after a part of corresponding parts among the D parts is written in one memory block, the two memory blocks carry out writing of the subsequent part in the other memory block and reading of a signal from the memory block in which a part of the input signal is written previously while causing at least a part of the writing and reading to overlap each other.

33. An image display apparatus according to claim 32, wherein each of the D memories has the two memory blocks.

34. An image display apparatus according to claim 33, in which one of the parallel outputs is constituted by signals read out from each of the two memory blocks one after another, the apparatus further comprising a delay circuit for alleviating deviation in starting of input of each of the parallel outputs in each of the modulation side drive circuits.

35. An image display apparatus according to claim 33, wherein when numbers are allocated to memory blocks, which are provided two for each of the first to Dth outputs, in the order of inputting the input signals, the number of input signals to be written in a memory block of an odd number and the number of input signals to be written in a memory block of an even number satisfy the following expression:

1/D≦ the number of input signals to be written in a memory block of an odd number/the number of input signals to be written in a memory block of an even number D, and wherein the number of input signals to be written in each memory block is equal to or more than 1/D(D+1) times and equal to or less than D/D(D+1) times the total number of modulation wirings through which each modulation side drive circuit supplies a modulation signal.

36. An image display apparatus according to claim 34, wherein when numbers are allocated to memory blocks, which are provided two for each of the first to Dth outputs, in the order of inputting the input signals, the number of input signals to be written in a memory block of an odd number and the number of input signals to be written in a memory block of an even number satisfy the following expression:

1/D≦ the number of input signals to be written in a memory block of an odd number/the number of input signals to be written in a memory block of an even number ≦D, and wherein the number of input signals to be written in each memory block is equal to or more than 1/D(D+1) times and equal to or less than D/D(D+1) times the total number of modulation wirings through which each modulation side drive circuit supplies a modulation signal.

37. An image display apparatus according to claim 32, in which one of the parallel outputs is constituted by signals read out from each of the two memory blocks one after another, the apparatus further comprising a delay circuit for alleviating deviation in starting of input of each of the parallel outputs in each of the modulation side drive circuits.

38. An image display apparatus according to claim 37, wherein when numbers are allocated to memory blocks, which are provided two for each of the first to Dth outputs, in the order of inputting the input signals, the number of input signals to be written in a memory block of an odd number and the number of input signals to be written in a memory block of an even number satisfy the following expression:

1/D≦ the number of input signals to be written in a memory block of an odd number/the number of input signals to be written in a memory block of an even number D, and wherein the number of input signals to be written in each memory block is equal to or more than 1/D(D+1) times and equal to or less than D/D(D+1) times the total number of modulation wirings through which each modulation side drive circuit supplies a modulation signal.

39. An image display apparatus according to claim 32, wherein when numbers are allocated to memory blocks, which are provided two for each of the first to Dth outputs, in the order of inputting the input signals, the number of input signals to be written in a memory block of an odd number and the number of input signals to be written in a memory block of an even number satisfy the following expression:

1/D≦ the number of input signals to be written in a memory block of an odd number/the number of input signals to be written in a memory block of an even number ≦D, and wherein the number of input signals to be written in each memory block is equal to or more than 1/D(D+1) times and equal to or less than D/D(D+1) times the total number of modulation wirings through which each modulation side drive circuit supplies a modulation signal.

40. An image display apparatus according to any one of claims 32 to 36, wherein when numbers are allocated to memory blocks, which are provided two for each of the first to Dth outputs, in the order of inputting the input signals, if X is an odd number from 1 to 2D−3 and 2D, the number of input signals to be written in an Xth memory block is D/D(D+1) times the total number of modulation wirings to which each modulation side drive circuit supplies a modulation signal, and if X is an even number from 2 to 2D−2 and 2D−1, the number of input signals to be written in an Xth memory block is 1/D(D+1)times the total number of modulation wirings to which each modulation side drive circuit supplies a modulation signal.

41. An image display apparatus according to claim 1, wherein transfer speeds of the plurality of parallel outputs are substantially equal.

42. An image display apparatus according to claim 1, wherein the signal to be inputted in time-series has first to Dth parts, with D being an integer equal to or larger than 2, in the order of input in the output circuit, the output circuit is for outputting the D parallel outputs based on each of the D parts, and the D parallel outputs are started to be inputted in each of the modulation side drive circuits substantially simultaneously.

43. An image display apparatus according to claim 1, in which an R input signal, a G input signal and a B input signal are inputted respectively, and the output circuits are provided for the input signals of each color, the apparatus further comprising a composition circuit for composing outputs to be outputted to the same modulation side drive circuit among the plurality of parallel outputs of each output circuit.

44. An image display apparatus according to claim 1, wherein the display element is an electron-emitting element.

45. An image display apparatus according to claim 1, wherein the input signal to be inputted in time-series for one scan wiring is divided into said parallel outputs.

46. An image display apparatus comprising:

a plurality of scan wirings;

a plurality of modulation wirings forming a matrix wiring together with the scan wirings;

display elements driven in matrix according to a scan signal to be applied by the scan wirings and a modulation signal applied by the modulation wirings;

a scan circuit for scanning the plurality of scan wirings and applying a scan signal to a selected scan wiring;

an output circuit including a first output circuit for storing an input signal for displaying a first color to be inputted in time-series and generating D outputs, with D being an integer equal to or larger than 2, consisting of time-series signals for generating modulation signals based on the stored result to output the D outputs to D output paths as parallel outputs, a second output circuit for storing an input signal for displaying a second color to be inputted in time-series and generating D outputs consisting of time-series signals for generating modulation signals based on the stored result to output the D outputs to D output paths as parallel outputs, and D composition circuits for composing outputs that are outputted to an Xth output path, wherein 1≦X≦D, among the D output paths to which the outputs from the first output circuit are outputted and an Xth output path, wherein 1≦X≦D, among the D output paths to which the outputs from the second output circuit are outputted respectively; and a modulation side drive circuit for outputting parallel modulation signals based on time-series signals for generating modulation signals to be outputted from the composition circuit, wherein the modulation side drive circuit is provided in plural forms associated with each of the D composition circuits and each of the plurality of modulation side drive circuits supplies the modulation signal to a part of and a plurality of modulation wirings among the plurality of modulation wirings, wherein the display elements are arranged such that a plurality of display elements to which the scan signals are given simultaneously by one scan wiring include a display element for displaying the first color and a display element for the second color, and wherein the composition circuit is for composing outputs from the first output circuit and the second output circuit according to the arrangement of the display element for displaying the first color and the display element for displaying the second color.

47. An image display apparatus comprising:

a plurality of scan wirings;

a plurality of modulation wirings forming a matrix wiring together with the scan wirings;

display elements to be driven in matrix according to a scan signal applied by the scan wirings and a modulation signal applied by the modulation wirings;

a scan circuit for scanning the plurality of scan wirings and applying a scan signal to a selected scan wiring;

an output circuit including a first output circuit for storing an input signal for displaying red to be inputted in time-series and generating D outputs, with D being an integer equal to or larger than 2, consisting of time-series signals for generating modulation signals based on the stored result to output the D outputs to D output paths as parallel outputs, a second output circuit for storing an input signal for displaying green to be inputted in time-series and generating D outputs consisting of time-series signals for generating modulation signals based on the stored result to output the D outputs to D output paths as parallel outputs, a third output circuit for storing an input signal for displaying blue to be inputted in time-series and generating D outputs consisting of time-series signals for generating modulation signals based on the stored result to output the D outputs to D output paths as parallel outputs, and D composition circuits for composing outputs that are outputted to an Xth output paths, wherein 1≦X≦D, among the D output paths to which the outputs from the first output circuit are outputted, an Xth output path, wherein 1≦X≦D, among the D output paths to which the outputs from the second output circuit are outputted, and an Xth output path, wherein 1≦X≦D, among the D output paths to which the outputs from the third output circuit are outputted respectively; and a modulation side drive circuit for outputting parallel modulation signals based on time-series signals for generating modulation signals to be outputted from the composition circuit, wherein the modulation side drive circuit is provided in plural forms associated with each of the D composition circuits and each of the plurality of modulation side drive circuits supplies the modulation signal to a part of and a plurality of modulation wirings among the plurality of modulation wirings, wherein the display elements are arranged such that a plurality of display elements to which the scan signals are given simultaneously by one scan wiring include a display element for displaying red, a display element for displaying green and a display element for displaying blue, and wherein the composition circuit is for composing outputs from the first output circuit, the second output circuit and the third output circuit according to the arrangement of the display element for displaying red, the display element for displaying green and the display element for displaying blue.

* * * * *

UNITED STATES PATENT AND TRADEMARK OFFICE

CERTIFICATE OF CORRECTION

PATENT NO. : 7,053,888 B2
APPLICATION NO. : 10/054895
DATED : May 30, 2006
INVENTOR(S) : Muneki Ando It is certified that error appears in the above-identified patent and that said Letters Patent is hereby corrected as shown below:

[56] REFERENCES CITED:

U.S. PATENT DOCUMENTS, "5,771,031 6/1998 Kinoshita et al." should read --5,771,031 1/1998 Kinoshita et al.--.

COLUMN 7:

Line 7, "time-senes" should read --time-series--.
Line 11, "senes" should read --series--.

COLUMN 21:

Line 46, "unit" should read --unit is (D − X – 1)/D2 times the capacity for one scan wiring.--.

COLUMN 29:

Line 26, "and (2)," should read --and (2), $$R1 + W1 + R2 + W2 = T(1 + 1/D) \qquad (3)\text{--}.$$

Line 41, "$R1 + W1 \leq T$" should read --$R1 + W1 < T$--.
Line 43, "$R2 + W2 \leq T$" should read --$R2 + W2 < T$--.
Line 49, "$n \leq D$" should read --$n < D$--.

COLUMN 34:

Line 33, "claims 1-9," should read --claims 1 to 16,--.

COLUMN 36:

Line 23, "nX/Dth" should read --nX/D + 1th--.

UNITED STATES PATENT AND TRADEMARK OFFICE

CERTIFICATE OF CORRECTION

PATENT NO. : 7,053,888 B2
APPLICATION NO. : 10/054895
DATED : May 30, 2006
INVENTOR(S) : Muneki Ando It is certified that error appears in the above-identified patent and that said Letters Patent is hereby corrected as shown below:

COLUMN 39:

Line 15, "claims 32 to 36," should read --claims 32 to 39,--.

Signed and Sealed this

First Day of January, 2008

JON W. DUDAS
*Director of the United States Patent and Trademark Office*